US010321765B2

(12) United States Patent
Wong

(10) Patent No.: US 10,321,765 B2
(45) **Date of Patent: *Jun. 18, 2019**

(54) TRAVEL PILLOW

(71) Applicant: Cabeau, Inc., Woodland Hills, CA (US)

(72) Inventor: Jon Wong, Long Beach, CA (US)

(73) Assignee: Cabeau, Inc., Woodhills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/125,095

(22) PCT Filed: Mar. 11, 2015

(86) PCT No.: PCT/US2015/020038

§ 371 (c)(1),
(2) Date: Sep. 9, 2016

(87) PCT Pub. No.: WO2015/138654

PCT Pub. Date: Sep. 17, 2015

(65) Prior Publication Data

US 2017/0071349 A1 Mar. 16, 2017

Related U.S. Application Data

(63) Continuation-in-part of application No. 14/518,719, filed on Oct. 20, 2014, now Pat. No. 9,968,197.

(Continued)

(51) Int. Cl.

*A47G 9/10* (2006.01)
*A47G 9/00* (2006.01)

(Continued)

(52) U.S. Cl.

CPC ..... *A47C 7/383* (2013.01); *A47G 9/1081* (2013.01); *A47C 20/02* (2013.01); *A47G 9/10* (2013.01); *A47G 2009/1018* (2013.01)

(58) Field of Classification Search

CPC ..... A47G 9/10; A47G 9/1036; A47G 9/00; A47G 9/1081; A47G 2009/1018; A47C 9/38; A47C 20/02; A47C 7/383

See application file for complete search history.

(56) References Cited

U.S. PATENT DOCUMENTS 15,581 A 8/1856 Slaughter
D98,859 S 1/1870 Fast (Continued)

FOREIGN PATENT DOCUMENTS

AU 199176466 11/1991
AU A7646691 11/1991

(Continued)

OTHER PUBLICATIONS

Office Action from Chinse Patent Appl. No. 201580023142.2 dated Jun. 2, 2017.

(Continued)

*Primary Examiner* — Nicholas F Polito
*Assistant Examiner* — Rahib T Zaman
(74) *Attorney, Agent, or Firm* — DLA Piper (US)

(57) ABSTRACT

A travel pillow for supporting the head of a person when seated comprises a generally U-shaped frame having two side members and a rear member, and a padded generally U-shaped cushion fixed with the frame. In one embodiment, the pillow includes a plurality of cushions each fixed along the frame. The frame and cushion may include a plurality of mutually-aligned ventilation apertures therethrough to cool the person's neck and head. The frame may include a plurality of connectable, size-adjustable, or hinged segments for allowing the pillow to be collapsed for storage or transport. In one embodiment, the frame is replaced by a plurality of rigid grommets fixed about each ventilation aperture, or a pair of lateral frames at side sections of the (Continued)

pillow. A travel pillow includes a resilient inner frame having a rear portion and two side portions, and U-shaped outer cushion fixed about the inner frame and including a rear portion and two side portions. Each side portion, and optionally the rear portions, includes at least one transverse air apertures therethrough. Each side portion of the inner frame further includes a forward end. The side portions may each include a drawstring aperture at the forward end for receiving a drawstring having two halves, each of which being fixed at a proximal end thereof at the drawstring apertures and being mutually and selectively fixable at distal ends thereof at one part of a two-part mechanical fastener. A flexible cover that has an opening therethrough into which the inner frame and the outer cushion are inserted may be included that has at least one ventilation area through which air may travel.

5 Claims, 52 Drawing Sheets

Related U.S. Application Data

(60) Provisional application No. 61/951,421, filed on Mar. 11, 2014.

(51) Int. Cl.
*A47C 7/38* (2006.01)
*A47C 20/02* (2006.01)

(56) References Cited

U.S. PATENT DOCUMENTS 1,468,072 A 9/1923 Ogle ..... 5/654
1,787,832 A 5/1929 Mueller
3,327,330 A 6/1967 McCullough
4,031,578 A 6/1977 Sweeney et al.
D256,728 S 9/1980 Allen
4,285,081 A 8/1981 Price ..... 5/637
4,345,347 A 8/1982 Kantor ..... 5/644
4,617,691 A * 10/1986 Monti ..... A47C 7/383 128/DIG. 23
5,205,611 A 4/1993 Stephens
5,313,678 A 5/1994 Redwill ..... 5/639
5,339,472 A 8/1994 Yin
5,378,042 A 1/1995 Daneshvar
5,423,099 A * 6/1995 Gulli ..... A47D 13/08 5/638
5,588,445 A 12/1996 Brown
D396,594 S 8/1998 Lefebvre
D396,980 S 8/1998 Novros
D404,238 S 1/1999 Keilhaur
D414,974 S 10/1999 Marrone et al.
D416,745 S 11/1999 Noyes
5,974,607 A * 11/1999 Smith ..... A61G 7/072 297/393
D419,024 S 1/2000 Lenahan
6,010,192 A 1/2000 King ..... 297/397
D420,845 S 2/2000 Rumage
6,230,348 B1 5/2001 Patrikakis ..... 5/636
6,230,349 B1 5/2001 Silver et al. ..... 5/636
D443,461 S 6/2001 Hall
D444,981 S 7/2001 Hall
D445,624 S 7/2001 Futagami ..... D6/604
6,408,468 B1 6/2002 Comfort ..... 5/636
6,435,617 B1 8/2002 McNair ..... 297/397
6,447,468 B1 9/2002 Hankins et al. ..... 602/18
D481,247 S 10/2003 Roberts et al. ..... D6/604
6,658,681 B2 12/2003 Britto et al. ..... 5/655
D486,028 S 2/2004 Cathey
D503,062 S 3/2005 Nash
6,926,686 B2 8/2005 Cheatham
D522,300 S 6/2006 Roberts
7,185,378 B2 3/2007 Smith ..... 5/642
7,225,485 B2 6/2007 Binder ..... 5/644
D550,495 S 9/2007 Boutin
D567,562 S 4/2008 Nash
7,437,788 B1 10/2008 Holman ..... 5/636
D582,045 S 12/2008 James
D582,713 S 12/2008 Baldwin ..... D6/601
D597,364 S 8/2009 Lindgren
D607,682 S 1/2010 Presman
D619,402 S 7/2010 Sternlight et al. ..... D6/601
7,779,492 B2 8/2010 Mangano ..... 5/482
7,788,752 B2 9/2010 Tidwell et al. ..... 5/655
7,865,987 B2 1/2011 Deetsch ..... 5/640
7,909,406 B2 3/2011 Samuelsen ..... 297/397
D637,439 S 5/2011 Mettler
D637,440 S 5/2011 Mettler
8,144,913 B1 3/2012 Myles ..... 381/374
8,239,987 B2 8/2012 Sharp ..... 5/639
8,316,488 B2 11/2012 Rojas
8,646,134 B1 2/2014 Alletto, Jr.
8,887,332 B2 11/2014 Alletto
8,898,840 B1 * 12/2014 Majette ..... A47C 7/383 297/393
8,911,020 B2 * 12/2014 Westerink ..... B60N 2/80 297/407
9,015,883 B2 4/2015 Alletto
9,032,570 B1 * 5/2015 Benami ..... A47G 9/1009 5/640
9,155,408 B2 10/2015 Alletto, Jr.
D746,080 S 12/2015 Mittelstadt ..... D6/601
D754,454 S 4/2016 Schwingendorf ..... D6/601
9,386,868 B2 7/2016 Alletto, Jr.
D762,400 S 8/2016 Wong ..... D6/601
D769,029 S 10/2016 Okwumabua ..... D6/601
2001/0054837 A1 12/2001 O'Connor
2002/0050007 A1 * 5/2002 Kim ..... A47G 9/10 5/636
2003/0135927 A1 * 7/2003 Hsia ..... A47G 9/1009 5/640
2003/0137178 A1 7/2003 Craft et al. ..... 297/452.41
2003/0196269 A1 * 10/2003 Britto ..... A47D 13/083 5/636
2005/0150050 A1 7/2005 Wolf et al. ..... 5/636
2005/0173300 A1 8/2005 O'Connor
2005/0179300 A1 8/2005 O'Connor et al. ..... 297/391
2005/0229557 A1 * 10/2005 Little ..... A47C 7/383 55/385.1
2007/0033737 A1 2/2007 Melton ..... 5/640
2007/0056107 A1 3/2007 Gabriel
2007/0067915 A1 3/2007 Pryor ..... 5/636
2007/0271703 A1 11/2007 Brown et al. ..... 5/636
2007/0297633 A1 12/2007 Kaulfuss
2008/0104764 A1 5/2008 Chen ..... 5/644
2008/0216244 A1 9/2008 Minton ..... 5/640
2008/0229498 A1 9/2008 Grosso ..... 5/244
2009/0013471 A1 1/2009 Yang ..... 5/640
2009/0019641 A1 * 1/2009 Ali ..... B60N 2/885 5/636
2009/0133193 A1 5/2009 Weise ..... 5/640
2009/0276960 A1 11/2009 Chou
2011/0094033 A1 * 4/2011 Lee ..... A61F 5/56 5/636
2011/0235832 A1 9/2011 Riopel ..... 381/300
2011/0314609 A1 12/2011 Lee ..... 5/655.3
2012/0011655 A1 1/2012 Rojas ..... 5/636
2012/0023676 A1 * 2/2012 Hansen ..... A47G 9/10 5/636
2012/0313417 A1 * 12/2012 Hurwitz ..... B60N 2/882 297/391
2013/0098364 A1 4/2013 Davis et al.
2013/0125312 A1 5/2013 Harooni ..... 5/639
2013/0232693 A1 9/2013 Myers ..... 5/636
2013/0232694 A1 * 9/2013 Ross ..... A47G 9/1009 5/639
2014/0000036 A1 1/2014 Cohen
2014/0026323 A1 * 1/2014 Bowers ..... A47G 9/10 5/636

(56) References Cited

U.S. PATENT DOCUMENTS

| | | | | |
|---|---|---|---|---|
| 2014/0041091 | A1* | 2/2014 | Sternlight | B60N 2/882 2/12 |
| 2014/0310877 | A1* | 10/2014 | Sternlight | A47G 9/10 5/639 |
| 2015/0150391 | A1* | 6/2015 | Hsu | A47G 9/10 5/636 |
| 2015/0257555 | A1 | 9/2015 | Wong | |
| 2016/0183685 | A1 | 6/2016 | Kang | 5/639 |
| 2017/0000273 | A1 | 1/2017 | Mitchell | |

FOREIGN PATENT DOCUMENTS

| | | | |
|---|---|---|---|
| AU | 2003201842 | | 10/2003 |
| AU | 2003201842 | A1 | 10/2003 |
| CN | 86300949 | | 5/1987 |
| CN | 3006418 | | 9/1990 |
| CN | 3010552 | | 9/1991 |
| CN | 3015753 | | 10/1992 |
| CN | 3052608 | | 12/1996 |
| CN | 013590715 | | 12/2001 |
| CN | 3238498 | | 5/2002 |
| CN | 3289601 | | 4/2003 |
| CN | 3435056 | | 3/2005 |
| CN | 3440171 | | 4/2005 |
| CN | 3476279 | | 9/2005 |
| CN | 2836650 | | 11/2005 |
| CN | 3487002 | | 11/2005 |
| CN | 3497652 | | 1/2006 |
| CN | 2006301323942 | | 6/2006 |
| CN | 3563694 | | 9/2006 |
| CN | 3578942 | | 11/2006 |
| CN | 3614520 | | 2/2007 |
| CN | 300685967 | | 9/2007 |
| CN | 300690834 | | 9/2007 |
| CN | 300707538 | | 11/2007 |
| CN | 300711427 | | 11/2007 |
| CN | 300774484 | | 5/2008 |
| CN | 300611885 | | 8/2008 |
| CN | 300882439 | | 2/2009 |
| CN | 300892694 | | 3/2009 |
| CN | 300941334 | | 6/2009 |
| CN | 300959418 | | 7/2009 |
| CN | 301025929 | | 9/2009 |
| CN | 301109905 | | 1/2010 |
| CN | 301137730 | | 2/2010 |
| CN | 301151430 | | 3/2010 |
| CN | 102166088 | | 8/2011 |
| CN | 201958085 | | 8/2011 |
| CN | 202014937 | | 10/2011 |
| CN | 202014937 | U | 10/2011 |
| CN | 103126791 | A | 6/2013 |
| CN | 203106519 | | 8/2013 |
| CN | 103458742 | | 12/2013 |
| CN | 103458742 | A | 12/2013 |
| CN | 103619219 | A | 3/2014 |
| FR | 1076118 | | 10/1954 |
| GB | 2198341 | A1 | 6/1988 |
| GB | 2055656 | | 8/1996 |
| JP | 200015308 | | 10/2001 |
| JP | 3132278 | | 5/2007 |
| JP | 1543718 | | 2/2015 |
| KR | 3019990015333 | | 2/2000 |
| KR | 3020000029799 | | 5/2001 |
| KR | 3020010000482 | | 8/2001 |
| KR | 3020010007585 | | 8/2001 |
| KR | 20050019575 | | 3/2005 |
| KR | 20050019575 | A | 3/2005 |
| KR | 200424871 | | 8/2006 |
| KR | 3020070002191 | | 1/2007 |
| KR | 3020080018019 | | 5/2008 |
| KR | 3020080039948 | | 10/2008 |
| KR | 3020080049371 | | 11/2008 |
| KR | 3008249610000 | | 11/2015 |
| RU | 34338 | U1 | 12/2003 |
| TW | M448227 | | 3/2013 |
| WO | WO 2011122769 | | 10/2011 |
| WO | 2013155003 | A1 | 10/2013 |
| WO | WO 2013155003 | A1 | 10/2013 |

OTHER PUBLICATIONS

Written Opinion of the International Searching Authority, appl. No. PCT/US2015/020038, dated May 29, 2015.
International Search Report for International Application No. PCT/US16/54175; dated Sep. 28, 2016.
3rd party observations filed against European Patent Application No. 13745557.2, filed on Oct. 26, 2016.
Office Action for European Patent Application No. 15761243.3; dated Oct. 18, 2017.
Intention to Grant from European Patent Appl. No. 13 745 557 2-1653, dated Dec. 22, 2016.
Office Action from U.S. Appl. No. 15/346,742, dated Jan. 9, 2017.
Edge, (n. d.) American Heritage® Dictionary of the English Language, Fifth Edition. (2011) Retrieved Jan. 3, 2017 from http://www.thefreedictionary.com/edge.
Office Action from U.S. Appl. No. 29/568,003, dated Jan. 26, 2017.
Examination Report from corresponding patent appl. No. GB1418089.7, dated Feb. 22, 2017.
Search Report from Russian Federation patent application No. 2013131760, dated Mar. 6, 2017.
Third Party Submittal, Kirby IP Canada, dated Sep. 18, 2015.
Third Party Observation from International Appl. No. PCT/US2013/035646, dated Jun. 16, 2014.
Third Party Observation from Australian Appl. No. AU2014100424, dated Jun. 18, 2014.
Patent Examination Report No. 2, from Australian Patent Appl. No. 2013206536, dated Jan. 16, 2015.
Supplementary European Search Report from Appl. No. EP13745557, dated Sep. 15, 2014.
Third Party Observation for Appl. No. EP20130745557, dated Jun. 14, 2014.
Office Action from U.S. Appl. No. 13/488,443, dated Apr. 18, 2014.
Office Action from U.S. Appl. No. 13/488,443, dated Jul. 23, 2015.
Office Action from U.S. Appl. No. 13/488,443, dated Oct. 29, 2014.
Response to Office Action from U.S. Appl. No. 13/488,433, dated Apr. 28, 2015.
Response to Office Action from U.S. Appl. No. 13/488,133, dated Sep. 18, 2014.
Response to Office Action from U.S. Appl. No. 13/488,433, dated Dec. 12, 2014.
Office Action from U.S. Appl. No. 14/394,259, dated May 7, 2015.
Response to Office Action from U.S. Appl. No. 14/394,259, dated Nov. 9, 2015.
Examination from European Patent Appl. No. 13 745 557.2, dated Jun. 12, 2015.
Notice of Preliminary Rejection from Korean Patent Appl. No. 10-2013-7034274, dated Jul. 2, 2015.
International Search Report and Written Opinion from corresponding PCT application No. PCT/US2015/020038, dated May 29, 2015.
Third party observations on Great Britain Appl. No. GB1418089.7 dated Jun. 23, 2016.
Notice of Final Rejection from Korean Patent Appl. No. 10-2013-7034271, dated Apr. 15, 2016.
First Office Action (summary) from Mexican Design Appl. No. MX/f/2015/001297, dated Mar. 14, 2016.
Notice of Allowance and Search Report from Taiwanese Patent Appl. No. 104302012, dated Apr. 20, 2016.
Third Party Observations from corresponding UK Patent appl. No. 1418089.7 dated Oct. 27, 2015.
Examination from European Patent Appl. No. 13 745 557.2-1653, dated Mar. 7, 2016.
Third Party Observations filed with the Australian IP against Australian Patent Appl. No. 2015202263.
Office Action from U.S. Appl. No. 13/488,443, dated Feb. 11, 2016.
Office Action from U.S. Appl. No. 14/394,259, dated Feb. 5, 2016.

(56) References Cited

OTHER PUBLICATIONS

U.S. Appl. No. 29/325,226, filed Aug. 4, 2009, Lindgren.
U.S. Appl. No. 29/196,689, filed Mar. 22, 2005, Jill Nash.
U.S. Appl. No. 29/327,069, filed Jan. 12, 2010, C. Presman.
U.S. Appl. No. 29/131,623, filed Jul. 31, 2001, T. Futagami.
U.S. Appl. No. 29/197,503, filed Feb. 1, 2005, L. M. Harris.
U.S. Appl. No. 29/174,190, filed Oct. 28, 2003, B. Roberts.
U.S. Appl. No. 29/218,857, filed Jun. 6, 2006, B. Roberts.
U.S. Appl. No. 29/098,894, filed Jan. 18, 2000, Lenahan.
U.S. Appl. No. 29/262,985, filed Sep. 11, 2007, C. Boutin.
U.S. Appl. No. 29/129,963, filed Jun. 12, 2001, D. T. Hall.
U.S. Appl. No. 29/224,808, filed Apr. 29, 2008, J. Nash.
U.S. Appl. No. 29/129,962, filed Jul. 17, 2001, D. T. Hall.
Office Action from Columbian Patent Appl. No. 14-249922-4, dated Jun. 16, 2016.
Chinese Office Action from Application No. 2015800231422 dated Jun. 4, 2018.
Taiwan Office Action Application No. 104107719 dated Feb. 22, 2019.

* cited by examiner

TRAVEL PILLOW

CROSS-REFERENCE TO RELATED APPLICATIONS

This application claims the benefit of U.S. Provisional Patent Application 61/951,421 to Wong, filed on Mar. 11, 2014 and entitled "Travel Pillow", and U.S. patent application Ser. No. 14/518,719 to Wong, filed on Oct. 20, 2014 and entitled "Travel Pillow", each of which is fully incorporated by reference herein in its entirety.

FIELD OF THE INVENTION

This invention relates to pillows, and more particularly to an improved travel pillow.

DISCUSSION OF RELATED ART

Travel pillows are well known for helping people rest or sleep when in a seated position. However, such prior art travel pillows suffer from common drawbacks such being bulky, trapping heat and moisture between the pillow and the user's neck and head, and generally being unable to adequately or comfortably support the person's head.

U.S. Pat. No. 6,926,686 to Cheatham on Aug. 9, 2005, discloses a travel pillow with some of these drawbacks. Little air is allowed to circulate between the pillow and the person's neck with this type of product, often resulting in an uncomfortably hot and sweaty neck. Further, this type of travel pillow causes the user's head to tilt forward due to a relatively large back portion that, when contacting the seat, puts pressure on the rear of the person's neck. U.S. Design Pat. No. D619,402 to Sternlight et al. on Jul. 13, 2010 teaches a similar device. PCT Application PCT/US2013/035646, published on Oct. 17, 2013 to Sternlight et al., teaches a similar device, albeit with a thinner back portion. However, low air circulation is also a drawback of this device.

SUMMARY OF THE INVENTION

The present device is a pillow for supporting the head of a person when seated, such as when sitting in an airline seat. The pillow comprises a generally U-shaped frame that has two side members and a rear member. A padded generally U-shaped cushion is fixed with the frame and is adapted to support the person's head when the frame and the cushion are fixed about the person's neck. In one embodiment, the pillow includes a plurality of cushions each fixed along the frame and adapted to support the person's head when the frame and cushions are fixed about the person's neck. The cushions may be contoured to conform to the person's jaw, shoulders, and head. The frame may be fixed completely within the cushions, be fixed with an outside surface of the cushions, or both by traversing the cushions at frame apertures of the cushions.

The present device is a travel pillow for a person. A preferably U-shaped resilient inner frame includes a rear portion and two side portions. Each side portion, and optionally the rear portion, includes at least one lateral, transverse air apertures therethrough. Each side portion of the inner frame further includes a forward end.

In one embodiment, the frame and the cushions both include a plurality of mutually-aligned ventilation apertures traversing from an inside surface of the frame and cushions to the outside surface of the frame and cushions. As such, heated air between the person's neck and the pillow may escape through the ventilation apertures, resulting in the cooling of the person's neck and head.

A removable outer cover may be adapted for receiving therein each cushion and frame. The cover may include a bag configuration for transporting or storing the pillow when not in use. Alternately, a separate carrying bag may be included.

In certain other embodiments, the frame includes a plurality of connectable segments. Adjacent such segments are preferably selectively adjustably connectable, such as with a pin-and-aperture type mechanical fastening mechanism, or the like. As such, the size of the frame is selectively adjustable to fit the person's head and neck. In one embodiment, the frame includes an inner L-shaped segment and an outer L-shaped segment that are mutually rotatably fixed at a pivot. As such, the segments may be rotated between a collapsed configuration and an expanded configuration.

In one embodiment, the frame includes a living hinge between each side member and the rear member. Alternately, the side members and rear member of the frame are each separate segments, with each side member and the rear member pivotally mutually fixed at a hinge mechanism. As such, the pillow may be folded at each living hinge between a collapsed position and an expanded position.

In one embodiment, the pillow includes the padded, generally U-shaped cushion having two side sections, a rear section, the inside surface and the outside surface, but no internal frame. The cushion is adapted for supporting the person's head when the cushion is fixed about the person's neck. The cushion further includes the plurality of ventilation apertures traversing the cushion between the inside and outside surfaces, thereof. In one such embodiment, each ventilation apertures may further include a rigid or resilient grommet adapted to add rigidity and support to the pillow. Such an embodiment may include the outer cover made from an air-permeable mesh or woven material. Alternately the cover may include cover apertures therethrough, each aligned with a corresponding ventilation aperture of the cushion.

In one such embodiment, each ventilation apertures may further include a rigid or resilient grommet adapted to add rigidity a30nd support to the pillow. Such an embodiment may include the outer cover made from an air-permeable mesh or woven material. Alternately the cover may include cover apertures therethrough, each aligned with a corresponding ventilation aperture of the cushion. In one embodiment, adjacent grommets may be connected to form framing grommets. In such an embodiment, the grommets may include an L-shaped radial cross-section or an elongated radial cross-section, so as to add sufficient rigidity to the pillow at the two side sections to support the person's head when worn.

Alternately, the pillow includes the U-shaped cushion and a pair of lateral frames at the two side sections. Each such lateral frame includes at least one of the ventilation apertures therethrough. In one embodiment, each lateral frame is fixed to either the inside surface or the outside surface of one of the side sections. Alternately, each lateral frame is fixed within one of the side sections. Each lateral frame is preferably made with a material of higher density than the cushion.

In one embodiment, the pillow further includes a pair of tie strings each looped through one of the forward-most ventilation apertures and adapted to me mutually and selectively fastened, preferably with a two-part mechanical fastener. In the embodiment of the pillow having the cover, each tie string may be threaded between the cover and the cushion, exiting the cover at a forward end of the cover at a tie string aperture.

In one embodiment, a plurality of vertical supports is fixed within the cushion on either side of the ventilation apertures. Each vertical support has a density higher than the cushion, and may be fixed between the outside surface of the cushion and each lateral frame.

In one embodiment, each side portion of the cushion terminates a lower side thereof with an outwardly-extending flared portion. As such, the lower side and the front sides of each side portion rest on the person's chest to help support the person's head when worn.

The pillow may further include a plurality of vertical ventilation apertures, preferably each intersecting one of the horizontal ventilation apertures. The framing grommets may be fixed externally to the cushion, internally to the cushion, partially or fully within either the horizontal ventilation apertures, partially or fully within either the vertical ventilation apertures, or both. In one embodiment, the inside surface of the cushion further includes a plurality of vertical ventilation channels, each of which preferably intersects one of the horizontal ventilation apertures.

In an alternate embodiment of the pillow having the pair of lateral frames, each lateral frame includes at least one ventilation aperture having a supporting grid thereacross, the frame and grid being integrally formed from a resilient polymer material.

The present invention is a travel pillow that is compact and provides for a collapsed configuration for easier travel or storage when not in use. The present device further provides for heat and moisture dissipation between the pillow and the user's head and neck, and is contoured and internally supported to better retain the user's head in a comfortable position even while seated. The present invention is further relatively inexpensive to manufacture, easy to use and aesthetically pleasing. Other features and advantages of the present invention will become apparent from the following more detailed description, taken in conjunction with the accompanying drawings, which illustrate, by way of example, the principles of the invention.

In one embodiment, a U-shaped outer cushion is fixed about the inner frame and includes a rear portion and two side portions. Each side portion, and optionally the rear portion, includes at least one lateral, transverse air apertures therethrough that are each aligned with one of the air apertures of the inner frame. Each side portion of the outer cushion further includes a forward end.

In one embodiment, an upper front portion of the side portions extends upward for contacting the person's jaw and cheek areas to support the person's head in a neutral position. The upper front portion of each side portion is padded such that the cushion compresses at least slightly for continuous support of the person's head when the person's head is in the neutral position, upright and balanced from side-to-side.

The air apertures provide for an abundance of air flow through to the person's neck. The relative size of each of the apertures may vary in size to allow different compression characteristics along the top of the travel pillow. Pillars defined between each aperture are provided to control flexion of the top portion of the outer cushion and inner frame, improve support of the person's head, and provide for a wide range of sizes.

For example, apertures, at the rear portions, may be relatively large so that the top side of the cushion at the rear portion may flex more than, for example, along areas of the side portion. Alternately, larger apertures towards the front of the side portions allow for greater air flow and flexing at the front area of the travel pillow, while smaller apertures and more rigid pillars in the back portion provide for greater support at the back of the person's head.

The travel pillow preferably can further include a closure mechanism fixed with the side portions of the inner frame and outer cushion. Preferably the side portions each include a drawstring aperture at a forward end, thereof. The closure mechanism may include, for example, a drawstring traversing the drawstring apertures of each side portion. Such a drawstring is adapted to selectively and adjustably hold the forward ends mutually together. Alternately, the closure mechanism may be the drawstring traversing at least one of the air apertures, instead of the drawstring apertures.

The drawstring preferably includes two halves, each of which is fixed at a proximal end thereof to the side portions at one of the drawstring apertures thereof. Each drawstring half is mutually and selectively fixable at a distal end thereof at one part of a two-part mechanical fastener. Such a two-part mechanical fastener preferably includes at least one magnet for holding each part together. Each part of the two-part mechanical fastener further preferably includes a spring-biased drawstring cinch mechanism for selectively fixing the part to one of the drawstring halves at a selected position along the length of the drawstring half.

In one embodiment of the invention, each side portion of the outer cushion includes an ear depression formed in a top side thereof. Such an ear depression is adapted to reduce the chance of contact between the top side of the outer cushion with the person's ears, earphones, ear buds, or the like.

The inner frame is preferably C-shaped in cross section at least along part of the side portions. As such, the top portion of the inner frame may flex under the weight of the person's head as the lower part of the inner frame resists flexing. Each side portion of the outer cushion may further include a jawbone depression formed in the top side thereof, such that the travel pillow generally fits under and around a person's jaw to support his head.

A flexible, preferably elastic chin sling may be fixed between the forward ends of each side portion of the outer cushion. Such a chin sling is adapted to support the person's chin to keep the person's head in a substantially upright position. The sling may be removable, adjustable in length and elasticity, include cooling and forming materials such as gel or micro beads, and may also function as the closure mechanism.

In one embodiment, the travel pillow further includes a flexible cover that has an opening therethrough into which the inner frame and the outer cushion are inserted. The cover includes at least one ventilation area through which air may travel. Preferably the cover includes a flexible 4-way stretch fabric.

The present invention is a travel pillow that has a dynamic compression frame and cushioning that has superior support architecture. The present device allows proper flexion for load distributions and dissipations, adjusts to the person's particular anatomy, promotes air flow between the pillow and the person's neck for reducing sweat and increasing comfort. The present device comfortably maintains the user's head in an upright, neutral position during use, and supports the user's head even if tilted to one side or back. The present invention is contoured and internally supported to better retain the user's head in a comfortable position while seated. The present device is further relatively inexpensive to manufacture, easy to use and aesthetically pleasing. Other features and advantages of the present invention will become apparent from the following more detailed description, taken in conjunction with the accompanying drawings, which illustrate, by way of example, the principles of the invention.

DESCRIPTION OF THE DRAWINGS

FIG. 38I is a cross-sectional view of a horizontal ventilation apertures, illustrating a cross-sectional view of a ninth embodiment of the frame;

FIG. 39K a cross-sectional view of a tubular grommet inserted into a vertical ventilation aperture;

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
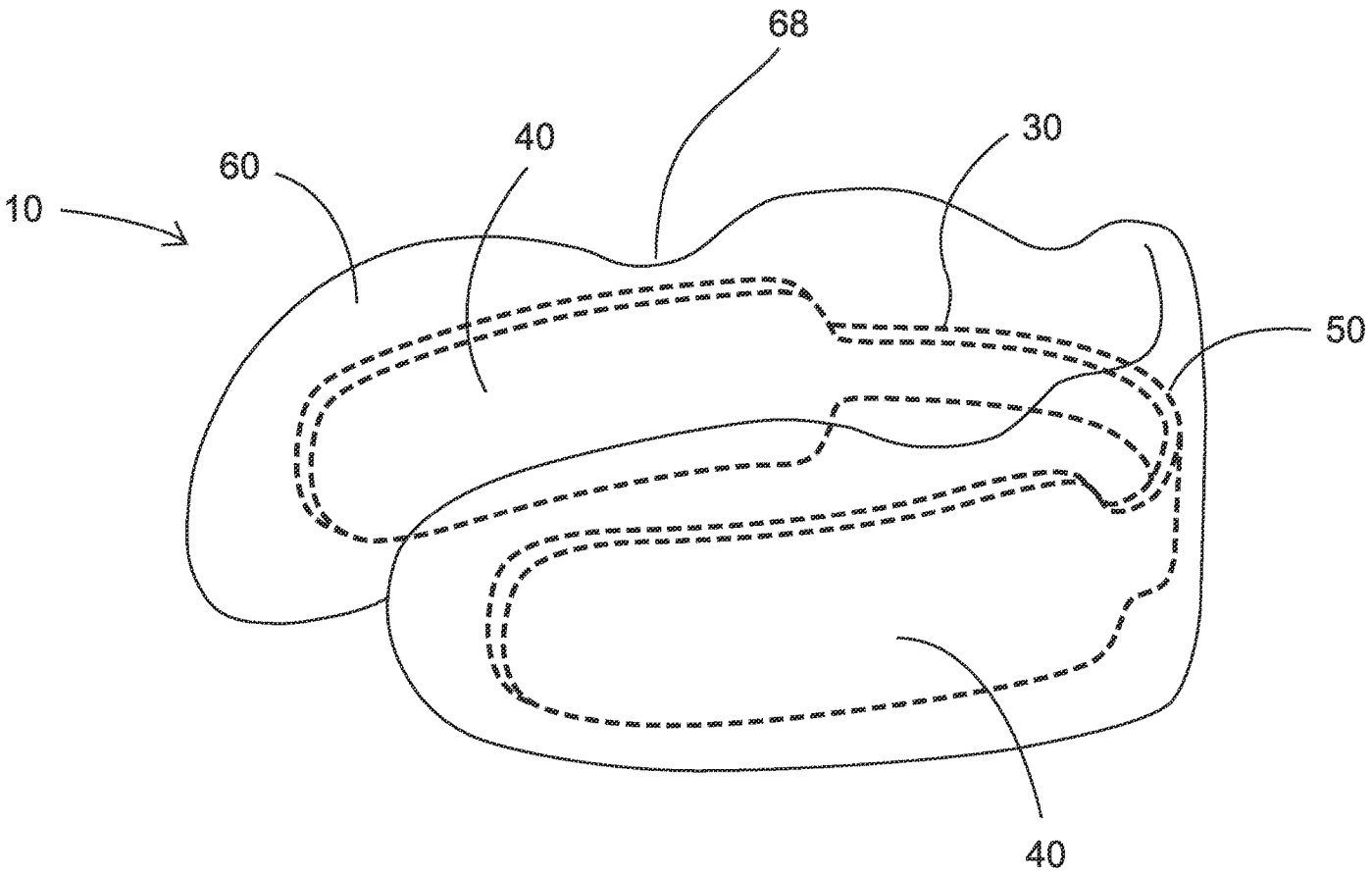
FIG. 1 is a perspective view of one embodiment of the invention, showing a frame embedded within a padded cushion.
Figure 2:
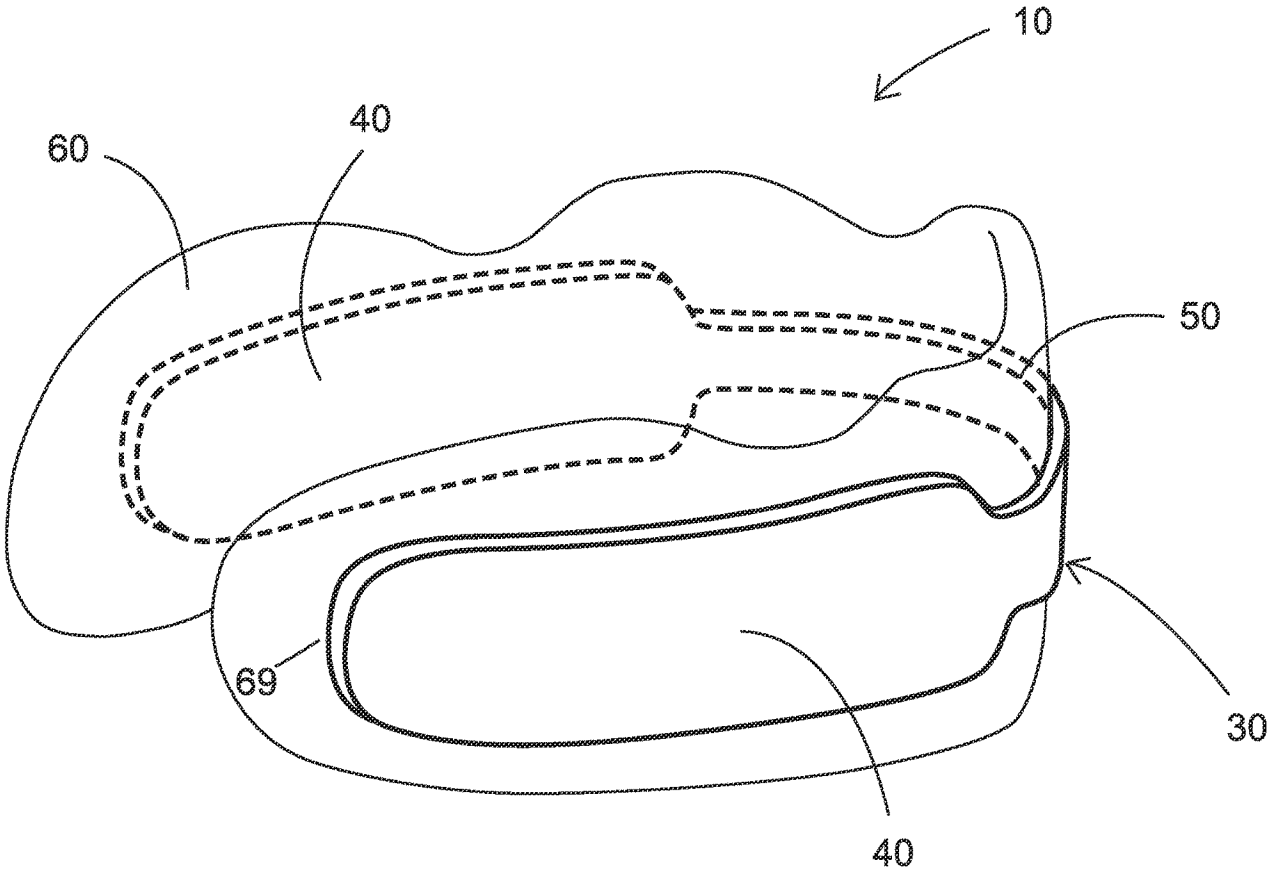
FIG. 2 is a perspective view of an alternate embodiment of the invention.
Figure 3:
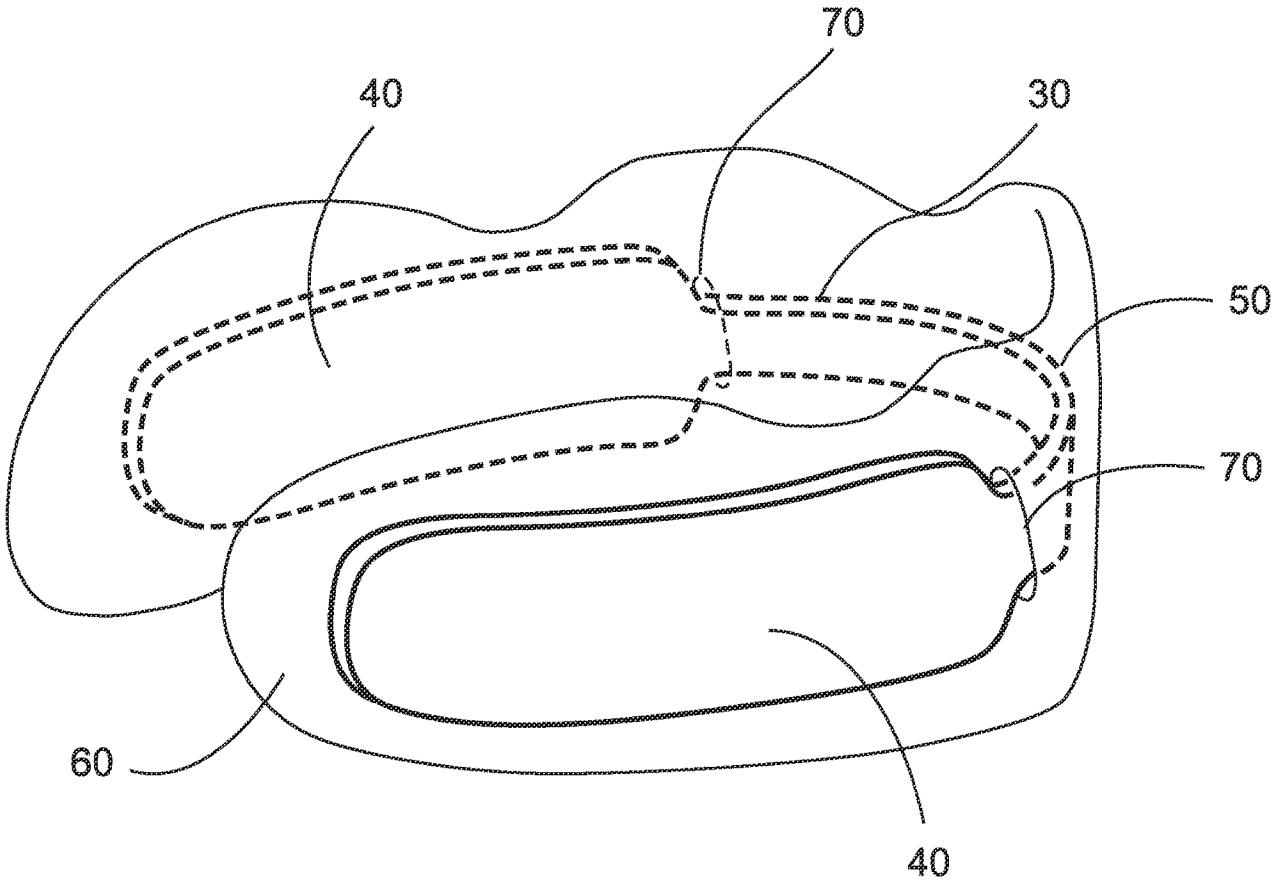
FIG. 3 is a perspective view of another alternate embodiment of the invention.

FIGS. 1-3 illustrate a pillow 10 for supporting the head 25 of a person 20 when seated, such as when sitting in an airline seat (not shown). The pillow 10 may also be used for those lying in a supine position on a bed (not shown) or other flat surface, or even a slanted surface (not shown). The pillow 10 supports the head 25 of the person from falling to the left or right uncomfortably.

Figure 31A:
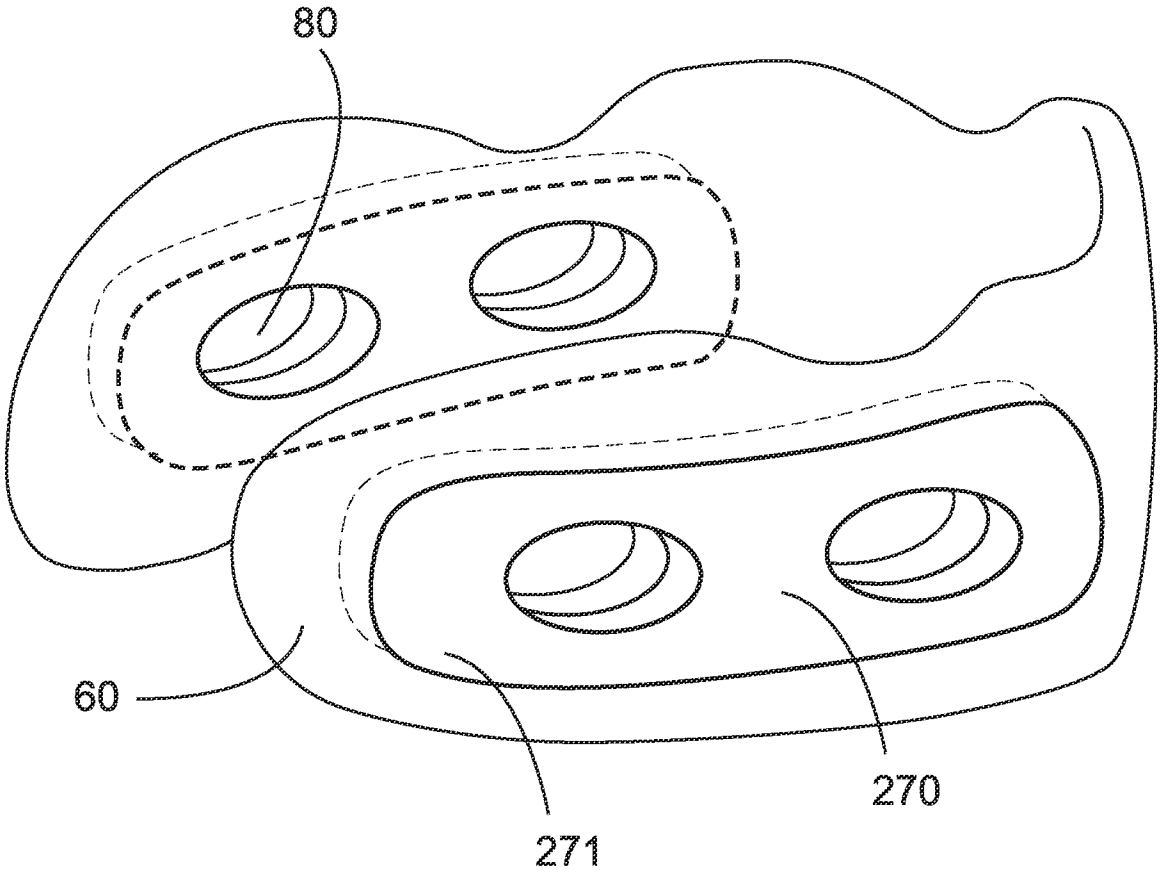
FIG. 31A is a perspective view of an alternate embodiment having two frames made with a higher density cushioning pad than the cushion thereof.
Figure 31B:
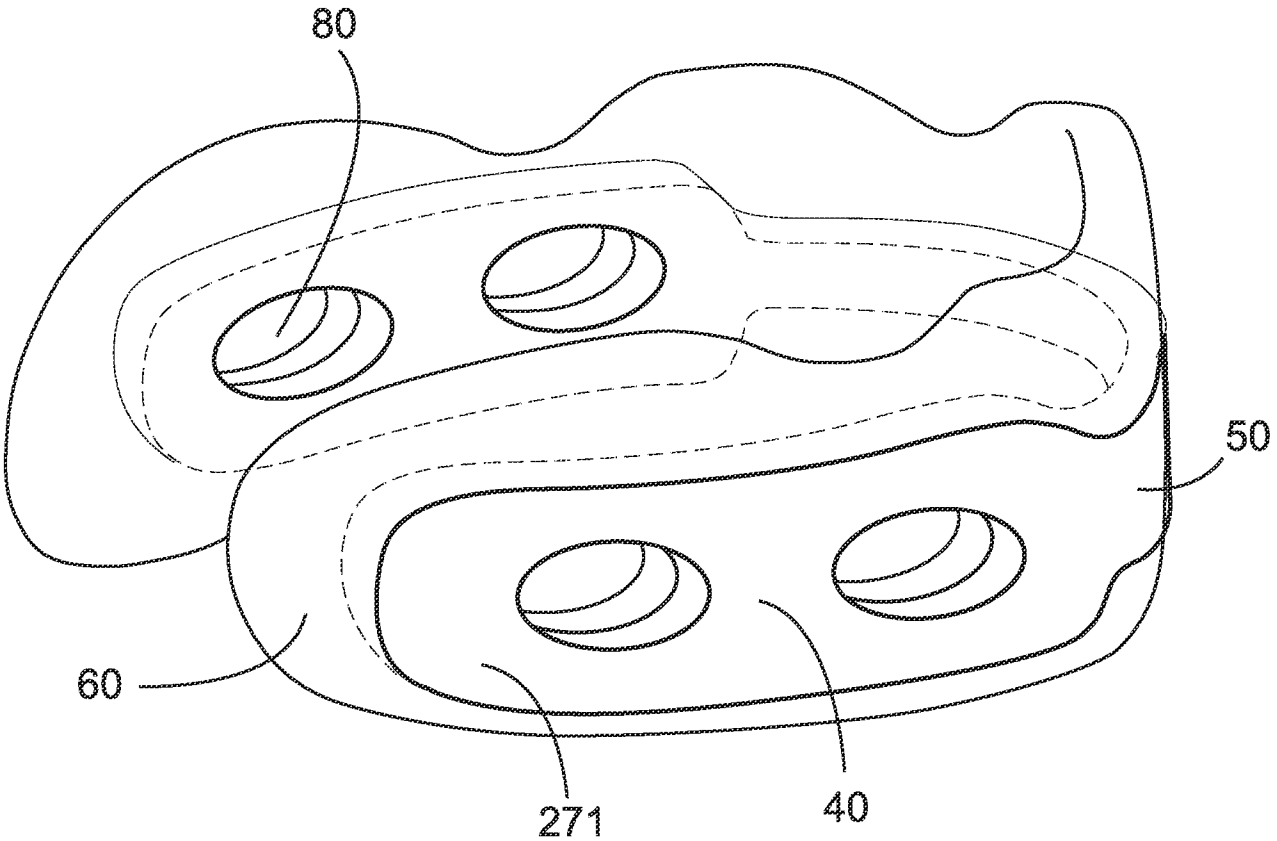
FIG. 31B is a perspective view of an alternate embodiment wherein the frame is made with a higher density cushioning pad than the cushion thereof.

The pillow 10 comprises a generally U-shaped frame 30 that has two side members 40 and a rear member 50. The frame 30 may be made from a suitably resilient or rigid material, such as plastic, aluminum, wood, rubber, or the like. In one embodiment, the frame 30 is made with a higher-density foam material than is the cushion 60 (FIG. 31B).

Figure 40:
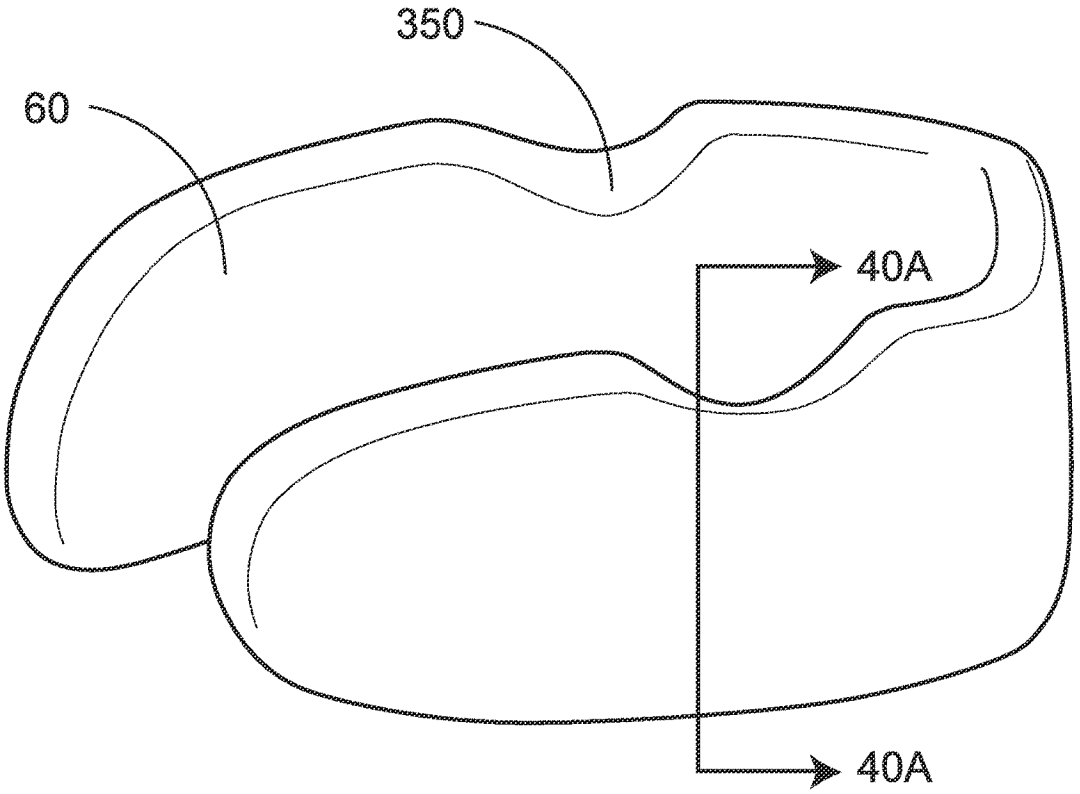
FIG. 40 is a perspective view of an alternate embodiment of the pillow, showing an ear depression in a top contoured surface of the cushion.
Figure 40A:
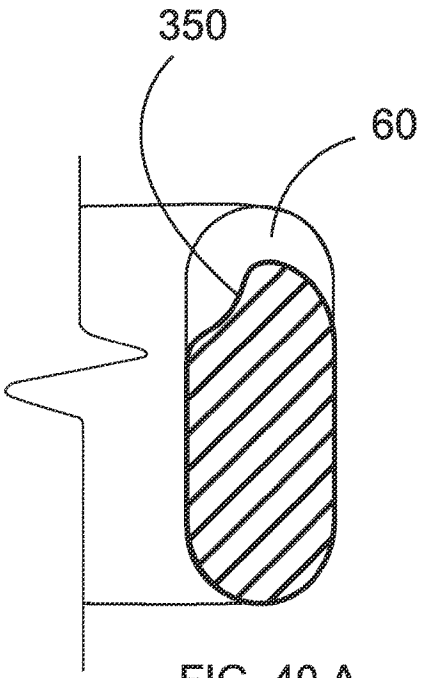
FIG. 40A is a cross-sectional view of FIG. 40 along line 40A.

A padded generally U-shaped cushion 60 is fixed with the frame 30 and is adapted to support the person's head 25 when the frame 30 and the cushion 60 are fixed about the person's neck 23. The cushion 60 may preferably include a contoured lower surface 62 for conforming to the curvature of the person's shoulders 27. Likewise, the cushion 60 may further include a contoured upper surface 68 conforming to the curvature of the person's jaw 24. A contoured upper surface 68 of the cushion 60 may further conform to the curvature of the back 26 of the person's head 25. Further, the contoured upper surface 68 may include an ear depression 350 for receiving a person's ear without contacting the ear, and for making room for access to the ear with headphones, so-called "ear buds," or the like (FIG. 40). The cushion 60 may be made from a suitably padded, resilient foam material, either open or closed foam, or other suitable material such as low-density rubber, foam rubber, or the like. Further, such a cushion 60 may further include a closed outer shell (not shown) that is generally water resistant.

In one embodiment, the frame 30 is fixed completely within the padded cushion 60 and the frame 30 is made from a rigid material, such as plastic, aluminum, or the like (FIG. 1). Alternately, the frame 30 may be fixed to an outside surface 69 of the padded cushion 60 (FIG. 2). Alternately, the frame 30 may be fixed partially within the cushion 60, wherein the frame 30 projects through the cushion 60 at a plurality of frame apertures 70 in the cushion 60 (FIG. 3). In such an embodiment, the rear member 50 may be fixed within the cushion 60 and the side members 40 of the frame 30 traverse the frame apertures 70 of the cushion 60 and are fixed to the outside surface 69 of the cushion 60 (FIG. 3), or alternately the rear member 50 of the frame 30 is fixed with the outer side 69 of the cushion 60 and the side members 40 of the frame 60 each traverse the frame apertures 70 in the cushion 60 and are at least partially fixed within the cushion 60 (not shown).

Figure 4A:
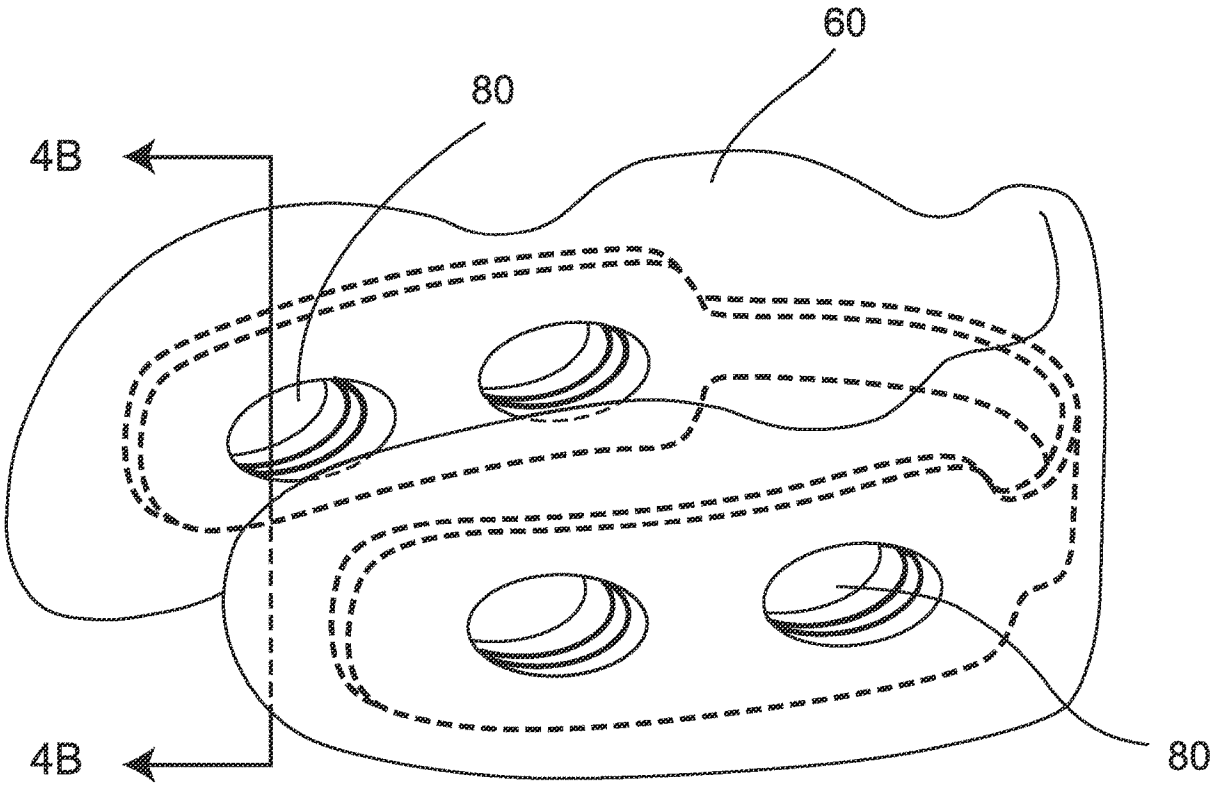
FIG. 4A is a perspective view of an embodiment of the invention having ventilation apertures through side members of the frame and cushion.
Figure 4B:
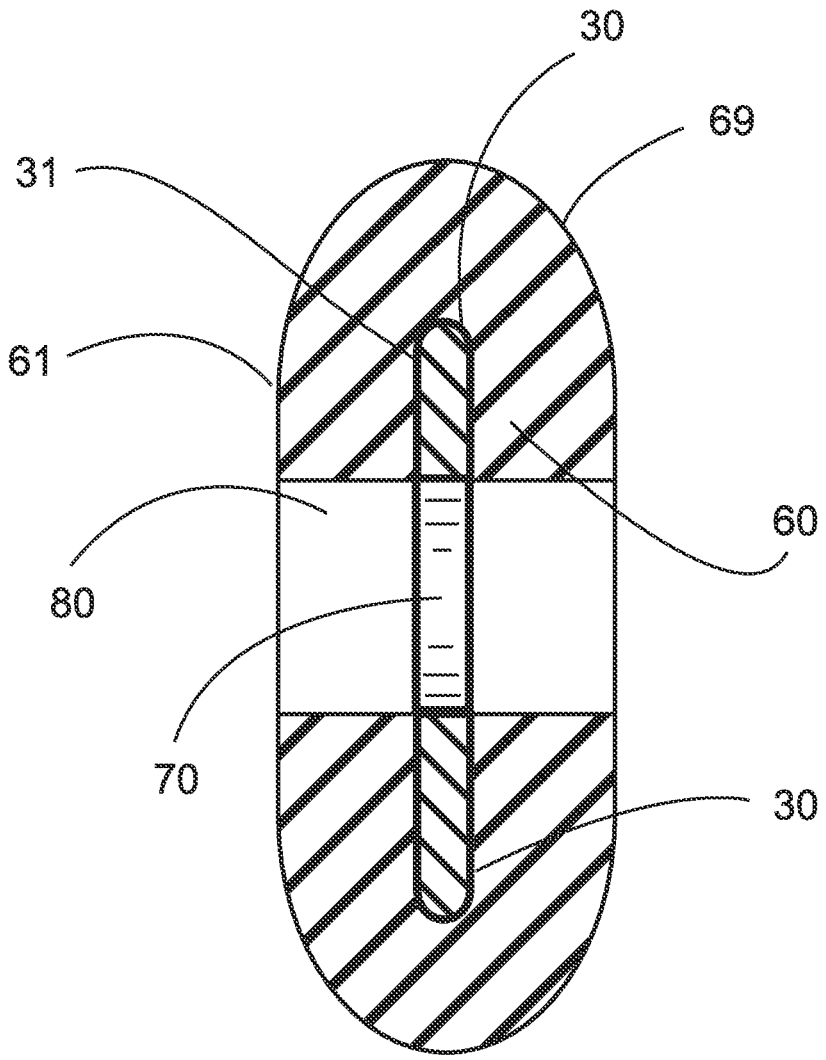
FIG. 4B is a cross-sectional view thereof, taken generally along line 4B-4B of FIG. 4A.
Figure 5:
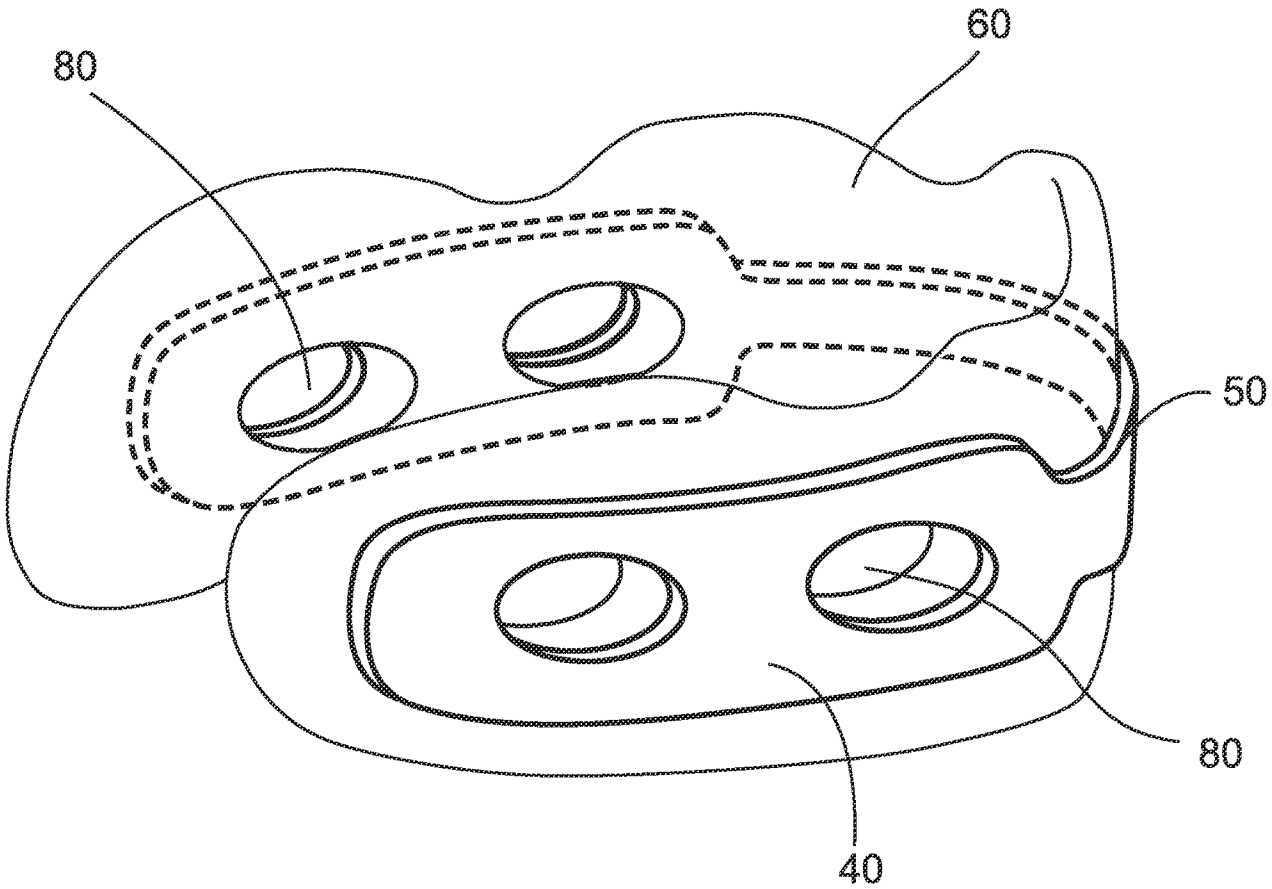
FIG. 5 is a perspective view of an alternate embodiment of FIG. 4A.
Figure 6:
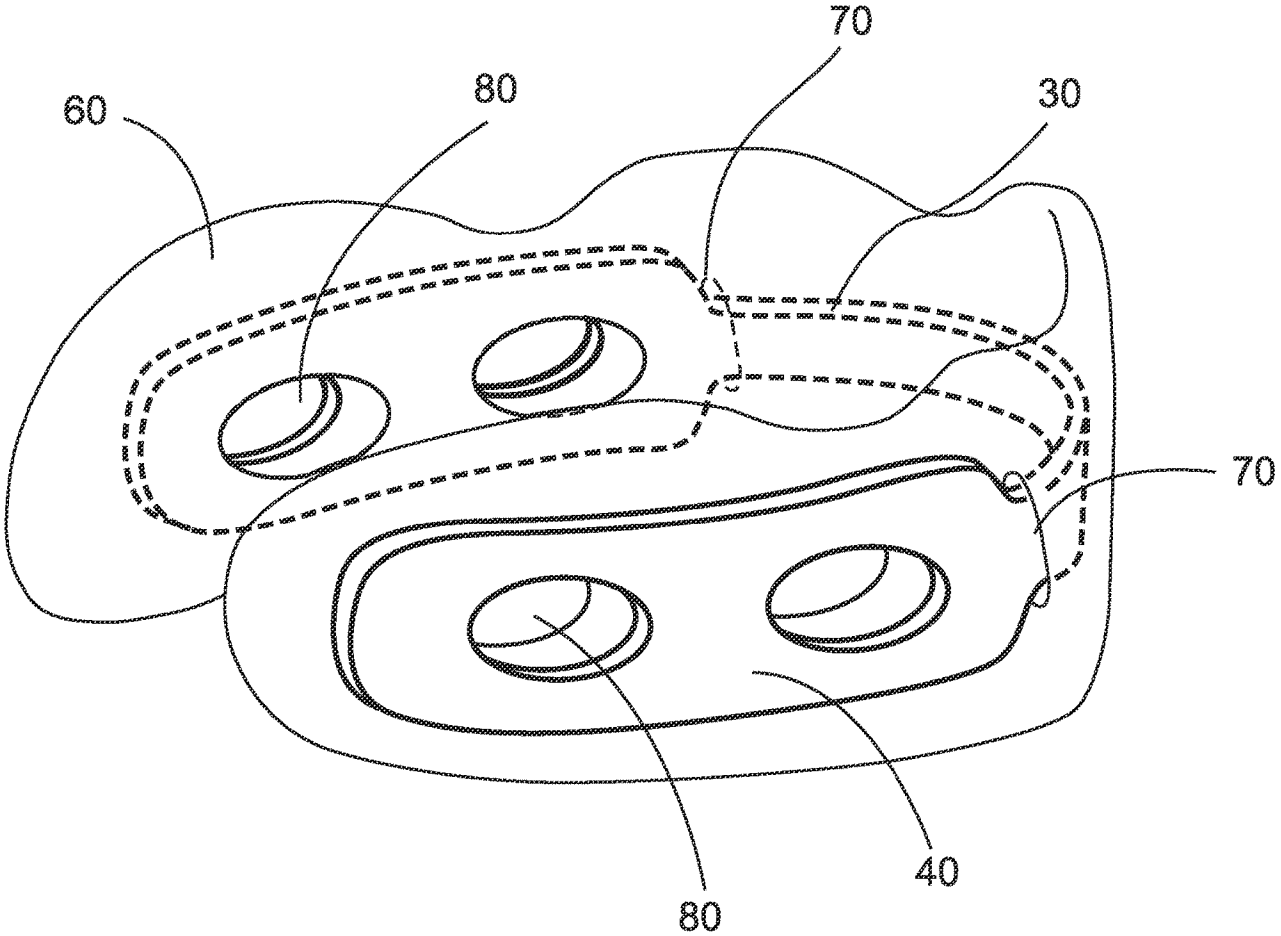
FIG. 6 is a perspective view of another alternate embodiment of FIG. 4A.
Figure 7:
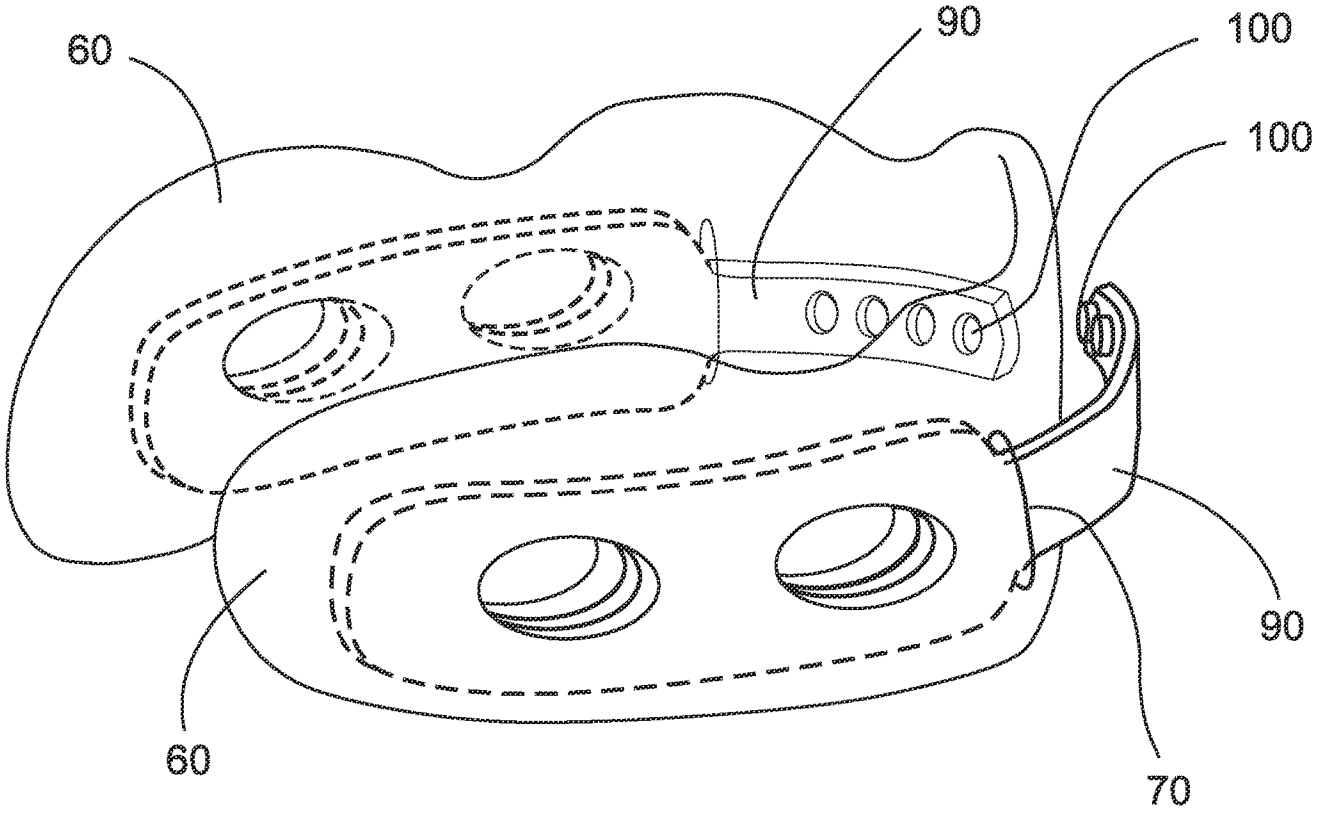
FIG. 7 is a perspective view of an embodiment of the invention wherein the frame comprises multiple separated segments mutually adjustably fixed at a mechanical fastener.
Figure 8:
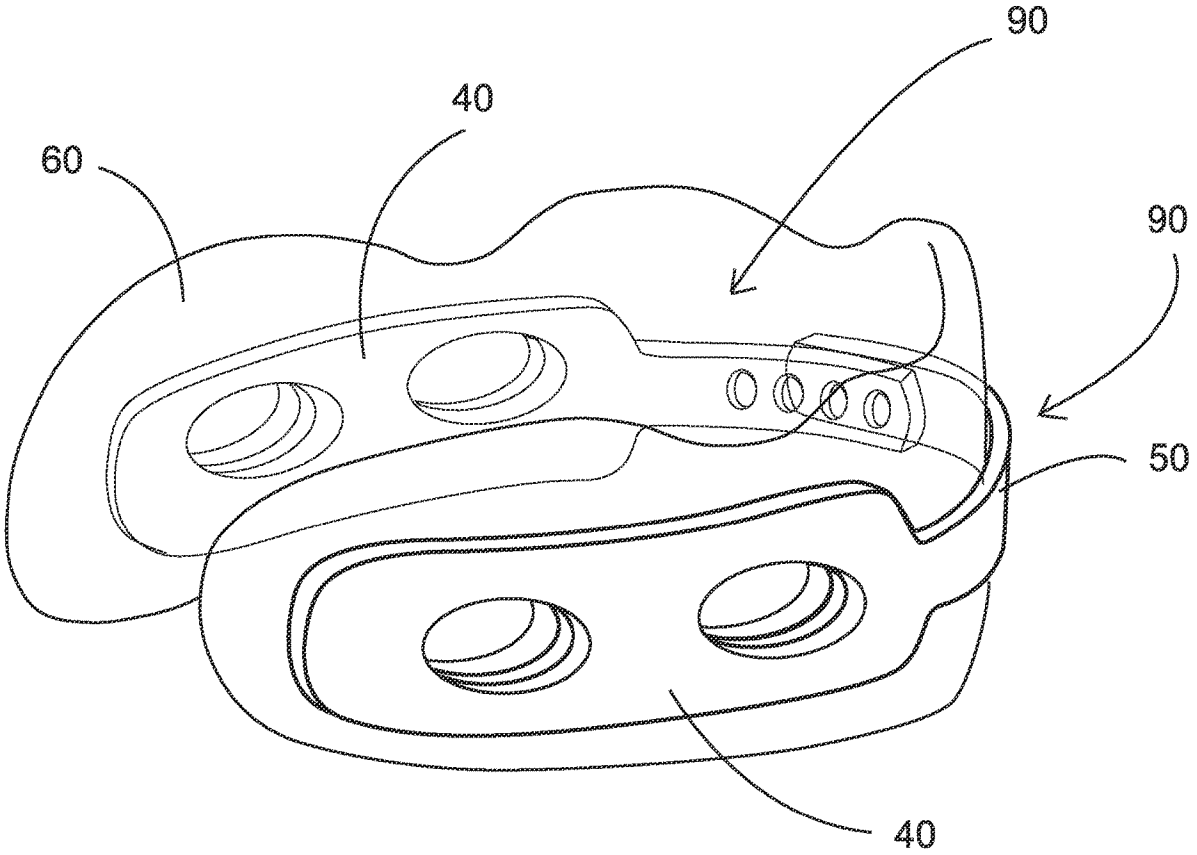
FIG. 8 is a perspective view of FIG. 7 illustrated with the segments mutually affixed.
Figure 9:
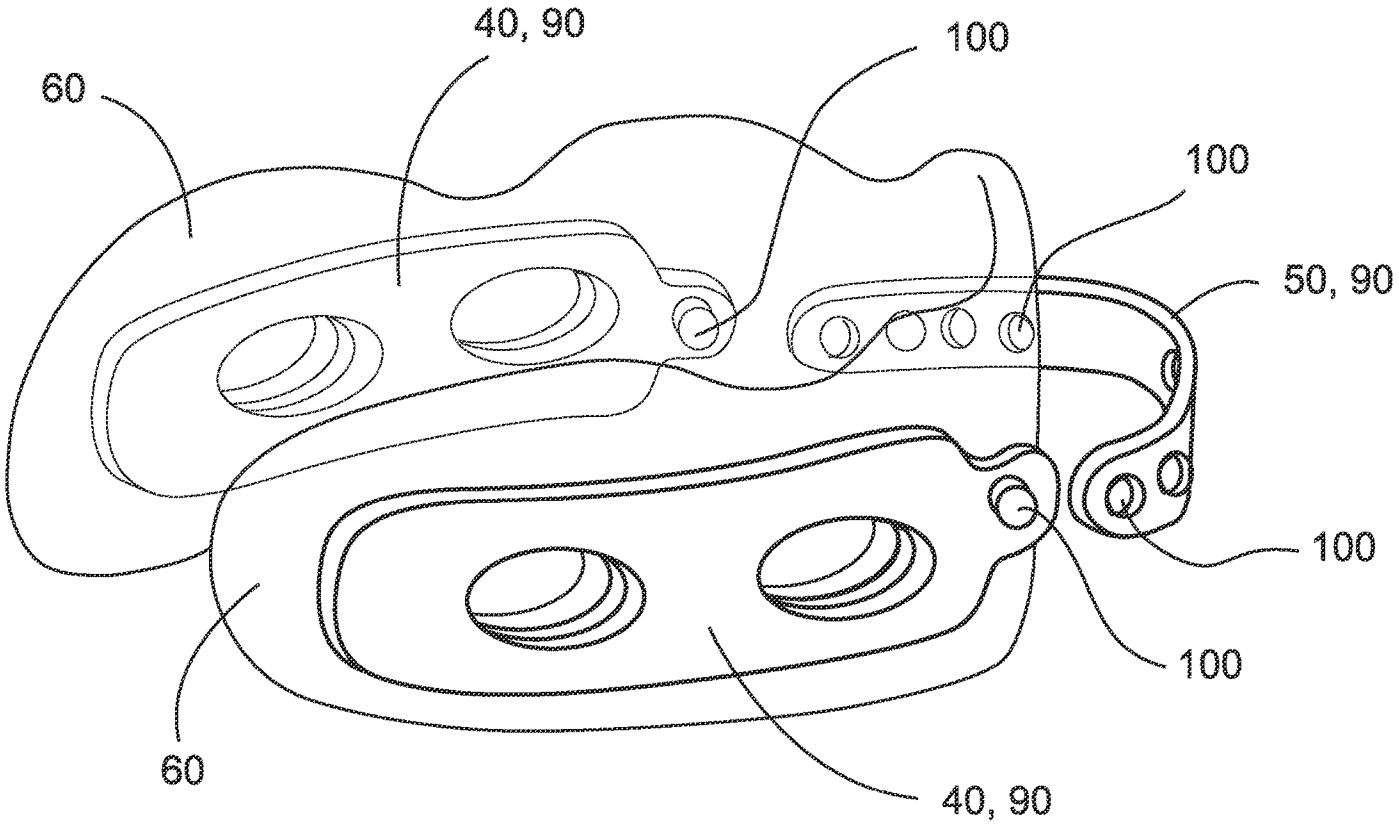
FIG. 9 is an alternate embodiment of FIG. 7.
Figure 10:
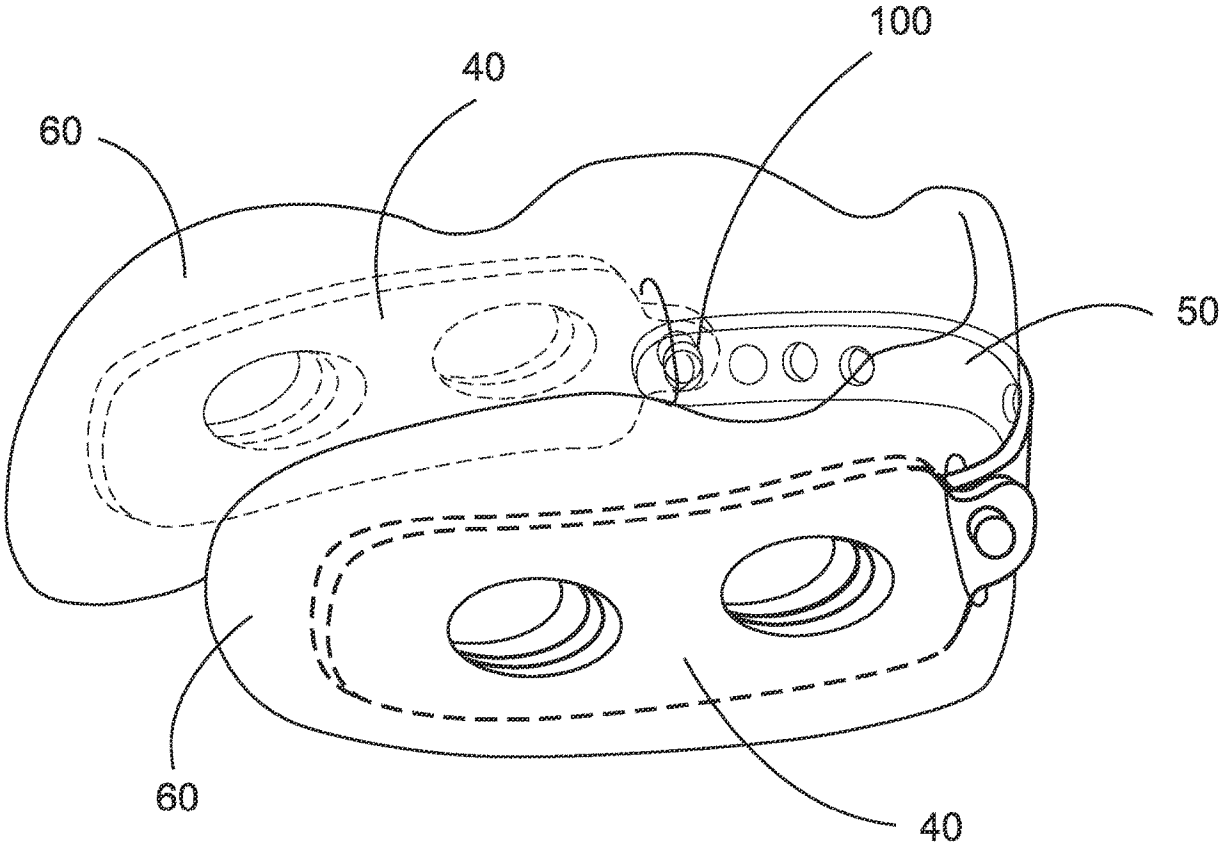
FIG. 10 is a perspective view of FIG. 9 illustrated with the segments mutually affixed.

In one preferred embodiment, the frame 30 and the cushion 60 both include a plurality of mutually-aligned horizontal ventilation apertures 80 (FIG. 4A) traversing from an inside surface of the frame 31 and cushion 61 to the outside surface of the frame 39 and cushion 69 (FIG. 4B). As such, heated air between the person's neck 23 and the pillow 10 may escape through the ventilation apertures 80, resulting in the cooling of the person's neck 23 and head 25.

Figure 19:
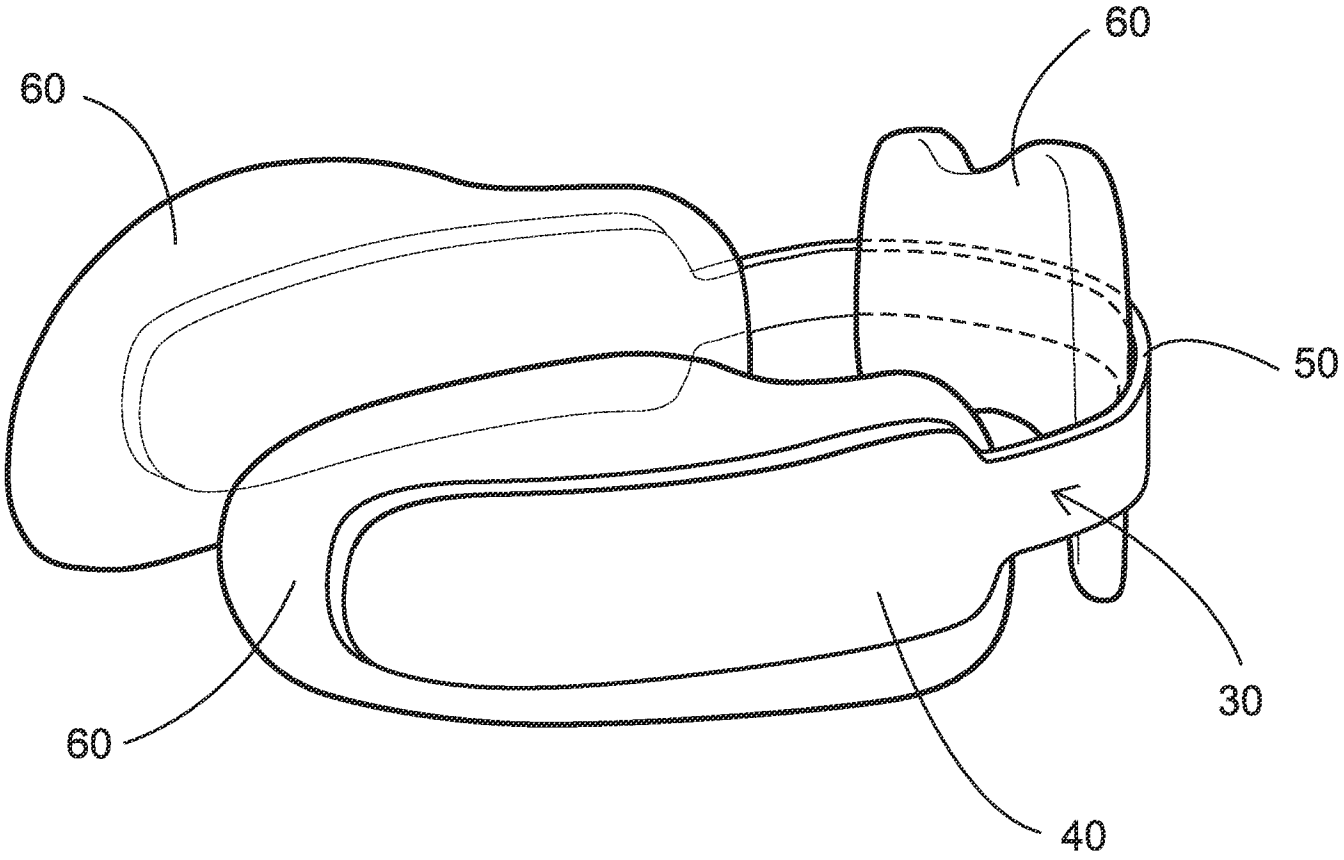
FIG. 19 is a perspective view of an embodiment of the invention having multiple cushions.
Figure 20:
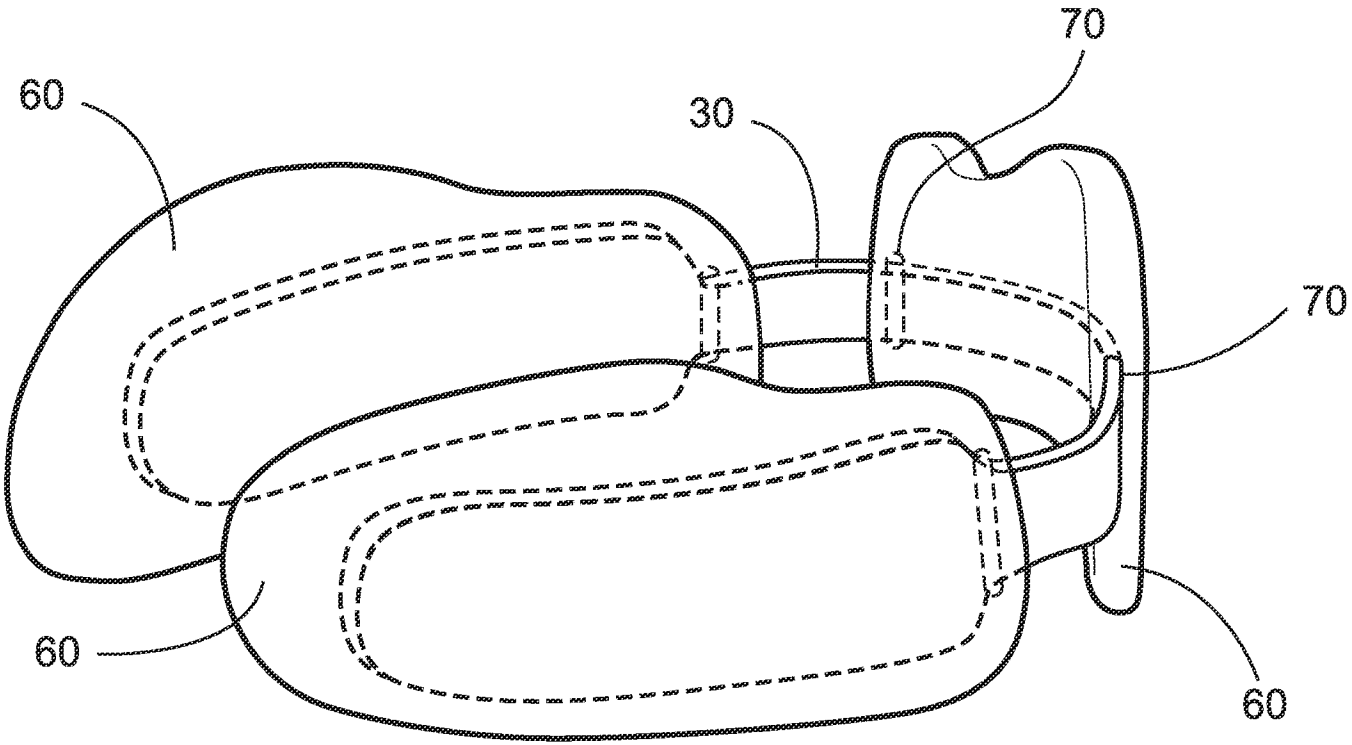
FIG. 20 is a perspective view of an alternate embodiment of FIG. 19.
Figure 21:
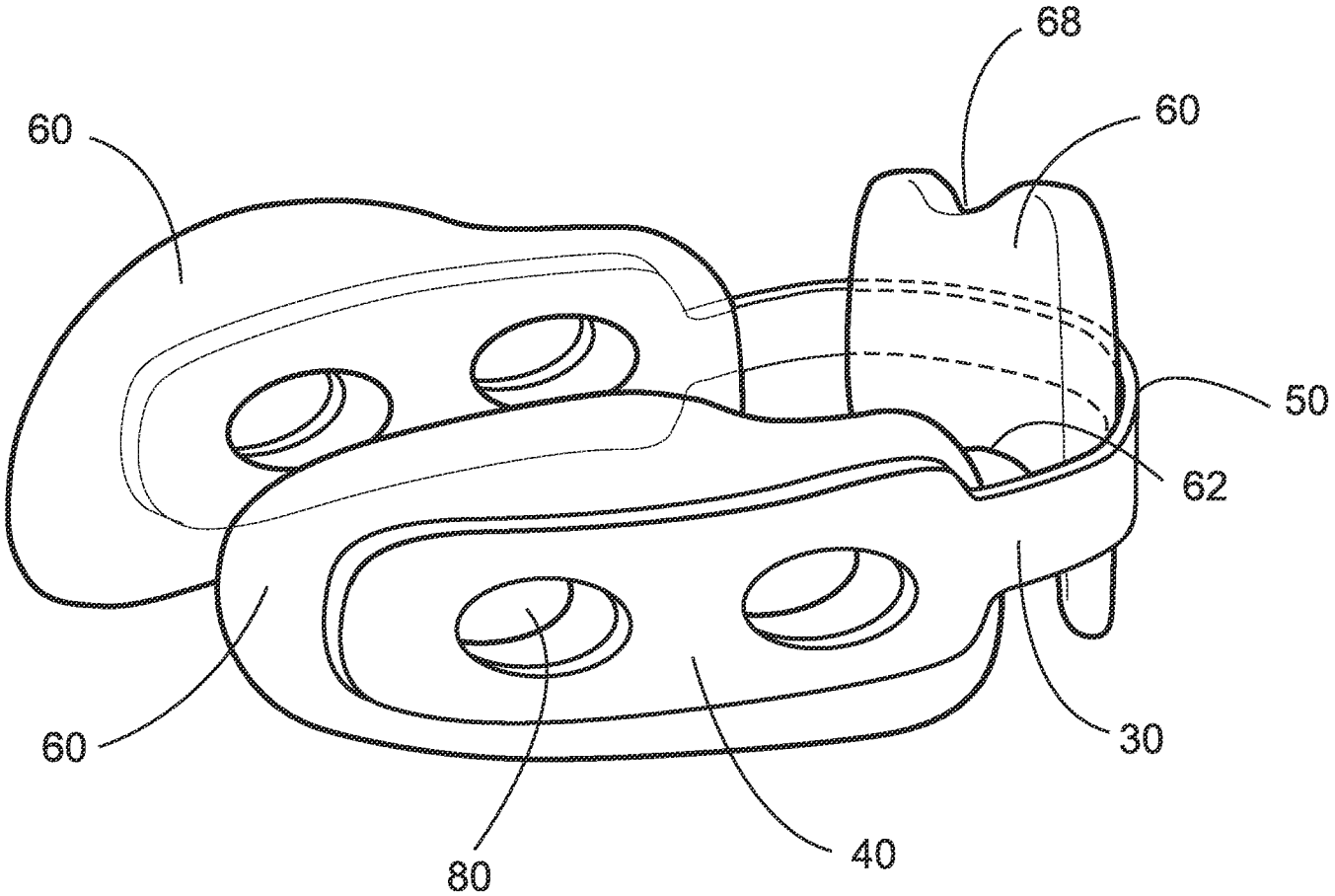
FIG. 21 is a perspective view of the embodiment of FIG. 19 but further including the ventilation apertures.
Figure 22:
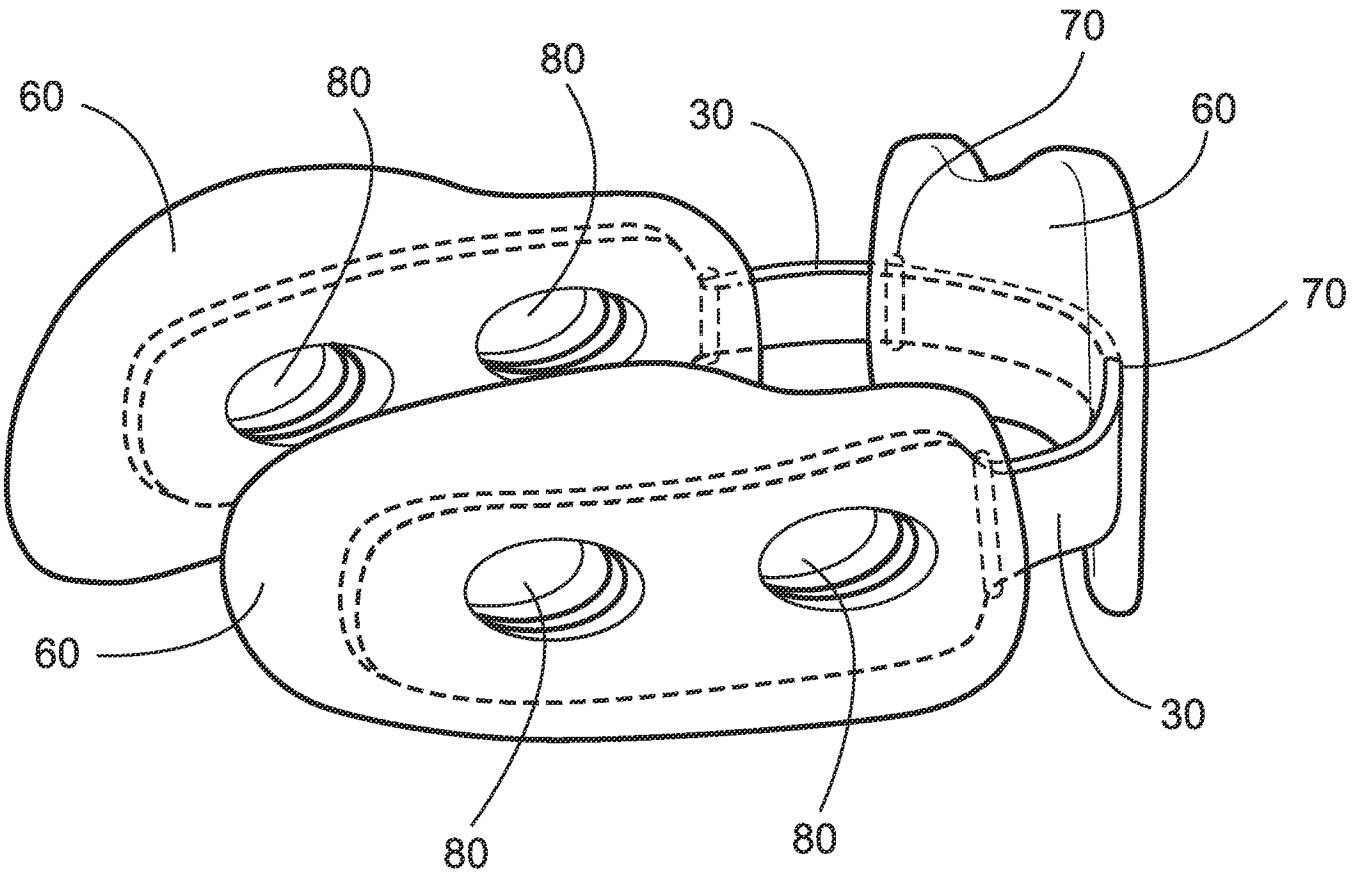
FIG. 22 is a perspective view of the embodiment of FIG. 20 but further including the ventilation apertures.

In one embodiment, the pillow 10 includes a plurality of cushions 60 (FIGS. 19-22), each fixed along the frame 30 and adapted to support the person's head 25 when the frame 30 and cushions 60 are fixed about the person's neck 23. In such an embodiment, the frame 30 may traverse at least one of the cushions 60 (FIGS. 20 and 22) through frame apertures 70 of the at least one cushion 60. For example, the rear member 50 may be fixed within one of the cushions 60 and the side members 40 of the frame 30 may be fixed to the outside surface 69 of the other cushions 60 (not shown), or alternately the rear member 50 of the frame 30 may be fixed with the outer side 69 of one of the cushions 60 and the side members 40 of the frame 30 may each traverse the frame apertures 70 in the other cushions 60 and be at least partially fixed within the other cushions 60 (not shown). Alternately, the frame 30 may be fixed to the outside surface 69 of all of the padded cushions 60 (FIGS. 19 and 21). The ventilation apertures 80 may further be included in one or more of the cushion 60 in such an embodiment (FIGS. 21 and 22).

In such an embodiment having the plurality of cushions 60, two of the cushions 60 may include the contoured lower surface 62 for conforming to the curvature of the person's shoulders 27. Likewise, such cushions 60 may further include the contoured upper surface 68 conforming to the curvature of the person's jaw 24. A rear cushion 60 may include the contoured upper surface 68 for conforming to the curvature of the back 26 of the person's head 25.

A removable outer cover 160 (FIG. 18) may be included, the outer cover 160 adapted for receiving therein the cushion 60 or cushions 60 and frame 30. The cover 160 may include a bag configuration (not shown) for transporting or storing the pillow 10 when not in use. Alternately, a separate carrying bag (not shown) may be included.

In certain other embodiments, the frame 30 includes a plurality of connectable segments 90 (FIGS. 7-14 and 18). Adjacent such segments 90 are preferably selectively adjustably connectable, such as with a pin-and-aperture type mechanical fastening mechanism 100, or the like (FIGS. 7-10). Telescoping mechanisms (not shown) may alternately be utilized as the fastening mechanism 100. As such, the size of the frame 30 is selectively adjustable to fit the person's head 25 and neck 23.

Figure 11:
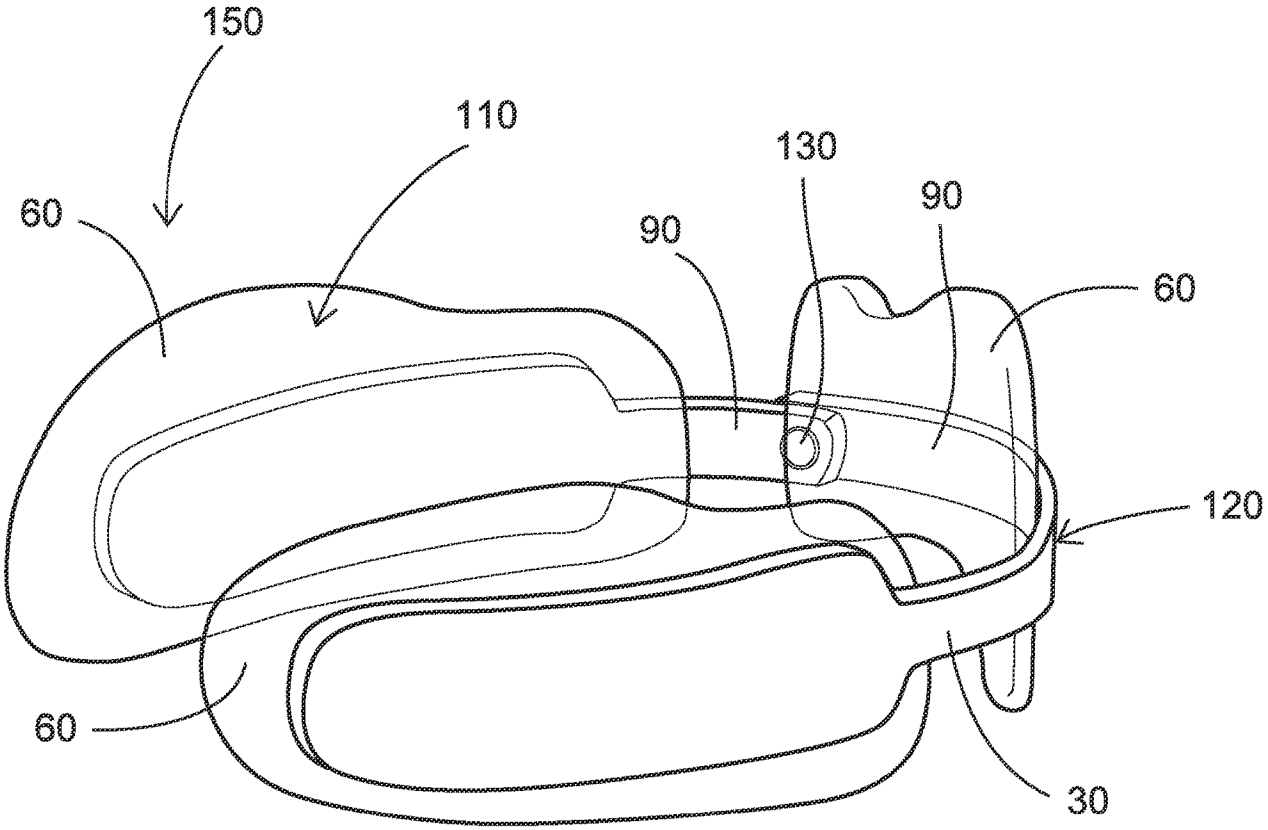
FIG. 11 is a perspective view of an embodiment wherein two segments are mutually pivotally attached, the pillow being illustrated in an expanded configuration.
Figure 14:
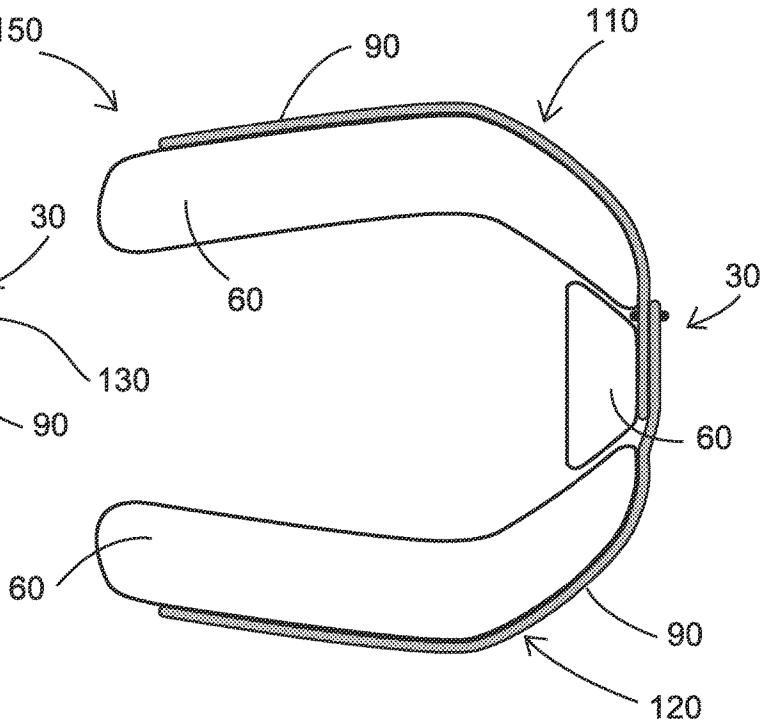
FIG. 14 is a top plan view of FIG. 12, except the pillow being in the expanded configuration.
Figure 12:
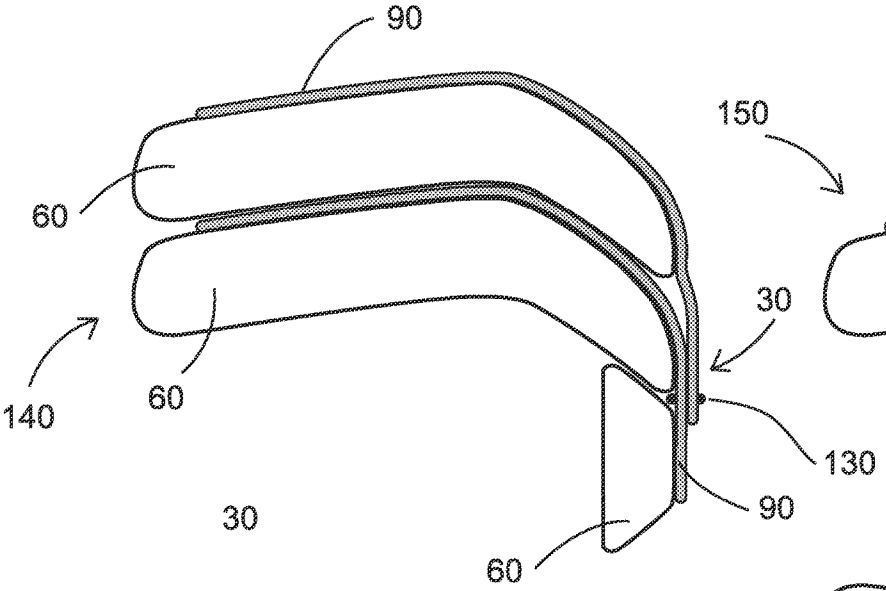
FIG. 12 is a top plan view of an alternate embodiment of that shown in FIG. 11, except the pillow being in a collapsed configuration.
Figure 13:
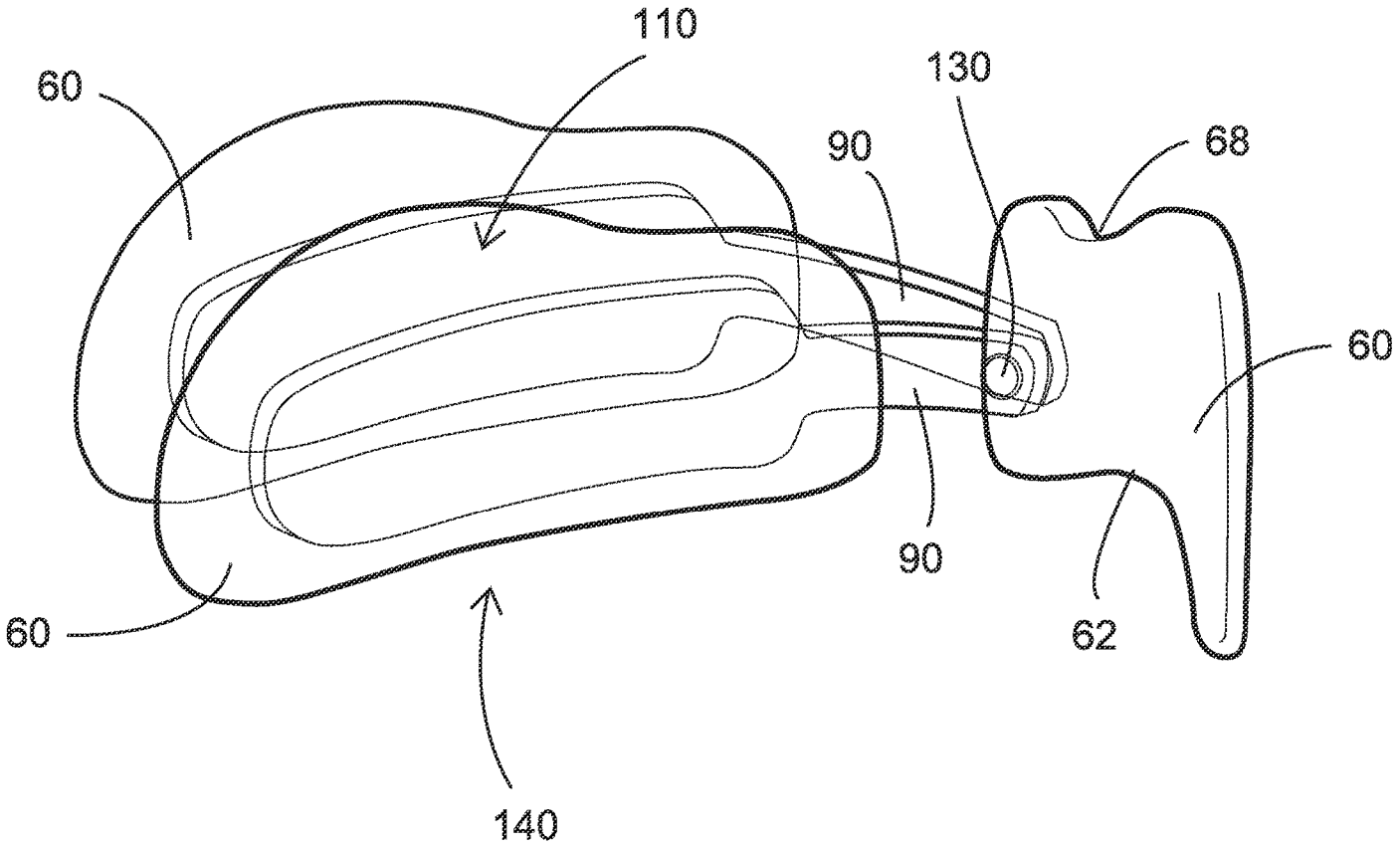
FIG. 13 is a perspective diagram of FIG. 11, except the pillow being in the collapsed configuration.

In one embodiment, the frame 30 includes an inner L-shaped segment 110 and an outer L-shaped segment 120 (FIGS. 11-14) that are mutually rotatably fixed at a pivot 130. As such, the segments 110,120 may be rotated between a collapsed configuration 140 (FIGS. 13 and 14) and an expanded configuration 150 (FIGS. 11 and 12).

Figure 15A:
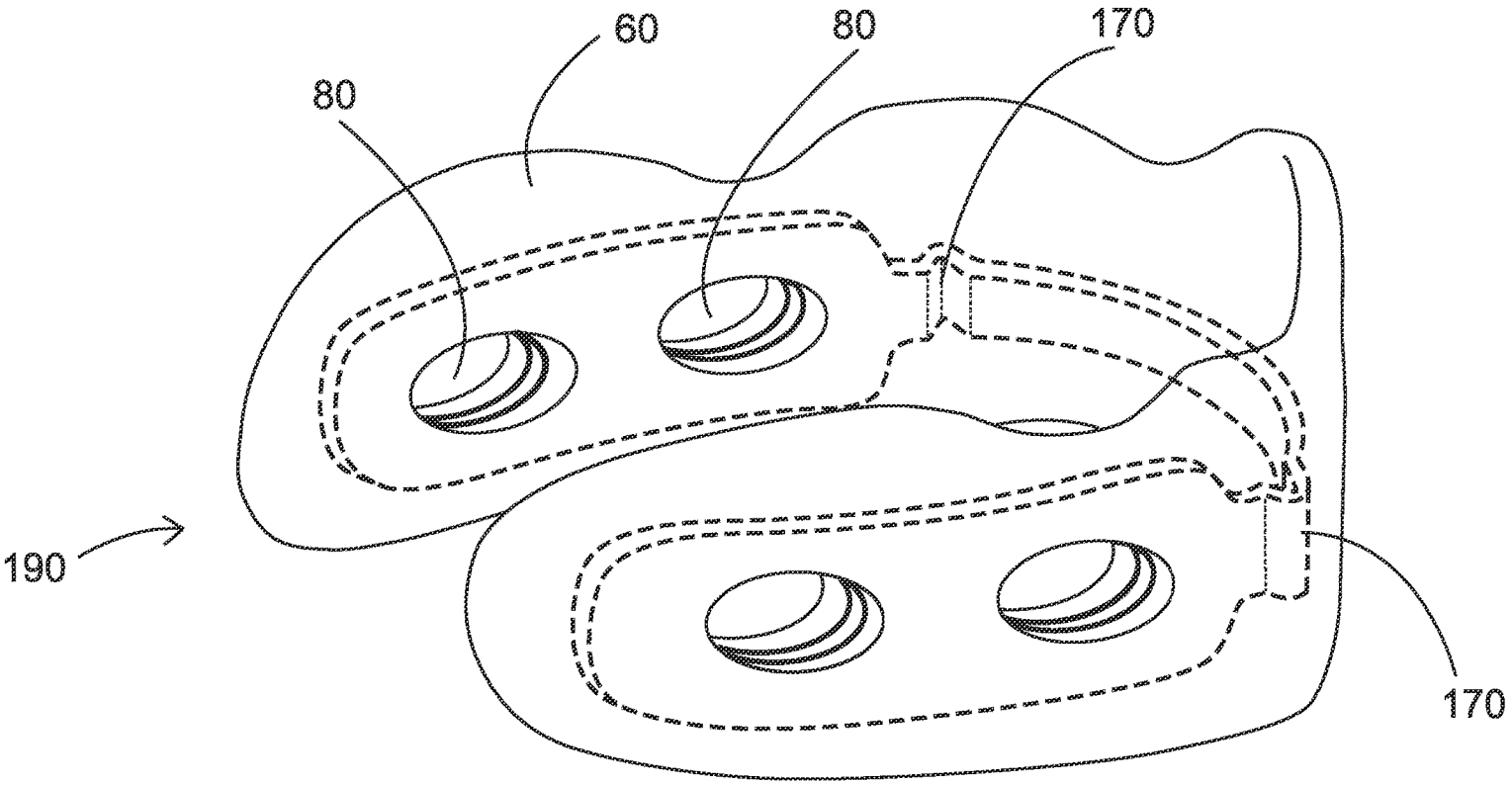
FIG. 15A is a perspective view of an embodiment of the invention having a living hinge formed between the side members and the rear member of the frame, the pillow being shown in an expanded configuration.
Figure 15B:
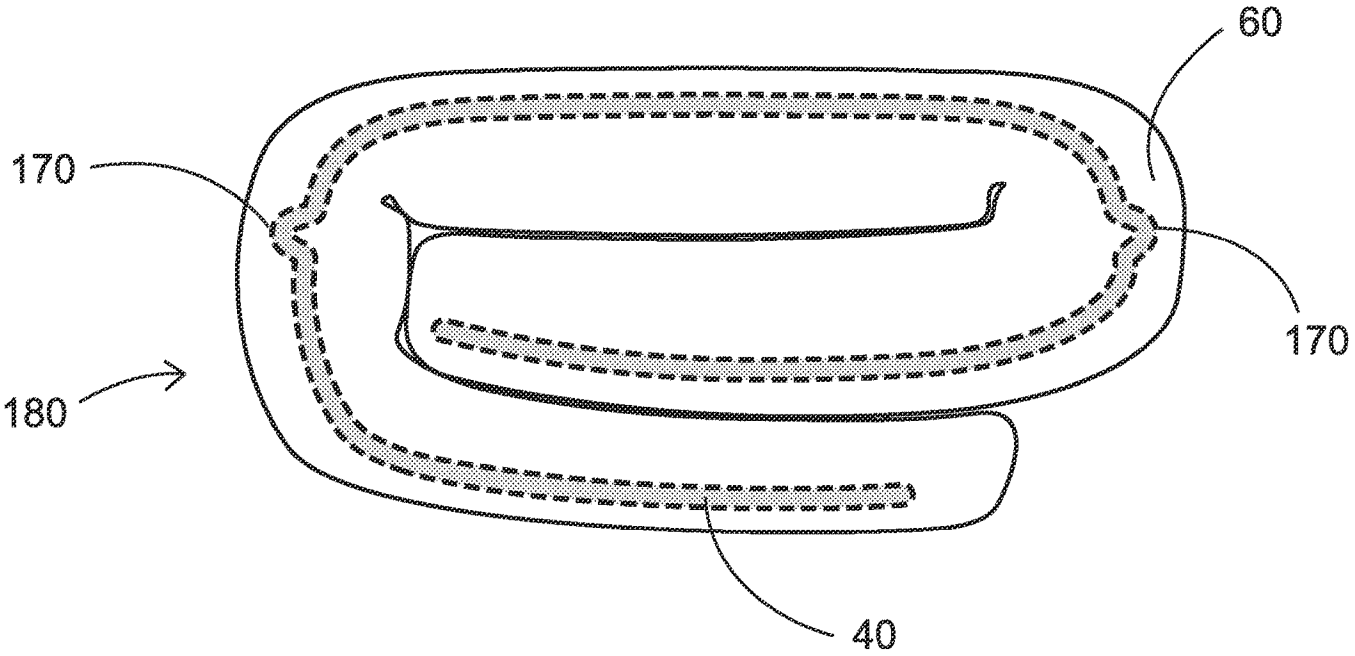
FIG. 15B is a top plan view of the embodiment of FIG. 15A in a collapsed configuration.
Figure 16:
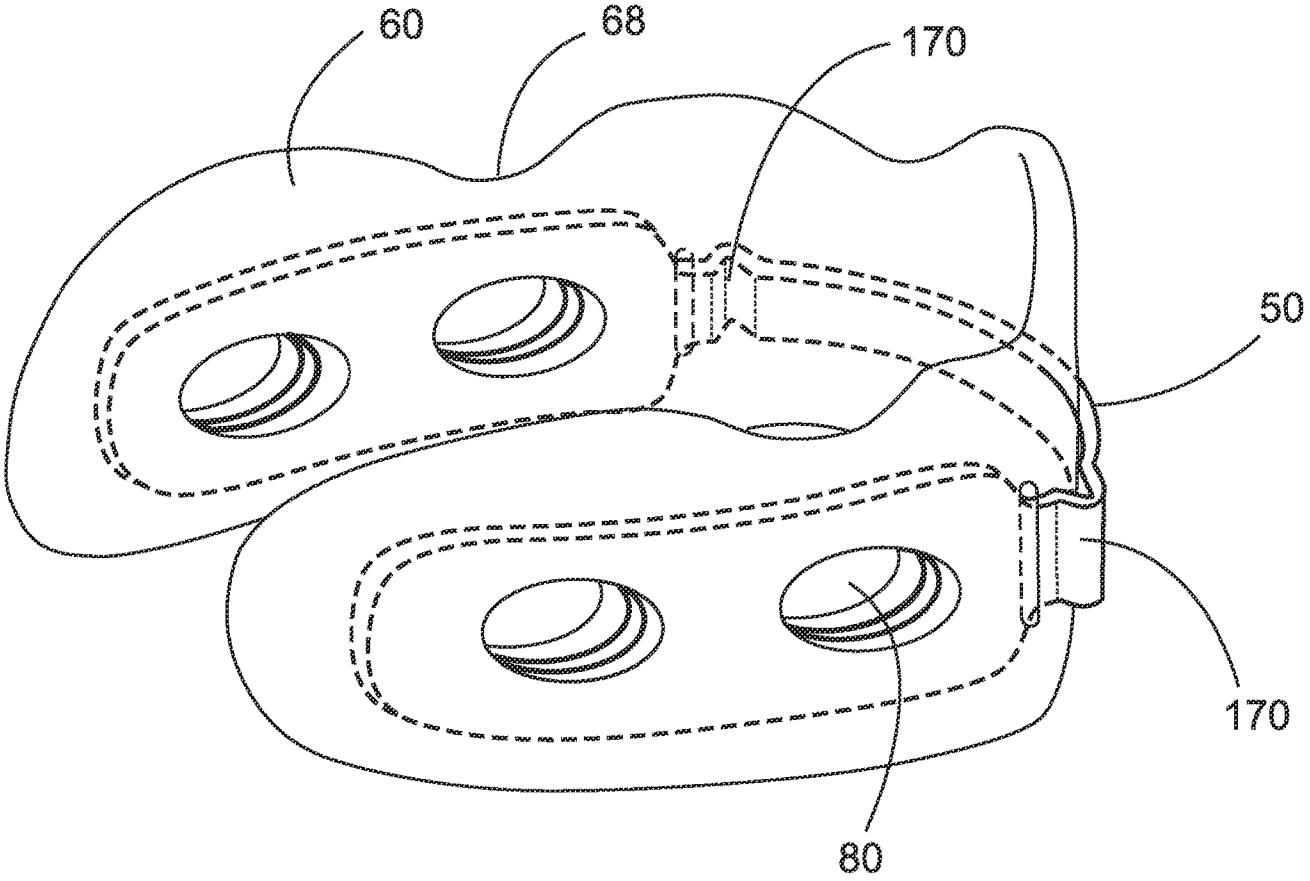
FIG. 16 is a perspective view of an alternate embodiment the invention.
Figure 17:
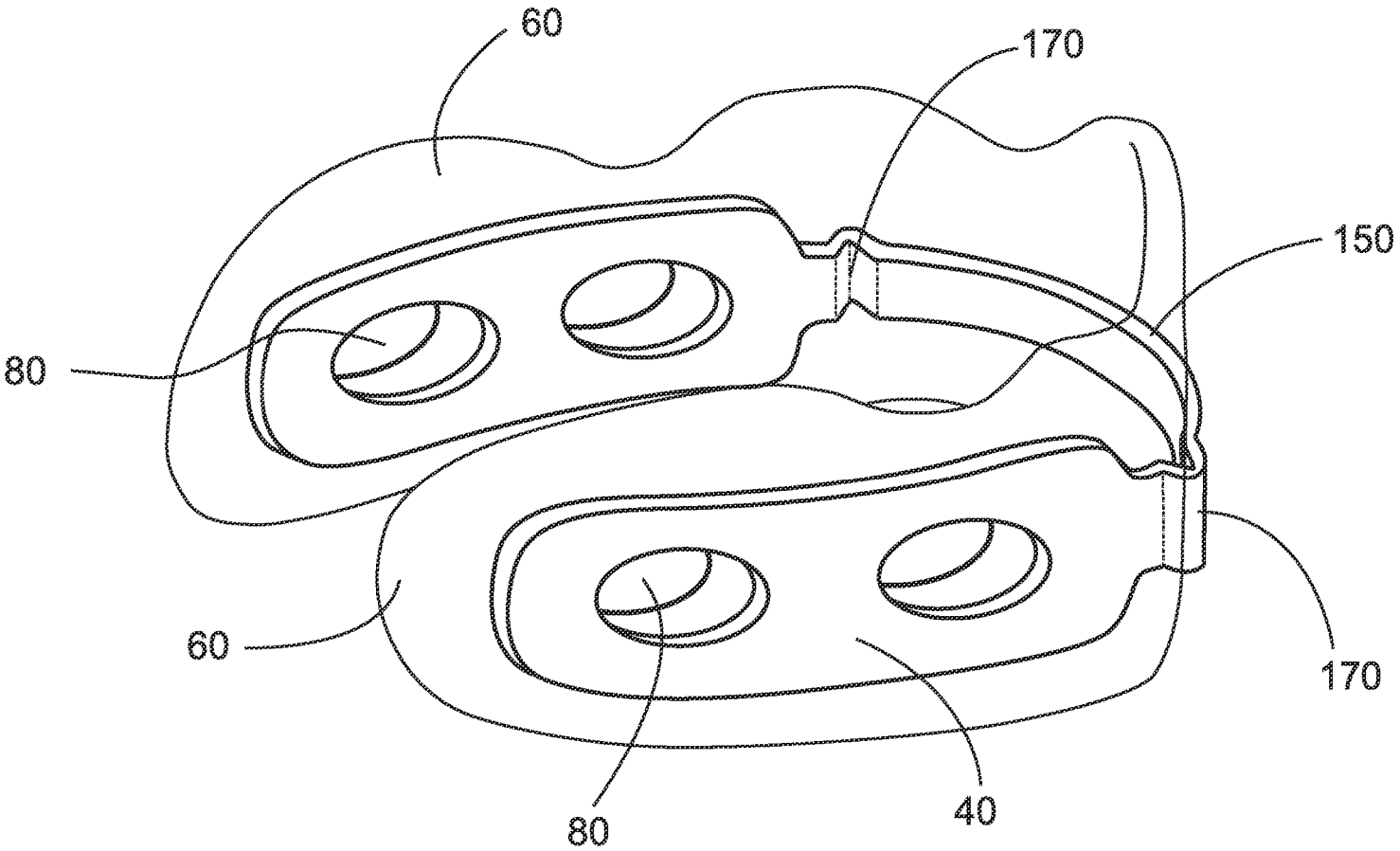
FIG. 17 is a perspective view of another alternate embodiment the invention.
Figure 18:
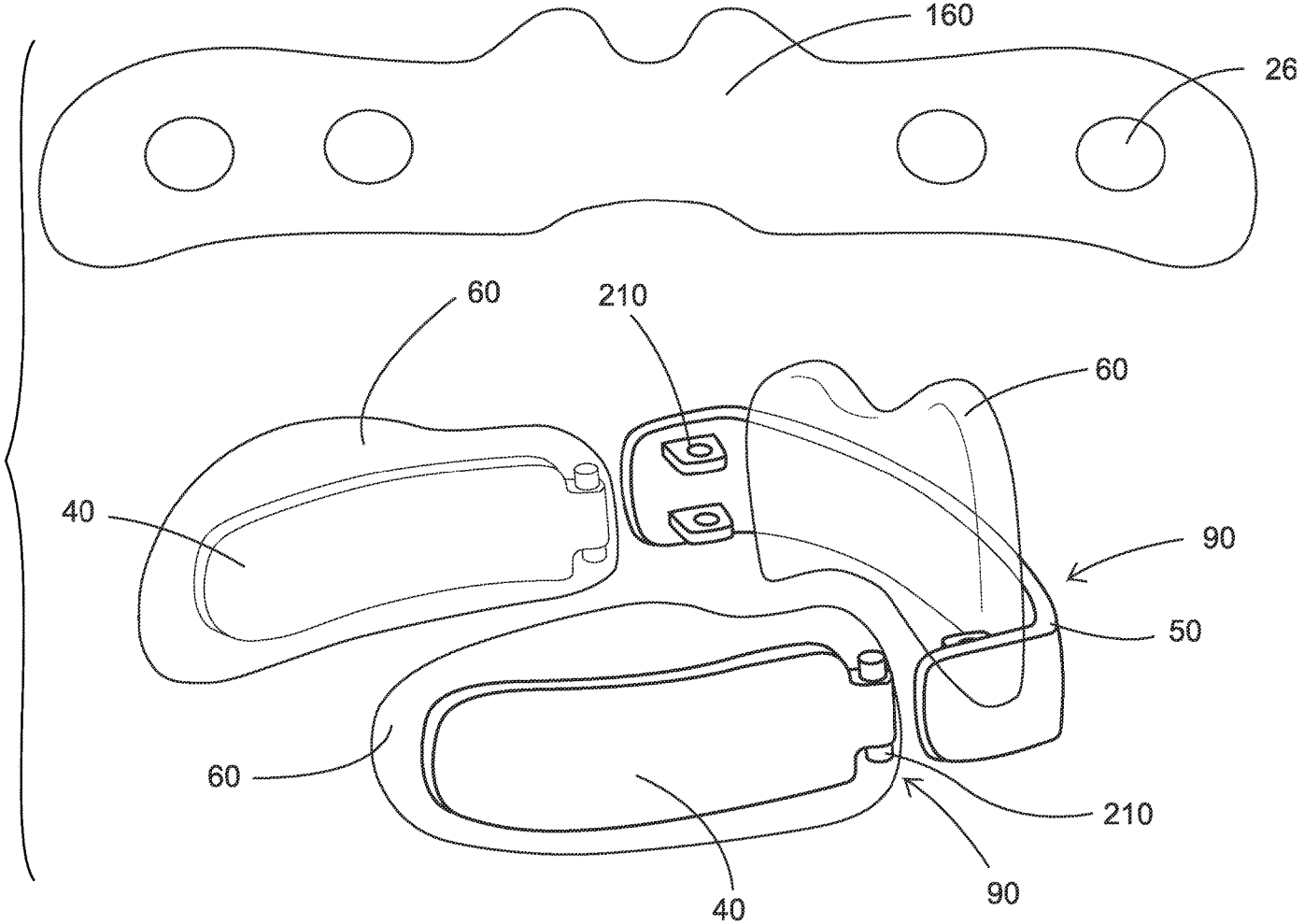
FIG. 18 is an exploded perspective view of an embodiment of the invention having a hinge mechanism between the side members and the rear member of the frame, and further illustrated a removable cover of the invention.

In one embodiment, the frame 30 includes a living hinge 170 (FIGS. 15A-17) between each side member 40 and the rear member 50. Alternately, the side members 40 and rear member 50 of the frame 30 are each separate segments 90, with each side member 40 and the rear member 50 pivotally mutually fixed at a hinge mechanism 210 (FIG. 18). As such, the pillow 10 may be folded at each living hinge 170 between a collapsed position 180 (FIG. 15A) and an expanded position 190 (FIGS. 15A and 18).

Figure 29:
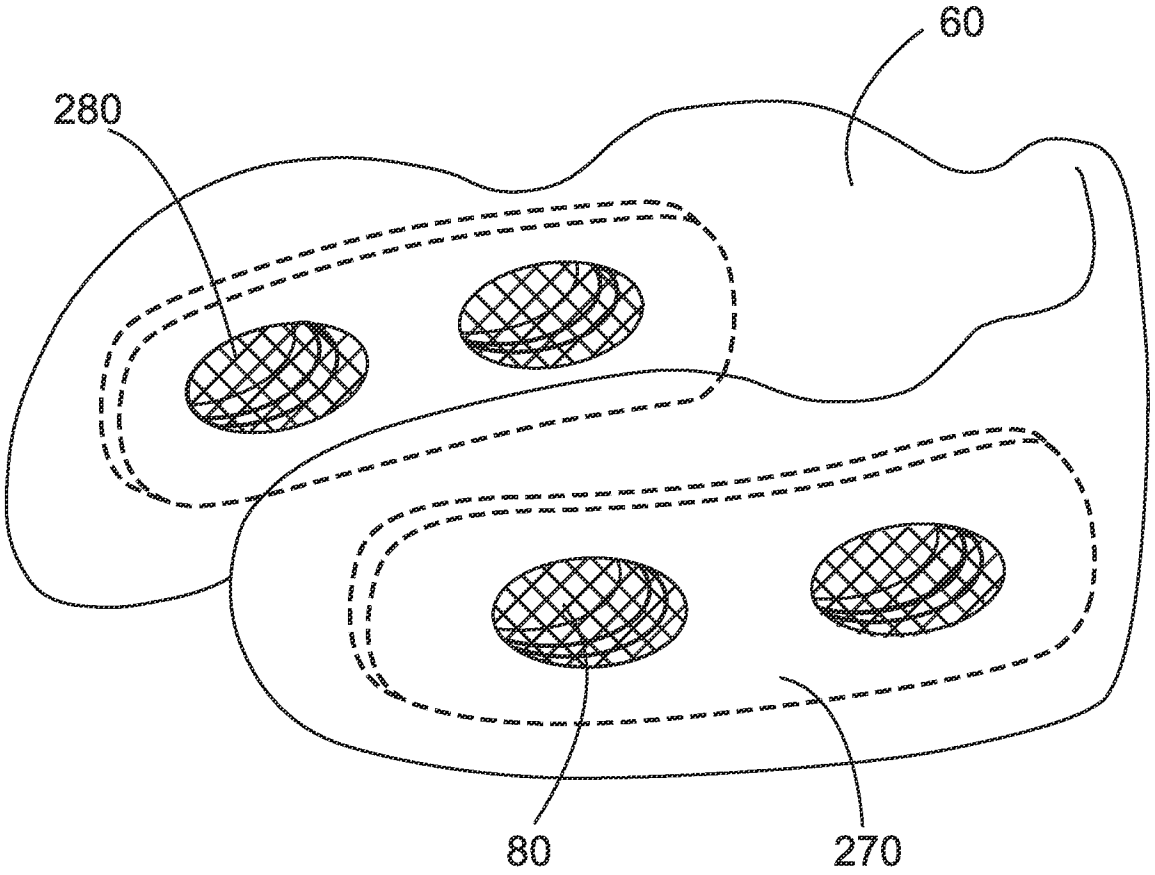
FIG. 29 is a perspective view of FIG. 27 but having a ventilated material covering the apertures of the frame.
Figure 30:
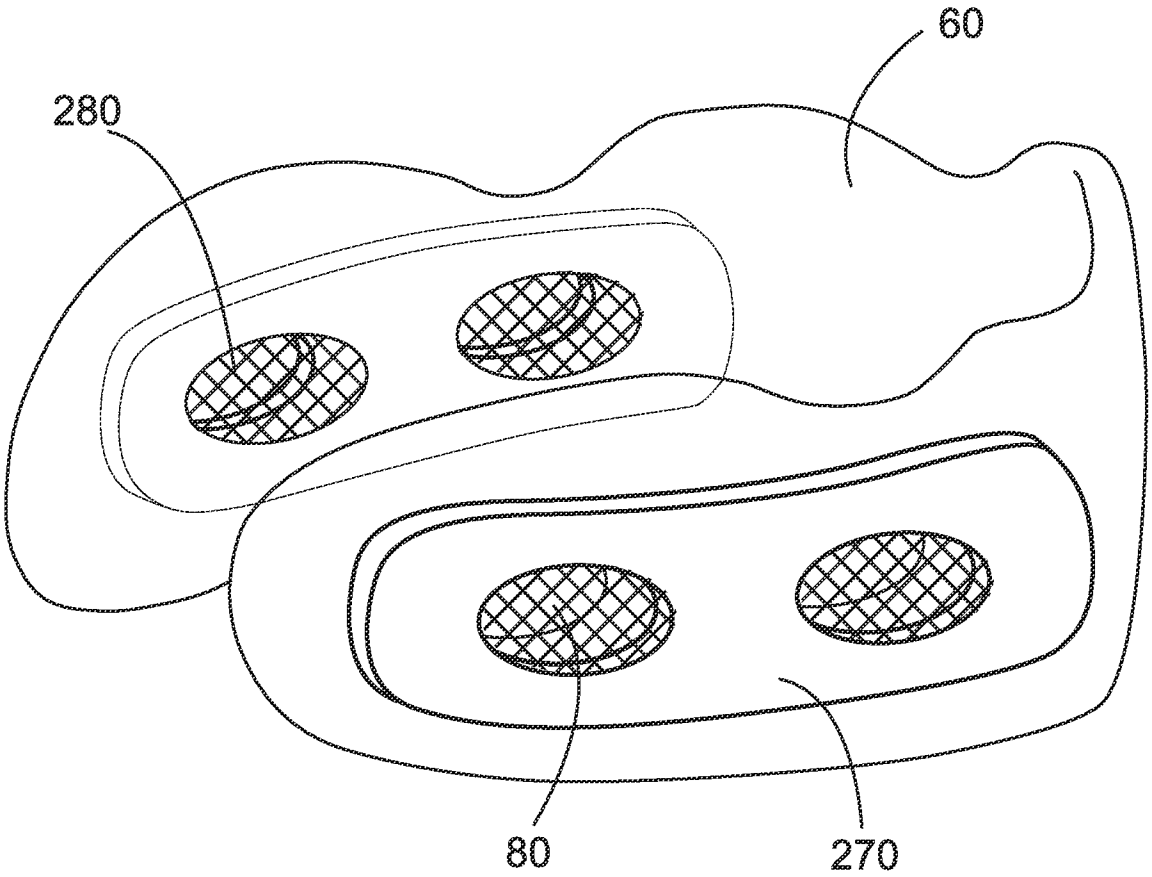
FIG. 30 a perspective view of FIG. 28 but having a ventilated material covering the apertures of the frame.

In one embodiment, the pillow 10 includes the padded, generally U-shaped cushion 60 having two side sections 220, a rear section 230, the inside surface 61 and the outside surface 69. The cushion 60 is adapted for supporting the person's head 25 when the cushion 60 is fixed about the person's neck 23. The cushion 60 further includes the plurality of ventilation apertures 80 traversing the cushion 60 between the inside and outside surfaces 61,69 thereof. In one embodiment, each ventilation aperture 80 is covered with a ventilating material 280, such as a mesh or loosely-woven material (FIGS. 29 and 30).

Figure 23:
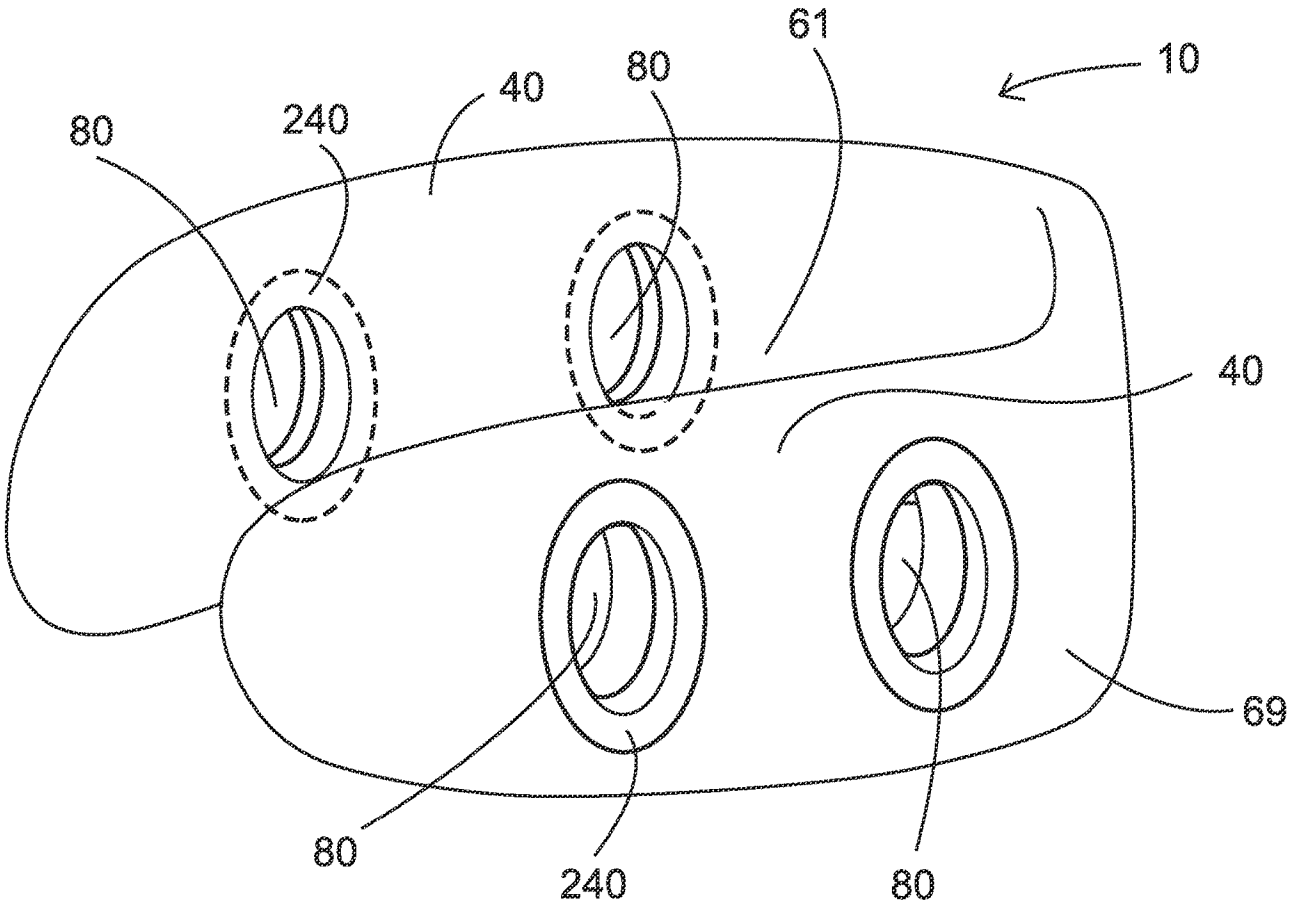
FIG. 23 is a perspective view of an embodiment of the invention having the cushion but no frame, and instead having resilient or rigid grommets fixed about the ventilation apertures.
Figure 24:
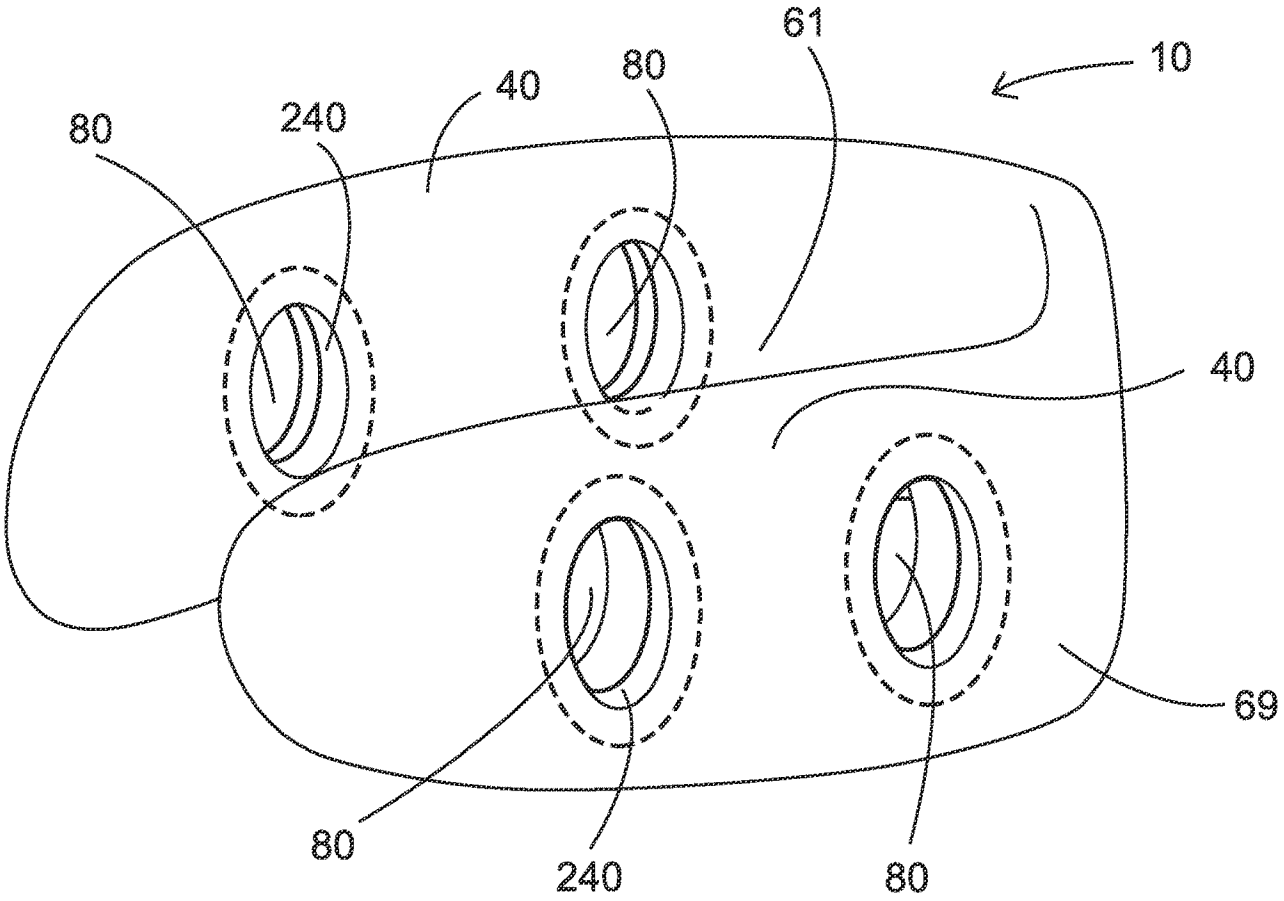
FIG. 24 is an alternate embodiment of FIG. 23.
Figure 25:
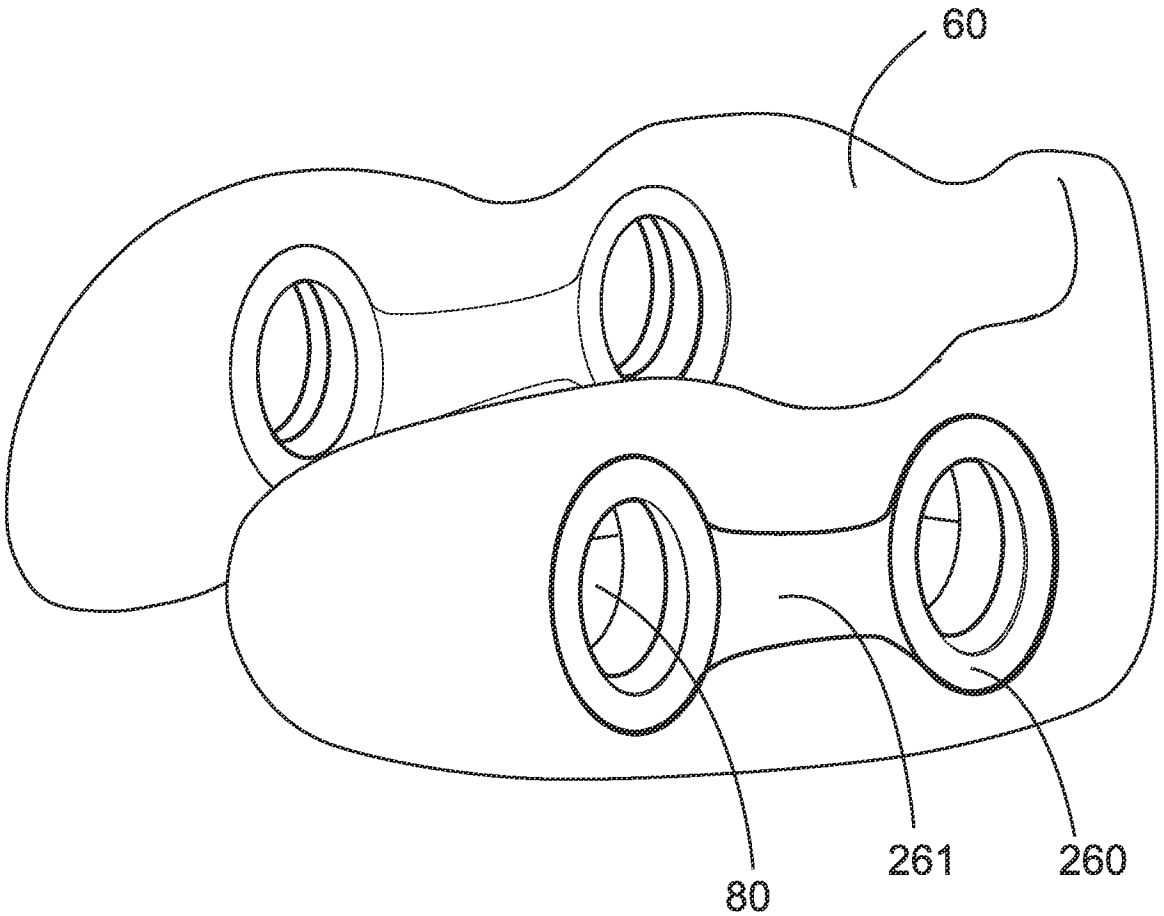
FIG. 25 is another alternate embodiment of FIG. 23.
Figure 26A:
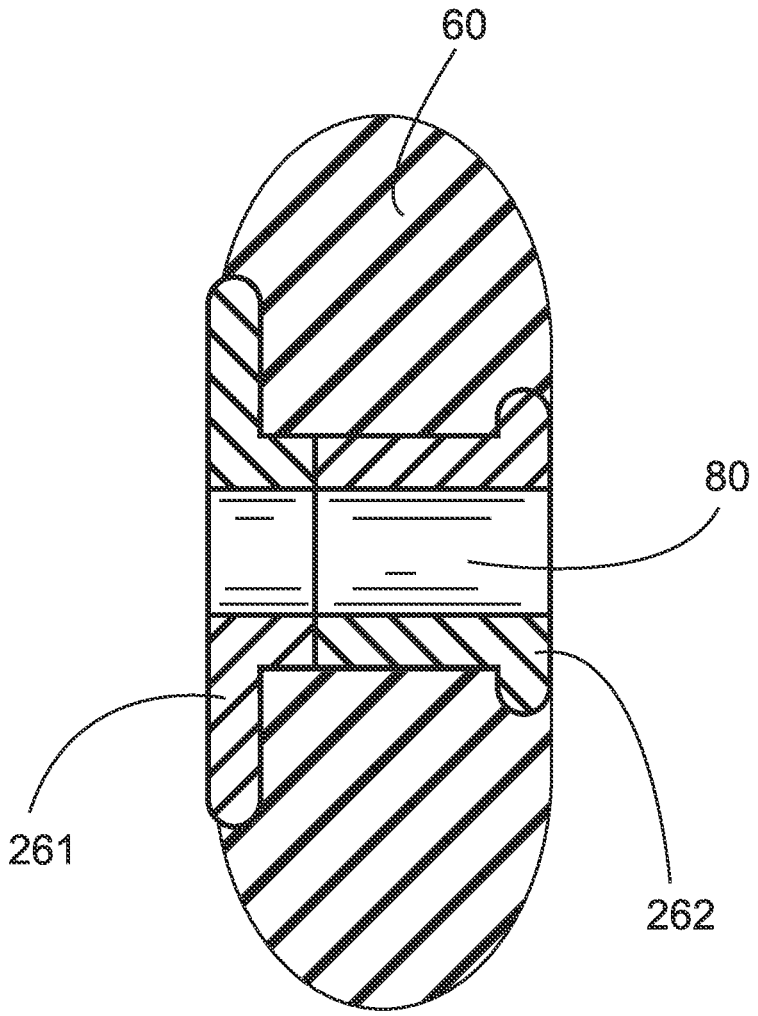
FIG. 26A is a cross-sectional view through one of the apertures of FIG. 24.
Figure 26B:
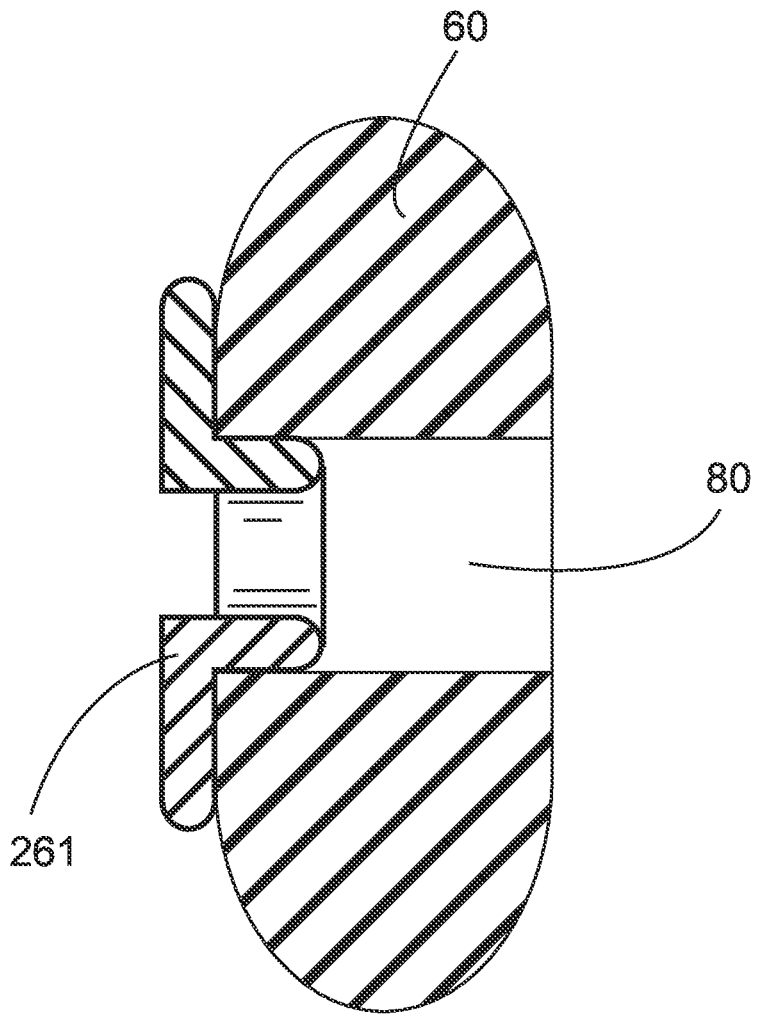
FIG. 26B is a cross-sectional view through one of the apertures of FIG. 25.

In one such embodiment, each ventilation apertures 80 may further include a rigid or resilient grommet 240 (FIGS. 23 and 24) adapted to add rigidity and support to the pillow 10. Such an embodiment may include the outer cover 160 made from an air-permeable mesh or woven material. Alternately the cover 160 may include cover apertures 250 therethrough, each aligned with a corresponding ventilation aperture 80 of the cushion 60. In one embodiment, adjacent grommets 240 may be connected with a connector 261 to form framing grommets 260 (FIG. 25).

In such an embodiment, the grommets 24 may include an L-shaped radial cross-section 261 or an elongated radial cross-section 262 (FIGS. 26A, 26B, and 38A-38I), so as to add sufficient rigidity to the pillow 10 at the two side sections 220 to support the person's head 25 when worn.

Figure 27:
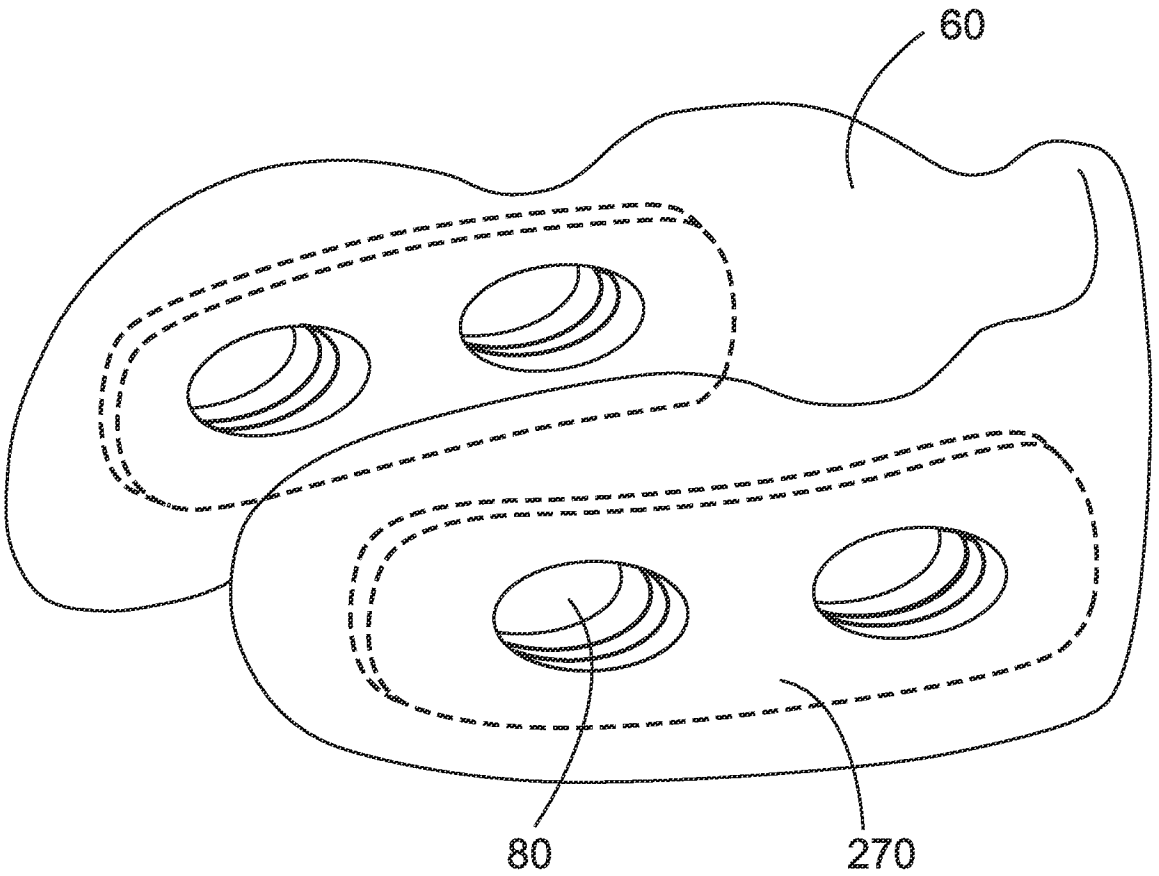
FIG. 27 is a perspective view of an alternate embodiment of the invention having two internal frames.
Figure 28:
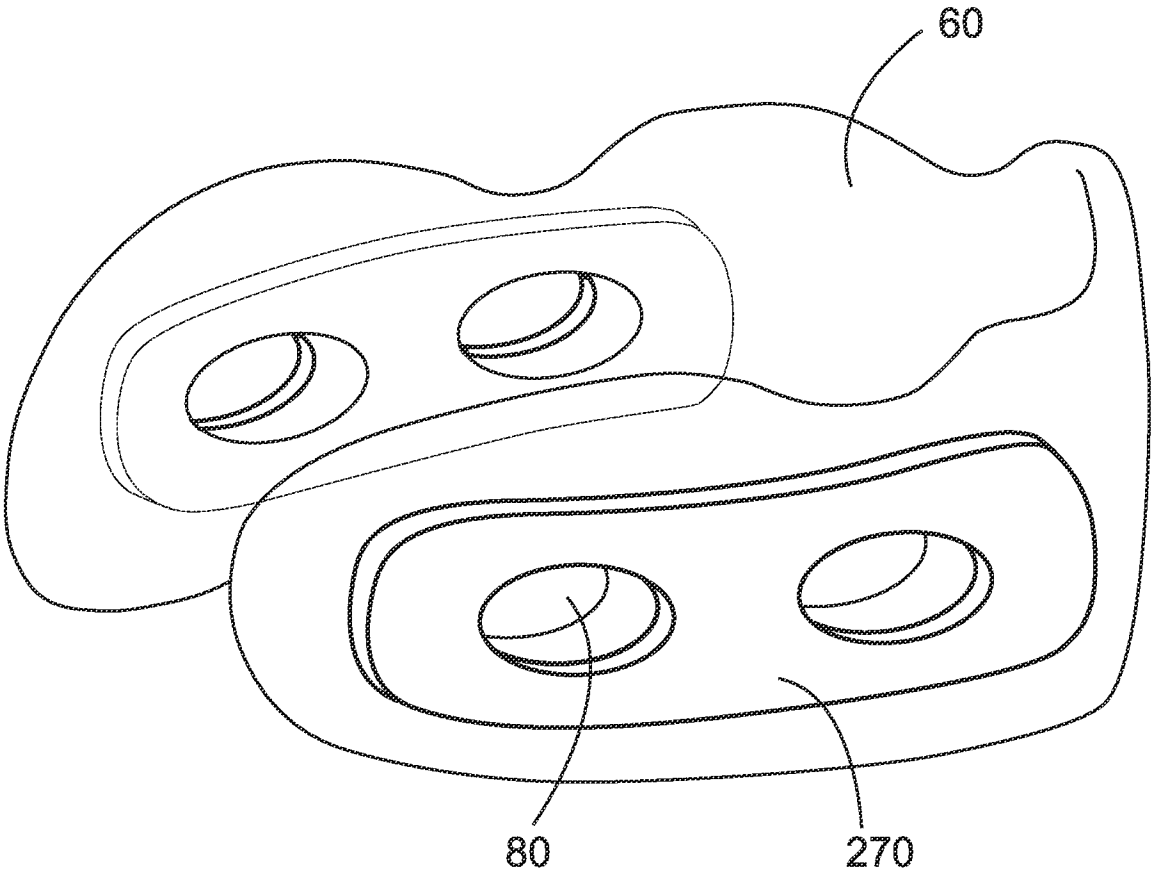
FIG. 28 is a perspective view of another alternate embodiment of the invention having two external frames.

Alternately, the pillow 10 includes the U-shaped cushion 60 and a pair of lateral frames 270 (FIGS. 27-34) at the two side sections 220. Each such lateral frame 270 includes at least one of the ventilation apertures 80 therethrough. In one embodiment, each lateral frame 270 is fixed to either the inside surface 61 or the outside surface 69 of one of the side sections 220 (FIGS. 28 and 30). Alternately, each lateral frame 270 is fixed within one of the side sections 220 (FIGS. 27 and 29). Each lateral frame 270 is preferably made with a material 271 of higher density than the cushion 60 (FIG. 31A).

Figure 32:
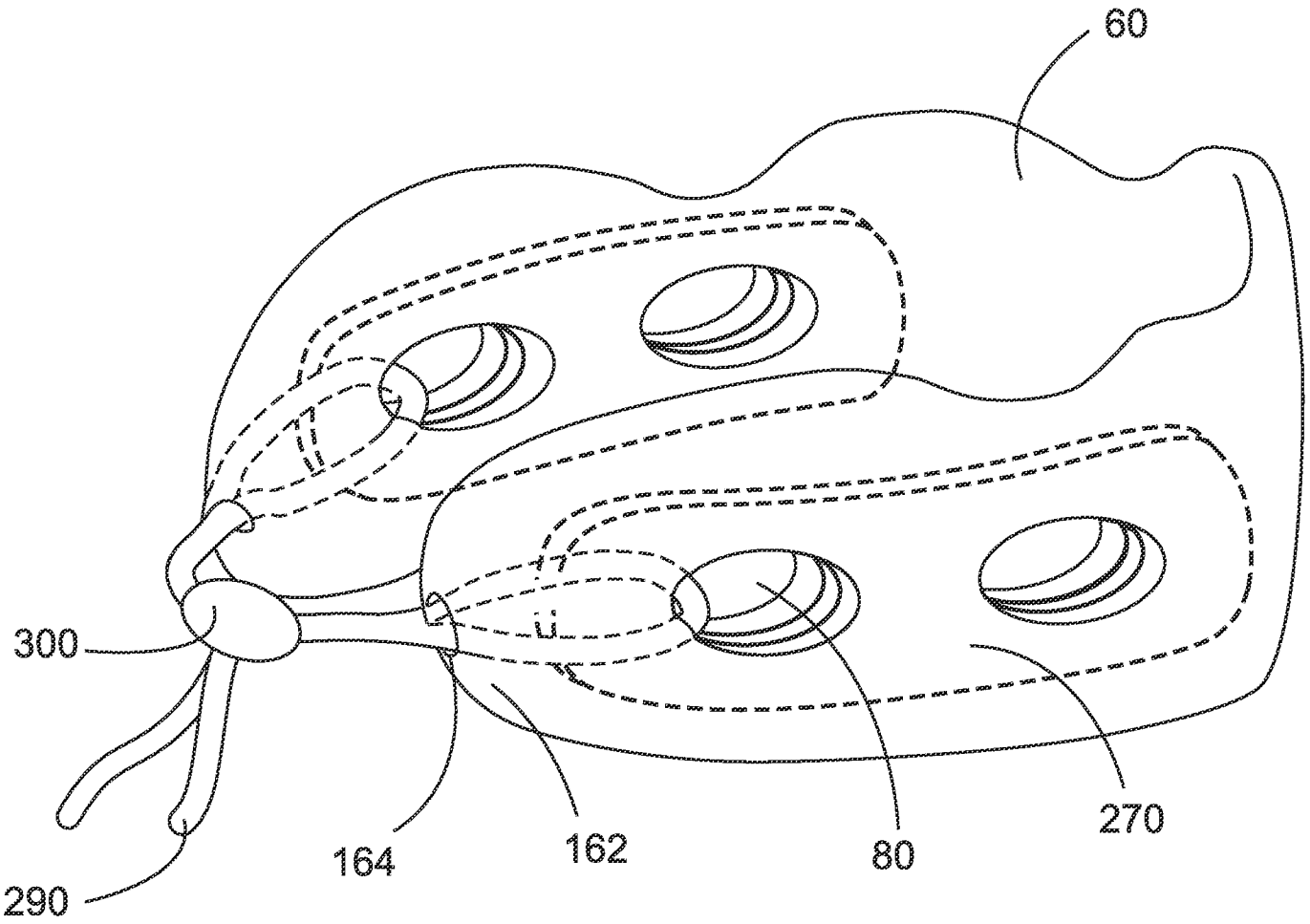
FIG. 32 is a perspective view of an alternate embodiment of FIG. 27, having a tie string looped through two of the ventilation apertures.
Figure 33:
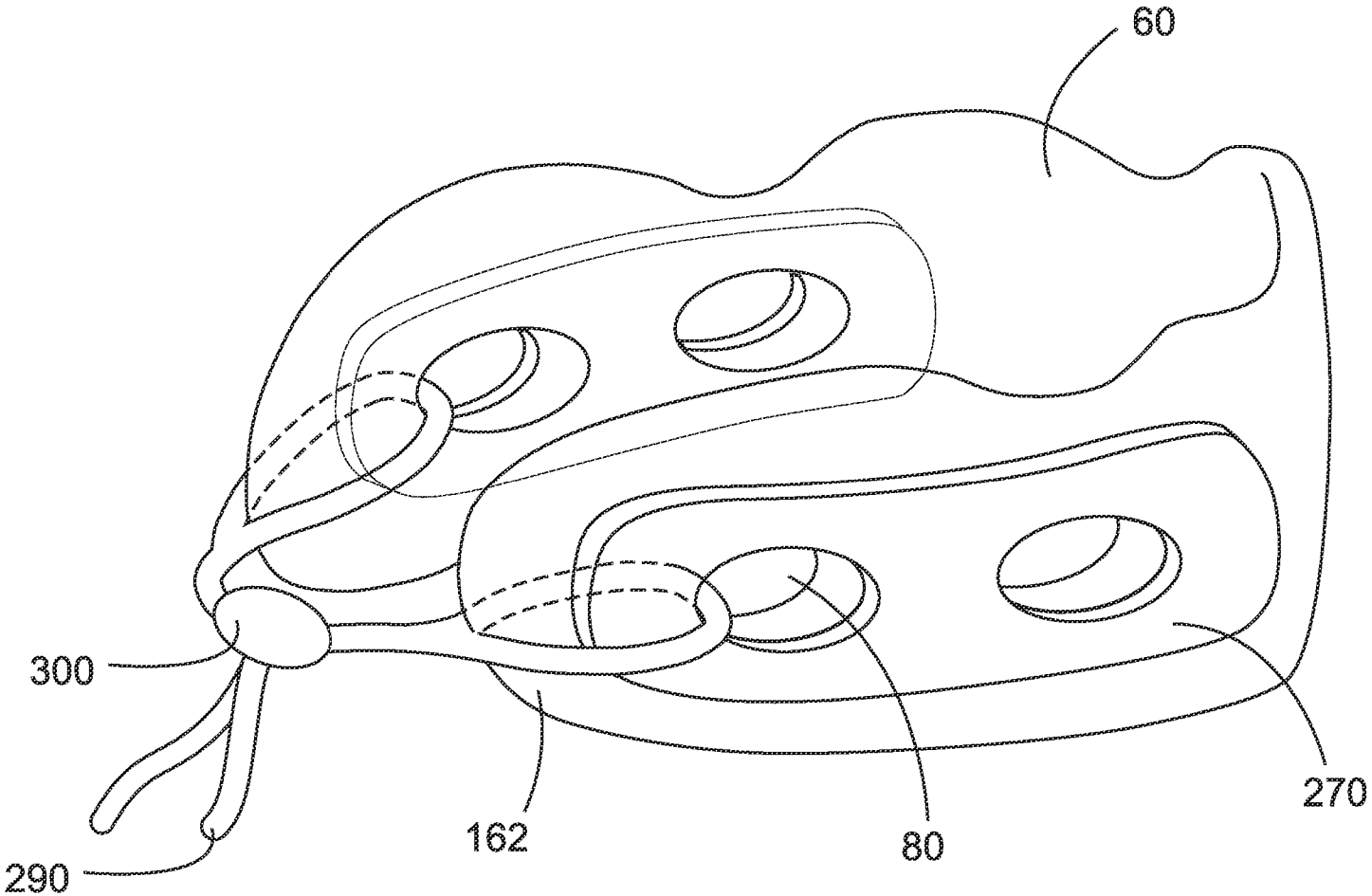
FIG. 33 is a perspective view of an alternate embodiment of FIG. 32.
Figure 34:
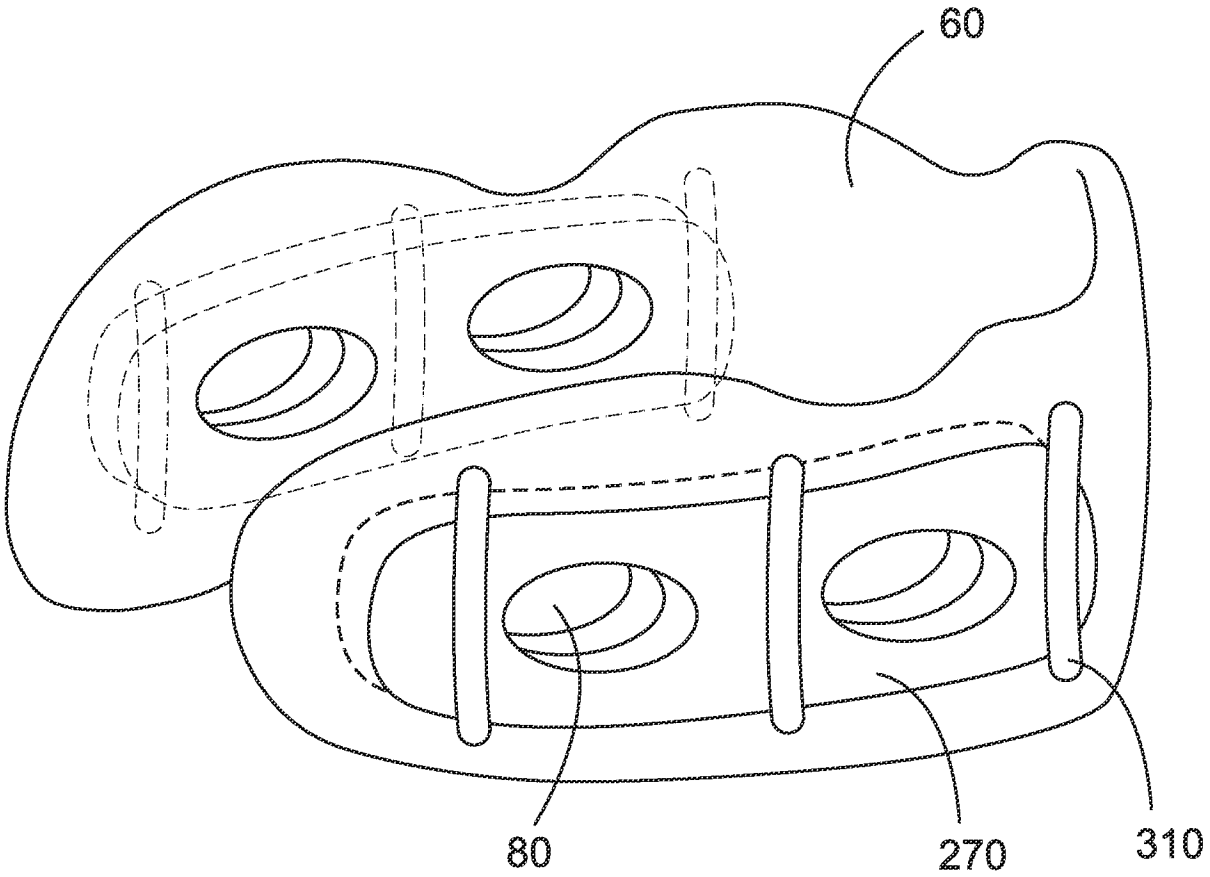
FIG. 34 is a perspective view of an alternate embodiment of FIG. 27 having vertical supports.

In one embodiment, the pillow 10 further includes a pair of tie strings 290 (FIGS. 32 and 33) each looped through one of the forward-most ventilation apertures 80 and adapted to me mutually and selectively fastened, preferably with a two-part mechanical fastener 300. In the embodiment of the pillow 10 having the cover 160, each tie string 290 may be threaded between the cover 160 and the cushion 60, exiting the cover 160 at a forward end 162 of the cover 160 at a tie string aperture 164 (FIG. 32).

Figure 35:
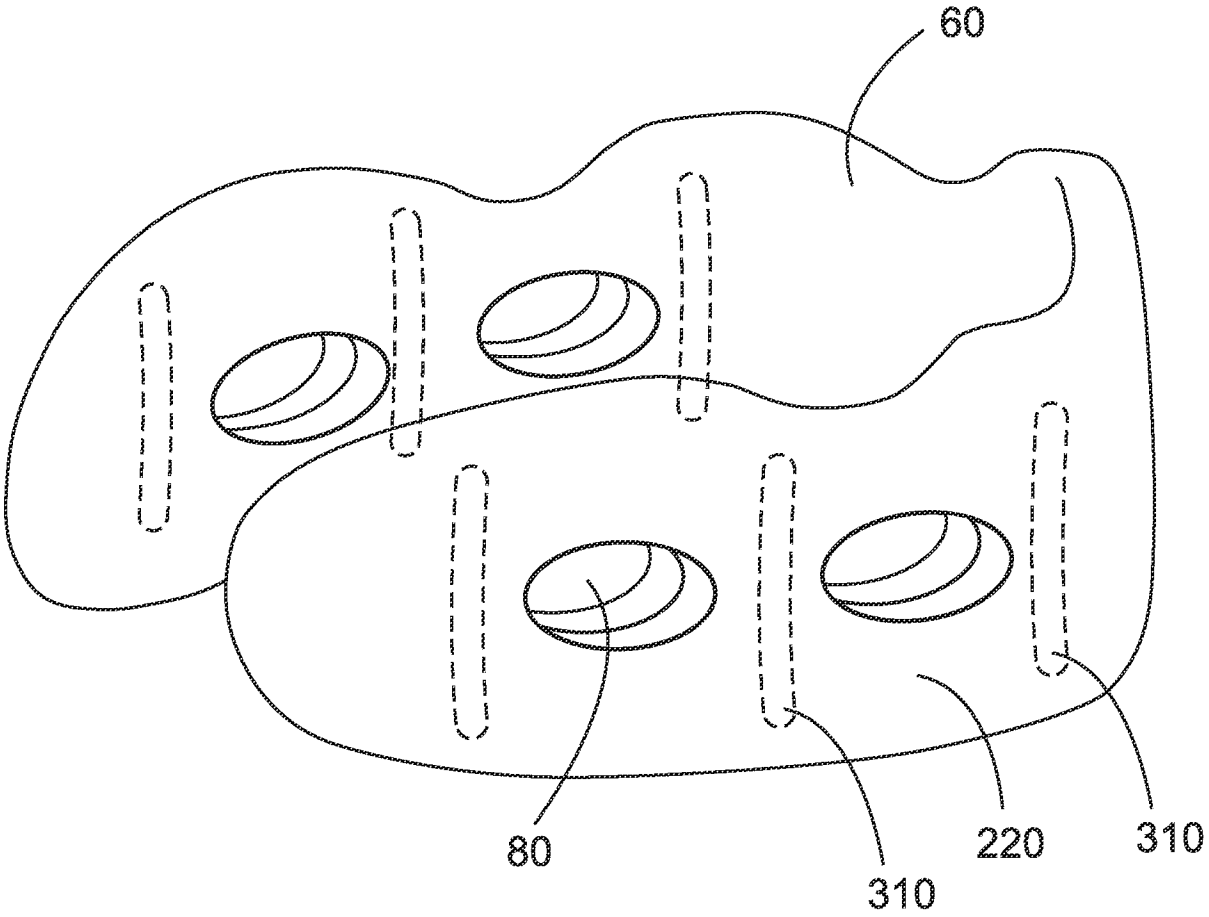
FIG. 35 is a perspective view of an alternate embodiment of FIG. 34.

In one embodiment, a plurality of vertical supports 310 (FIGS. 34-36) is fixed within the cushion 60 on either side of the ventilation apertures 80. Each vertical support has a density higher than the cushion 60, and may be fixed between the outside surface 69 of the cushion 60 and each lateral frame 270.

Figure 36:
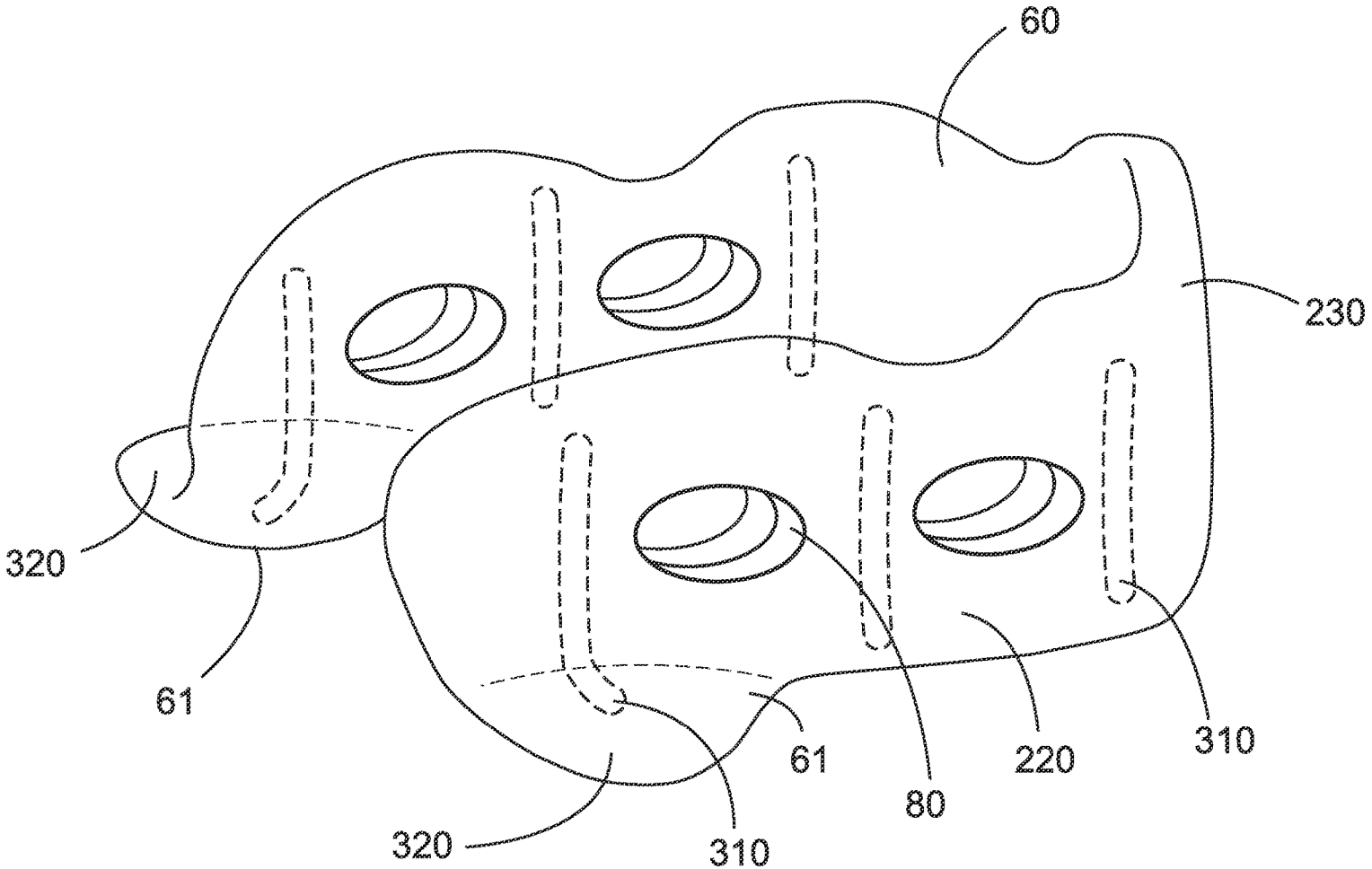
FIG. 36 is a perspective view of another alternate embodiment of FIG. 34.
Figure 37:
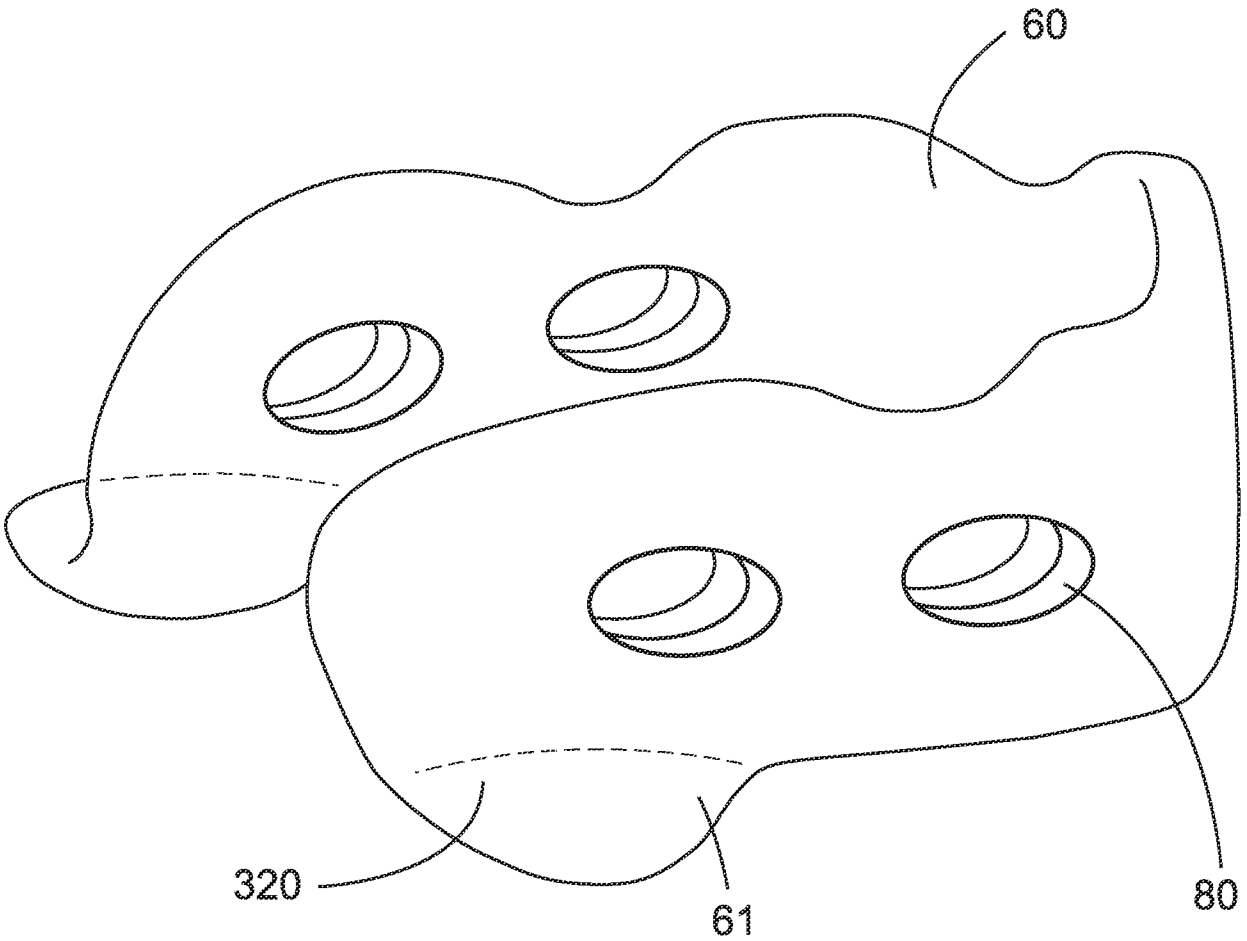
FIG. 37 is a perspective view of yet another alternate embodiment of FIG. 34.

In one embodiment, each side portion 220 of the cushion 60 terminates a lower side 61 thereof with an outwardly-extending flared portion 320 (FIGS. 36 and 37). As such, the lower side 61 and the front sides of each side portion 220 rest on the person's chest to help support the person's head 25 when worn.

Figure 38A:
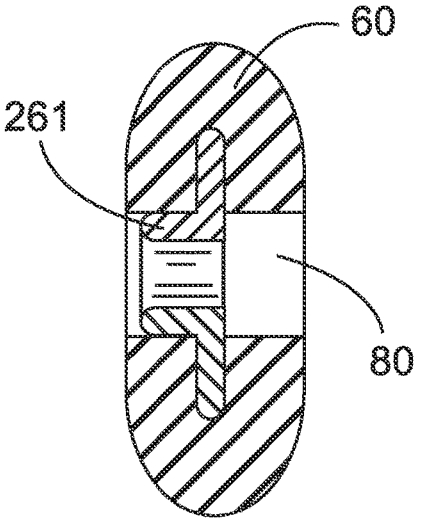
FIG. 38A is a cross-sectional view of a horizontal ventilation apertures, illustrating a cross-sectional view of one embodiment of the frame.
Figure 38B:
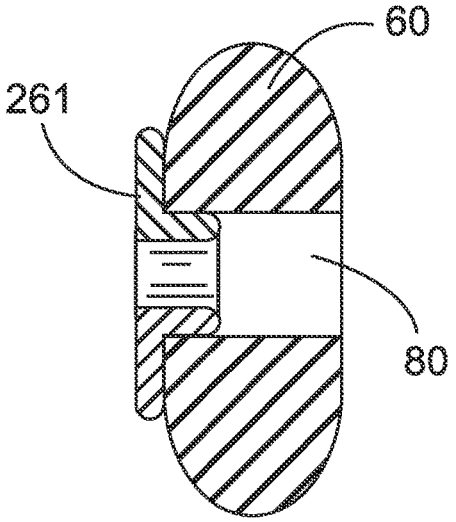
FIG. 38B is a cross-sectional view of a horizontal ventilation apertures, illustrating a cross-sectional view of a second embodiment of the frame.
Figure 38C:
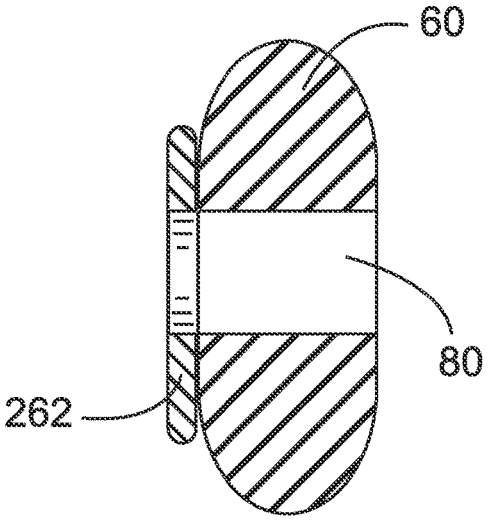
FIG. 38C is a cross-sectional view of a horizontal ventilation apertures, illustrating a cross-sectional view of a third embodiment of the frame.
Figure 38D:
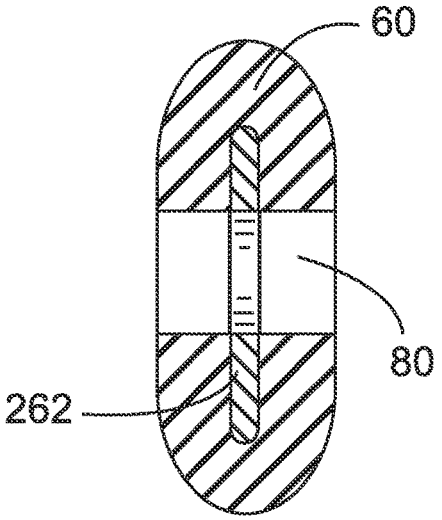
FIG. 38D is a cross-sectional view of a horizontal ventilation apertures, illustrating a cross-sectional view of a forth embodiment of the frame.
Figure 38E:
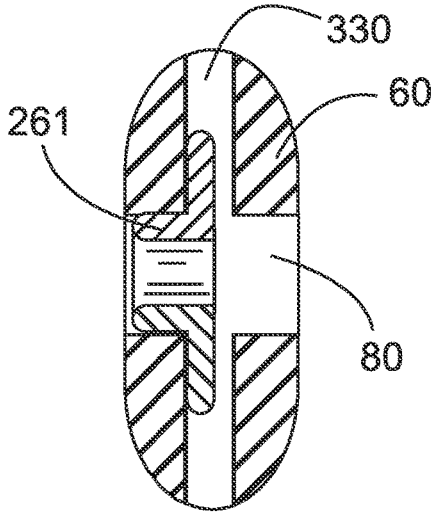
FIG. 38E is a cross-sectional view of a horizontal ventilation apertures, illustrating a cross-sectional view of a fifth embodiment of the frame.
Figure 38F:
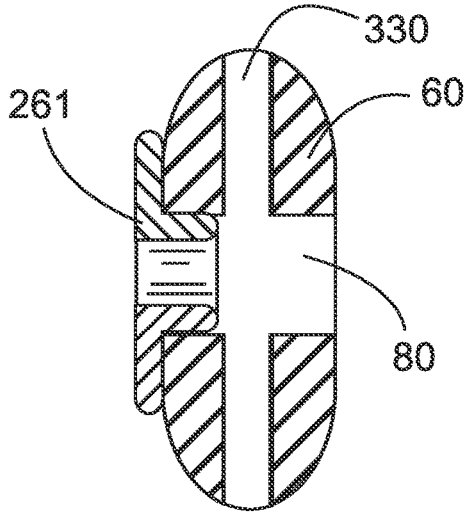
FIG. 38F is a cross-sectional view of a horizontal ventilation apertures, illustrating a cross-sectional view of a sixth embodiment of the frame.
Figure 38G:
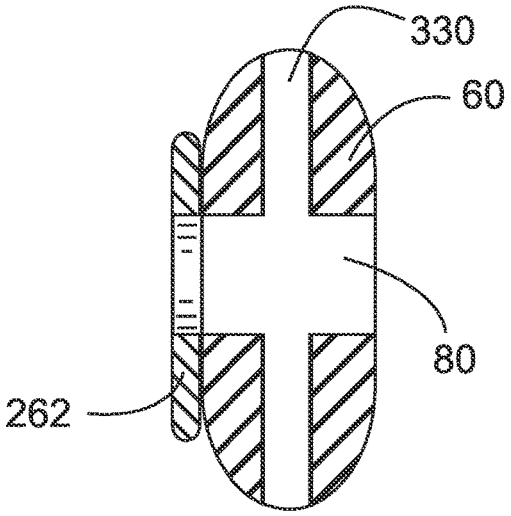
FIG. 38G is a cross-sectional view of a horizontal ventilation apertures, illustrating a cross-sectional view of a seventh embodiment of the frame.
Figure 38H:
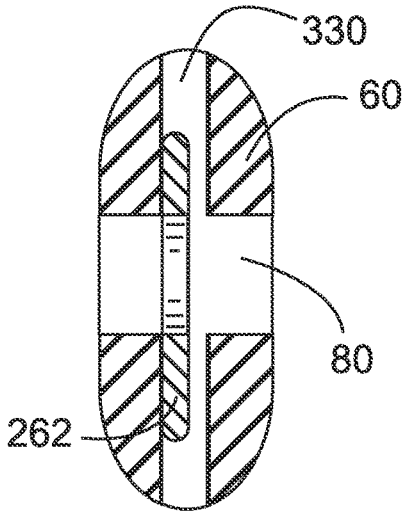
FIG. 38H is a cross-sectional view of a horizontal ventilation apertures, illustrating a cross-sectional view of a eighth embodiment of the frame.
Figures 38J, 38K, 381:
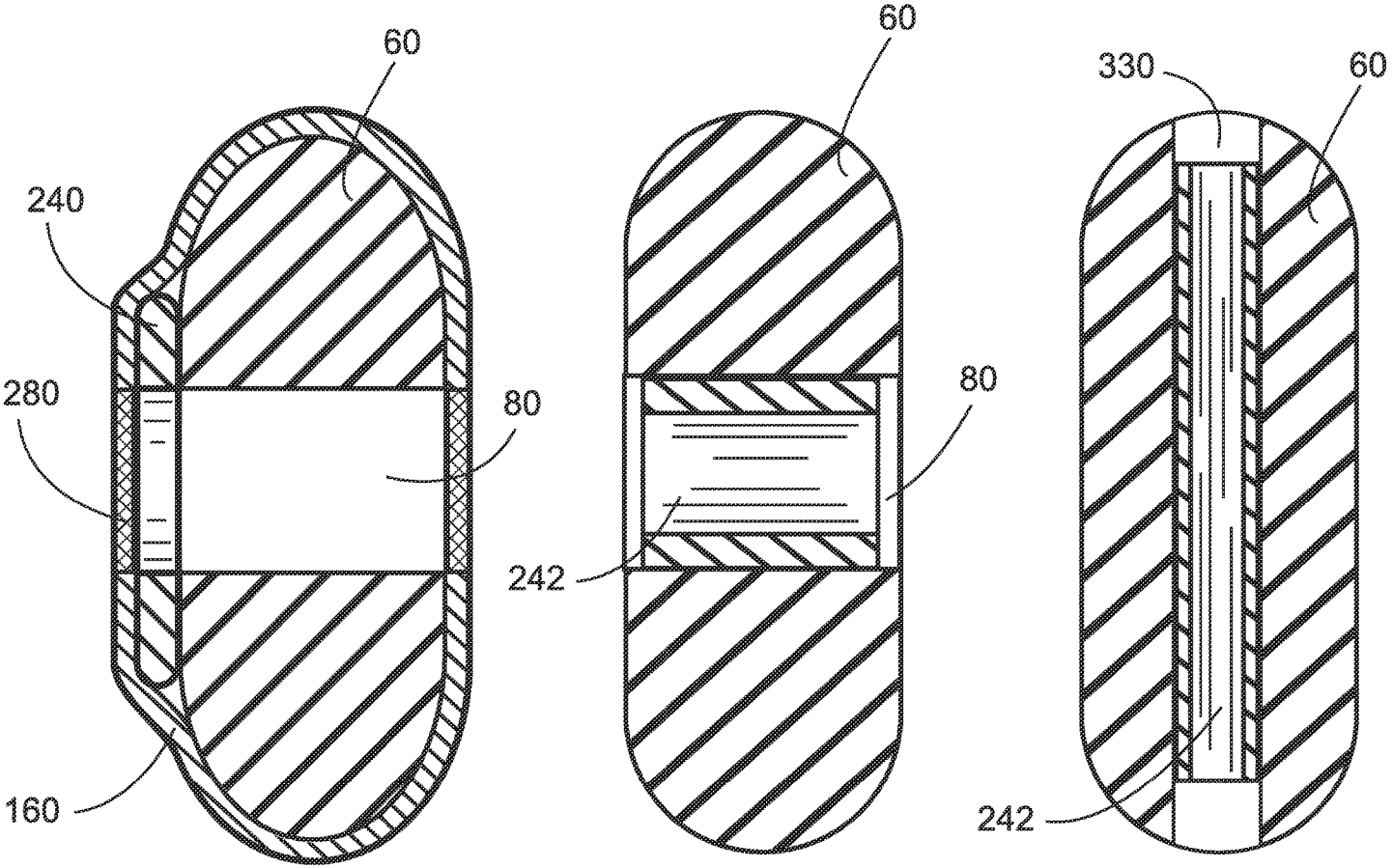
FIG. 38J is a cross-sectional view of a tubular grommet inserted into a horizontal ventilation aperture.
Figure 39:
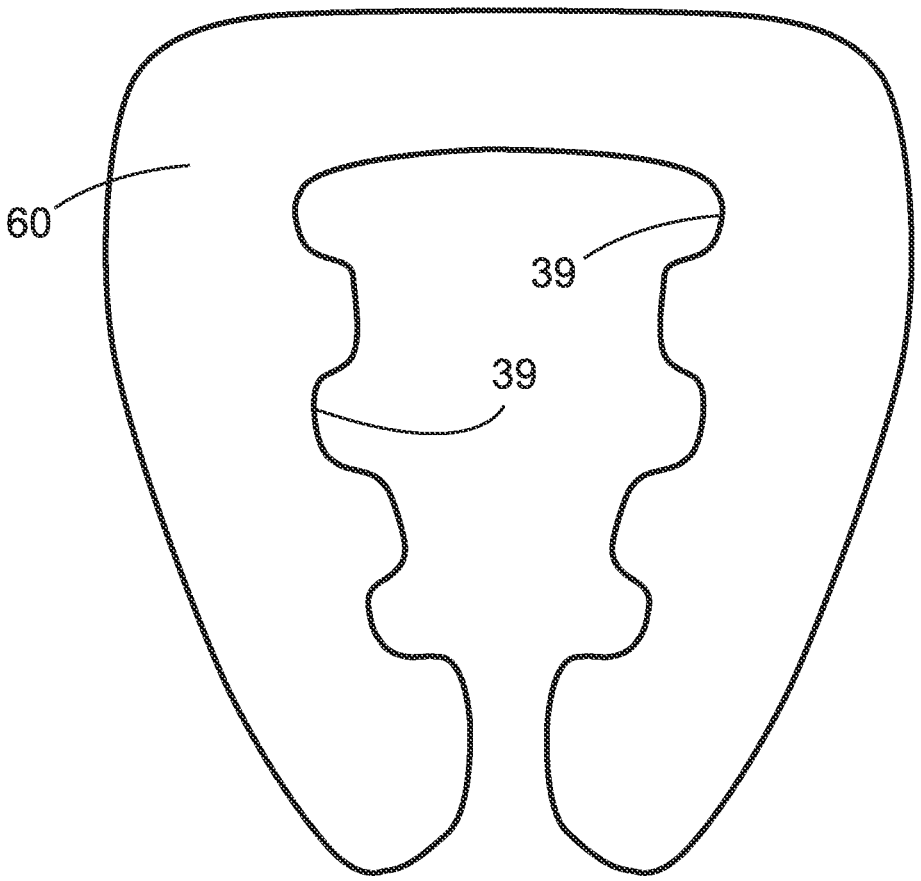
FIG. 39 is a top plan view of an alternate embodiment of the cushion, showing a plurality of vertical ventilation channels.

The pillow 10 may further include a plurality of vertical ventilation apertures 330 (FIGS. 38E-38H and 38K), preferably each intersecting one of the horizontal ventilation apertures 80. The framing grommets 260 may be fixed externally to the cushion 60, internally to the cushion 60, partially or fully within either the horizontal ventilation apertures 80, partially or fully within either the vertical ventilation apertures 330, or both (FIGS. 26A, 26B, and 38A-38I). FIG. 39 illustrates an embodiment wherein the inside surface 61 of the cushion 60 further includes a plurality of vertical ventilation channels 340, each of which preferably intersects one of the horizontal ventilation apertures 80. The framing grommets 260 may take the form of a tube 242 insertable into either the horizontal ventilation aperture 80 (FIG. 38J), or the vertical ventilation aperture 330 (FIG. 38K).

Figure 41:
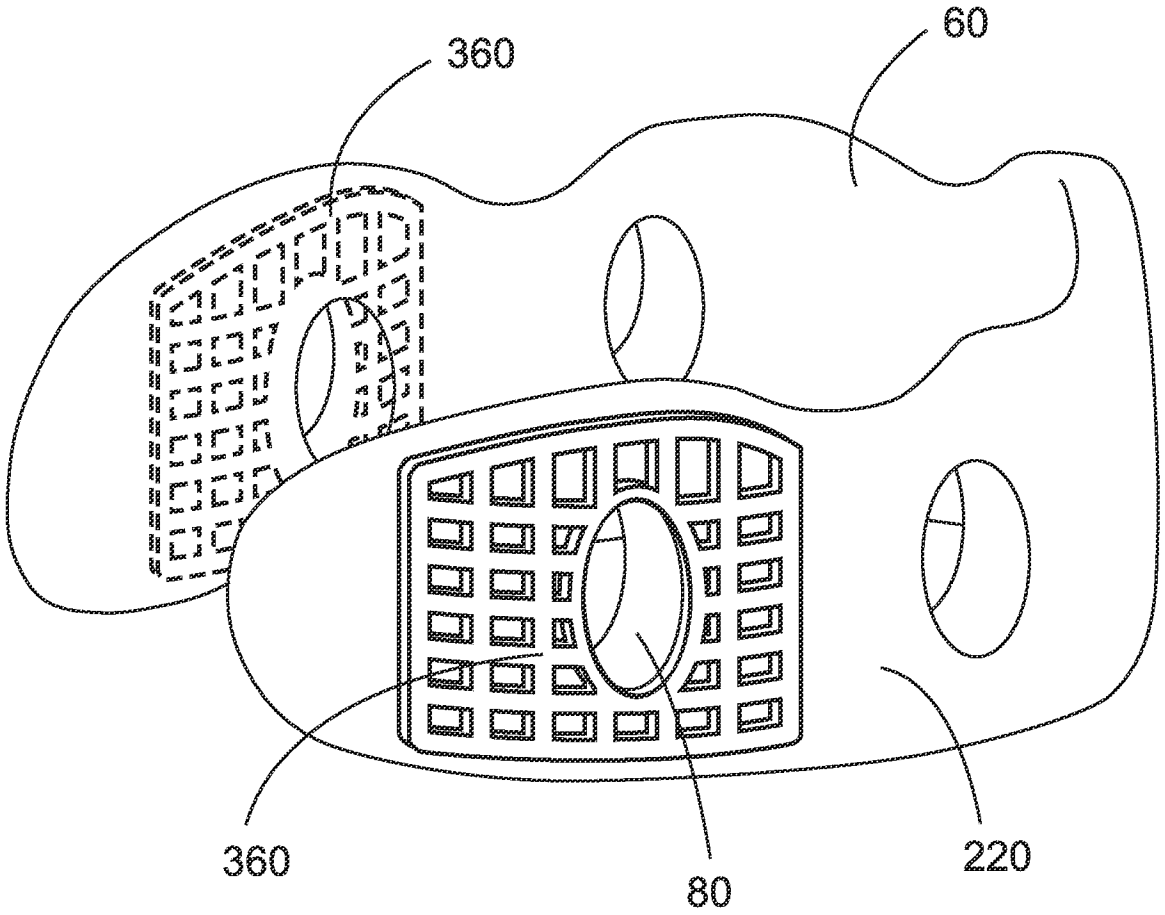
FIG. 41 is a perspective view of one embodiment of the framing grommet.

FIG. 41 illustrates an embodiment of the pillow 10 wherein each lateral frame 270 includes at least one ventilation aperture 80 having a supporting grid 360 thereacross, the frame 270 and grid 360 being integrally formed from a resilient polymer material. The frame 270 and grid 360 may be externally mounted with the cushion 60, or internally mounted.

FIGS. 42-45B illustrate a travel pillow 510 for a person 520. The travel pillow 510 is well suited for use while the person 520 is sitting, such as while traveling by plane, train, automobile, or the like.

Figure 43A:
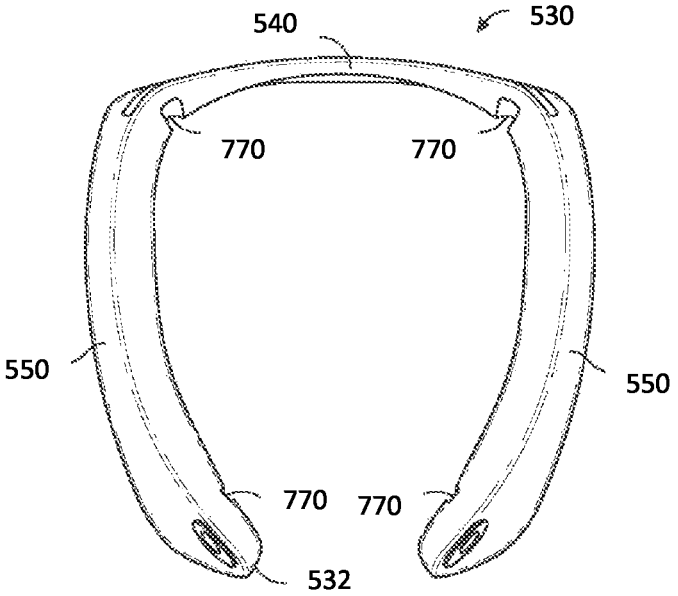
FIG. 43A is a top plan view of an inner frame of the invention.
Figure 43B:
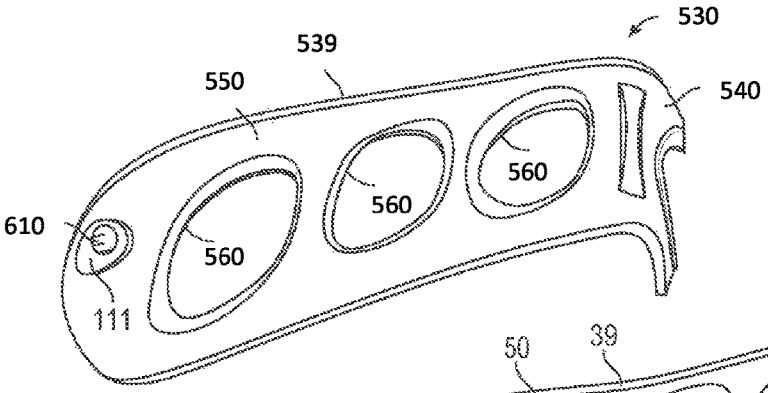
FIG. 43B is a right-side elevational view thereof.
Figure 43C:
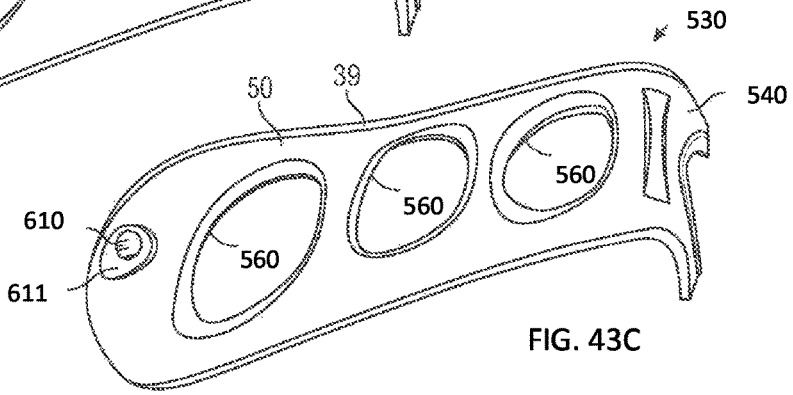
FIG. 43C is an alternate right-side elevational view thereof.

A resilient inner frame 530 includes a rear portion 540 and two side portions 550. The inner frame 530 is preferably U-shaped (FIG. 43A). Each side portion 550, and optionally the rear portion 540, includes at least one lateral, transverse air apertures 560 therethrough (FIG. 43B). Each side portion 550 of the inner frame 530 further includes a forward end 532. A top portion 539 of the inner frame 530 is preferably linear (FIG. 43B), or concave (FIG. 43C) to allow for a comfortable interface between the person's jaw and cheek areas 522 and the travel pillow 510. The top portion 539 of the side portions 550 of the inner frame 530 may also be concave in shape in a front elevational view (FIG. 47), further providing for cupping of the person's jaw and cheek areas 522. The inner frame 530 is made with a resilient plastic or foam material. While the inner frame 530 is preferably U-shaped, as illustrated in FIG. 43A, other embodiments may include a two-part inner frame comprising of the two side portions 550 without the rear portion 540, or three discrete pieces comprising the two side portions 550 and the rear portion 540 that are not in mutual contact, or the like.

A U-shaped outer cushion 570 is fixed about the inner frame 530 and includes a rear portion 580 and two side portions 590. Each side portion 590, and optionally the rear portion 580, includes at least one lateral, transverse air apertures 600 therethrough that are each aligned with one of the air apertures 560 of the inner frame 530. Each side portion 590 of the outer cushion 570 further includes a forward end 572. The outer cushion 570 is made with a pliable or malleable material, such as so-called memory foam, soft rubber, or the like.

In one embodiment, an upper front portion 559 (FIG. 44B) of the side portions 590 extends upward for contacting the person's jaw and cheek areas 522 to support the person's head 525 in a neutral position. The upper front portion 559 of each side portion 590 is padded such that the cushion 570 compresses at least slightly for continuous support of the person's head 525 when the person's head 525 is in the neutral position, upright and balanced from side-to-side.

Figure 46:
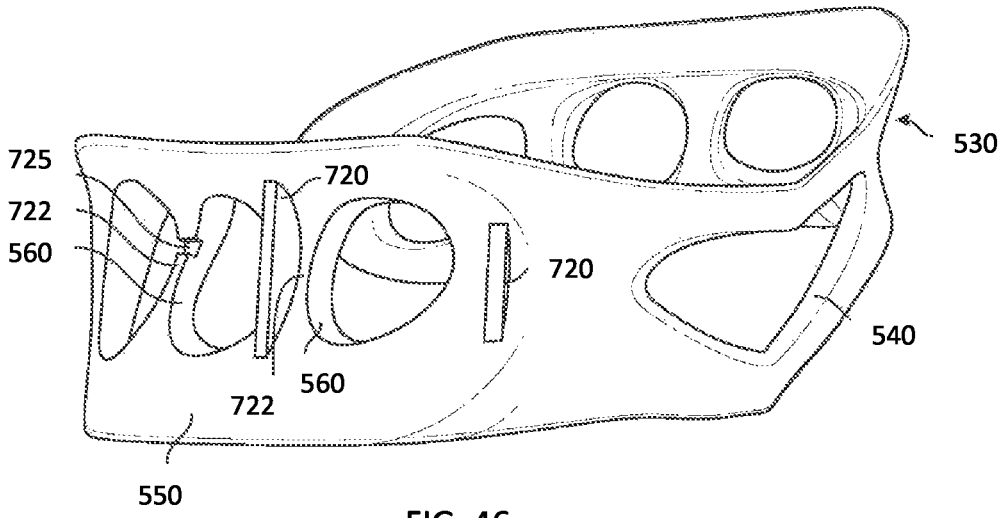
FIG. 46 is a rear perspective view of one embodiment of the inner frame.
Figure 49A:
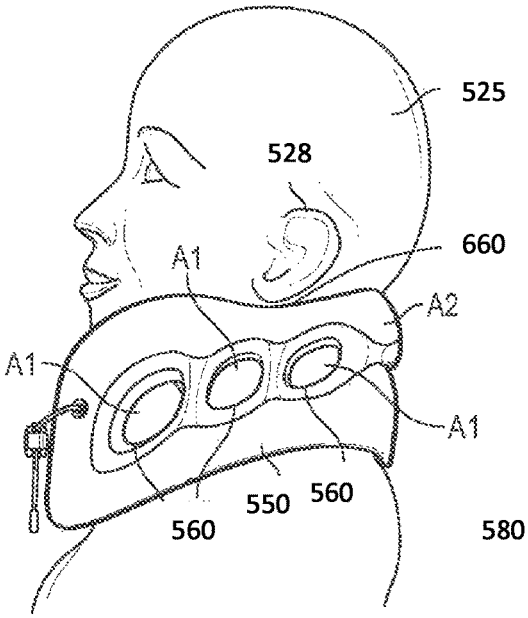
FIG. 49A is a side elevational view of the invention, showing an air aperture area as compared to a non-aperture area.
Figure 49B:
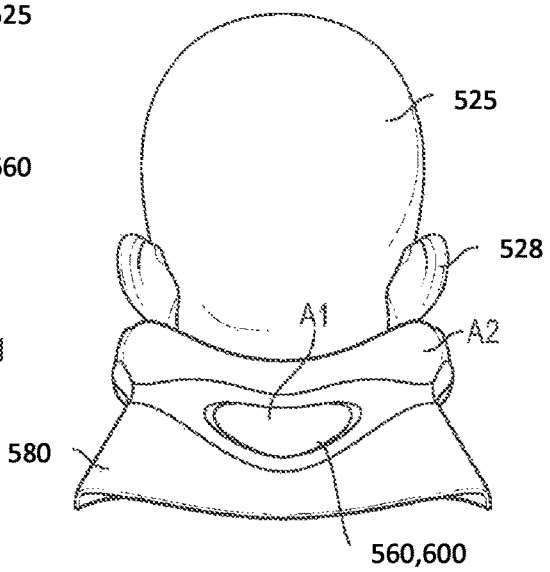
FIG. 49B is a rear elevational view of the invention, showing an air aperture area as compared to a non-aperture area.

The air apertures 560,600 preferably cover a surface area A1 of between 5% and 85% compared to the non-aperture area A2 (FIGS. 49A and 49B), providing for flexion under load compression, and an abundance of air flow through to the person's neck 526. As such, the air apertures 560,600 in the inner frame 530 and the outer cushion 570 allow the top side 571 to flex under the weight of the person's head 525. The relative size of each of the apertures 560,600 may vary in size to allow different compression characteristics along the length of the travel pillow 510. For example, apertures 560,600 at the rear portions 540,580 may be relatively small for better structurally support. Moreover, a plurality of reinforcements 720 (FIG. 46) may be fixed with the inner frame 530 between certain of the air apertures 560 on pillars 722 formed therebetween in order to reduce bending of the inner frame 530 except at a top portion 539 thereof. One or more flex grooves 725 may also be formed in one or more of the resilient pillars 722 to further promote flexing thereof when under pressure at the flex grooves 725.

Each side portion 550 of the inner frame 530 preferably further includes at least one folding groove 770 proximate the rear portion 540 (FIG. 43A). As such, the side portions 590 of the outer cushion 570 and the side portions 550 of the inner frame 530 may each be folded towards the rear portions 540,580 for compact storing of the travel pillow 510. A similar folding groove 770 may be included at corresponding locations on the outer cushion 570 as well (not shown). Another folding groove 770 proximate the front end 532 of the inner frame 530 may be included for providing better fitting around a smaller person 520.

The travel pillow 510 preferably further includes a closure mechanism 620 fixed with the side portions 532,572 of the inner frame 530 and/or the outer cushion 570. Preferably the side portions 550,590 of the inner frame 530 and the outer cushion 570 each include a drawstring aperture 610 at a forward end 532,572 thereof, respectively. The closure mechanism 620 may include, for example, a drawstring 621 traversing the drawstring apertures 610 of each side portion 550,590. Such a drawstring 621 is adapted to selectively and adjustably hold the forward ends 532,572 mutually together. Alternately, the closure mechanism 620 may be the drawstring 621 traversing at least one of the air apertures 560,600 instead of the drawstring apertures 610. Alternately, the closure mechanism 620 may be a length of hook-and-loop type fastening material (not shown) looped through at least one of the air apertures 560,600, or a strap with a mechanical snap fastener (not shown), or the like.

Figure 42:
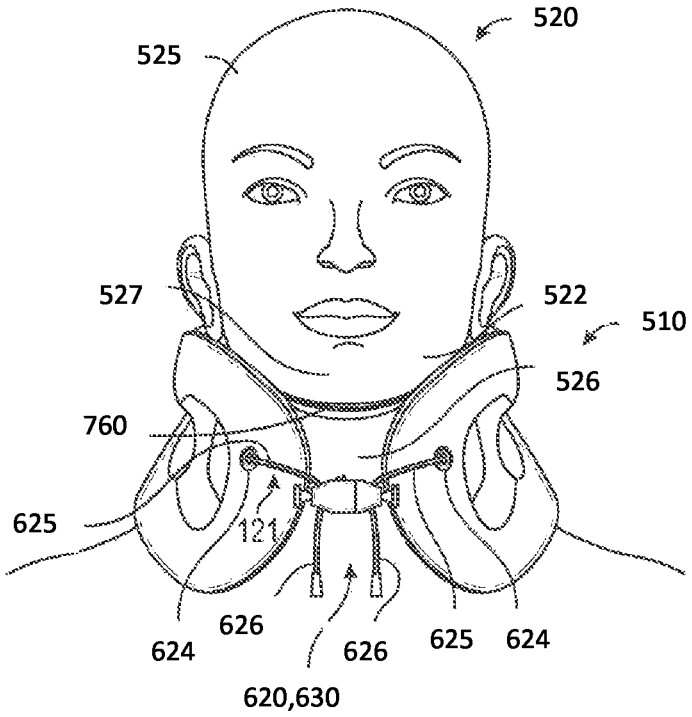
FIG. 42 is a front elevational view of the invention.
Figure 45A:
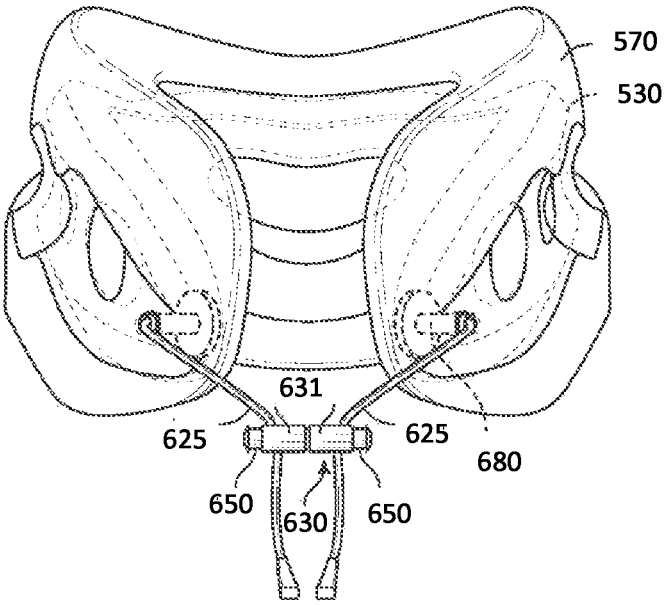
FIG. 45A is a front elevational view of the invention, illustrating in phantom outline the position of the internal frame within an outer cushion of the invention.
Figure 45B:
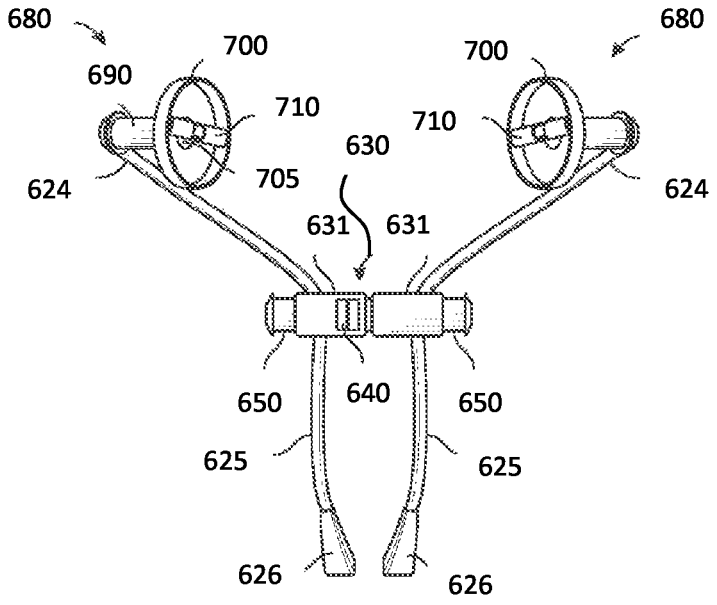
FIG. 45B is a front elevational view of a closure mechanism of the invention, illustrated with the inner frame and the cushion omitted for clarity of illustration.

The drawstring 621 preferably includes two halves 625, each of which is fixed a a proximal end 624 thereof to the side portions 550,590 of the inner frame 530 and the outer cushion 570 at one of the drawstring apertures 610 thereof. Each drawstring half 625 is mutually and selectively fixable at a distal end 626 thereof at one part 631 of a two-part mechanical fastener 630 (FIGS. 42, 45A & 45B). Such a two-part mechanical fastener 630 preferably includes at least one magnet 640 for holding each part 631 together. Each part 631 of the two-part mechanical fastener 630 further preferably includes a spring-biased drawstring cinch mechanism 650 for selectively fixing the part 631 to one of the drawstring halves 625 at a selected position along the length of the drawstring half 625.

A pair of drawstring anchors 680 (FIGS. 45A, 45B) may be included, each having a tube 690 fixed with a center portion 705 of a disk 700. The tube 690 is adapted for fitting within one of the drawstring apertures 610, and the disk 700 is large enough to prevent the anchor 680 from traversing the drawstring aperture 610. The proximal end 624 of each drawstring half 625 terminates at a T-shaped anchor 710 which is able to traverse each drawstring apertures 610 when aligned with the end 624 of the drawstring half 625, but when flipped 90-degrees is retained by the disk 700 and prevented from being pulled back through the drawstring aperture 610. As such, the drawstring 621 may not be pulled through the inner frame 530 or outer cushion 570. Both the inner frame 530 and the outer cushion 570 may further include a thicker anchor reinforcement area 611 about the drawstring apertures 610 to further inhibit the drawstring 620 from being pulled through or ripping the outer cushion 570 or the inner frame 530.

In one embodiment of the invention, each side portion 590 of the outer cushion 570 includes an ear depression 660 (FIG. 49A) formed in a top side 571 thereof. Such an ear depression 660 is adapted to reduce the chance of contact between the top side 571 of the outer cushion 570 with the person's ears 528, earphones (not shown), ear buds (not shown), or the like.

Preferably, at least a portion of an inside surface 574 of the outer cushion 570 at the top side 571 thereof or a center portion 575 thereof (FIG. 47) is sloped inwardly with respect to a bottom side 579 thereof, preferably at an angle α of between 2 and 85-degrees. Preferably, along the inside surface 574, the center portion 575 protrudes inwardly along at least one portion of its length with respect to the top and bottom sides 571,579 of the outer cushion. This angle α may vary along the length of the side portions 590 and rear portion 580.

In such an embodiment, the inner frame 530 is preferably C-shaped in cross section (FIG. 47), preferably at least along part of the side portions 550. As such, the top portion 539 of the inner frame 530 may flex under the weight of the person's head 525 as the lower part of the inner frame 530 resists flexing.

Figure 48:
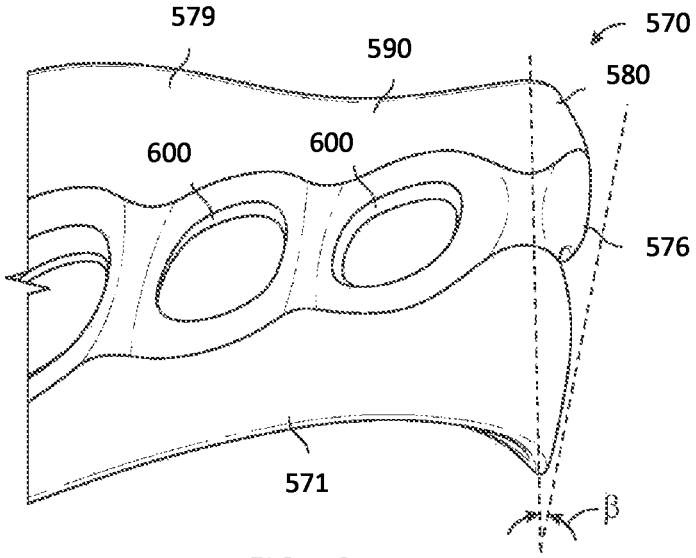
FIG. 48 is a partial side elevational view of another embodiment showing a rear portion of the invention sloped with respect to vertical.

In one embodiment, an outside surface 576 of the outer cushion 570 at the top side 571 thereof is sloped outwardly with respect to the bottom side 579 thereof, preferably at an angle β of between 2 and 30-degrees (FIG. 48). As such, contact between the outer cushion 570 and a seat (not shown) urges the travel pillow 510 to tilt forward rather than backward, a forward tilt of the travel pillow 510 being more comfortable to the person 520 and reducing the choking effect caused when such a travel pillow is tilted upward. That notwithstanding, the rear portions 540,580 are thin enough to minimize pressure transmitted from the seat through the rear portions 540,580 to the back of the person's head 525.

Figure 44A:
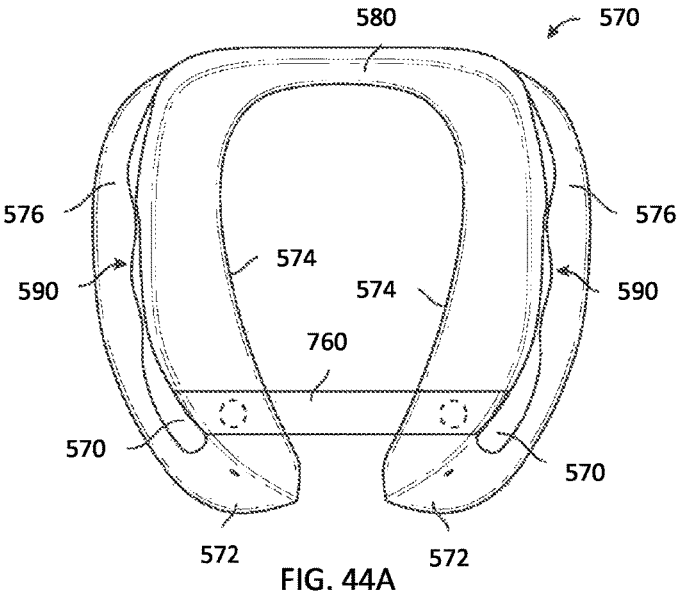
FIG. 44A is a top plan view of the invention.
Figure 47:
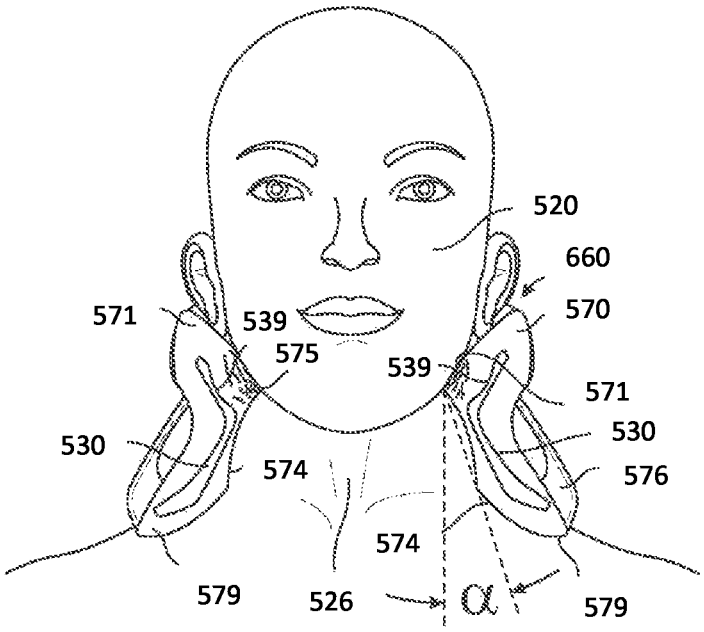
FIG. 47 is a front elevational view of another embodiment, illustrated with the inner frame and outer cushion cut away to show the interface between the invention and a person's jaw.

In one embodiment, each side portion 590 of the outer cushion 570 further includes a jawbone depression 670 formed in the top side 571 thereof, such that the travel pillow 510 generally fits under and around a person's jaw 522 to support his head 525 (FIGS. 44A and 47). Preferably when the person's head 525 is in a neutral vertical position, the top side 571 of the outer cushion 570 is compressed slightly to provide support to the person's head 525 in the neutral position (FIG. 42).

Figure 51A:
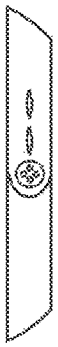
FIG. 51A is a top plan view of one embodiment of a chin sling of the invention.
Figure 51B:
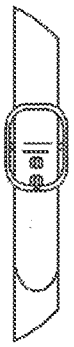
FIG. 51B is a top plan view of an alternate embodiment of the chin sling.
Figure 44B:
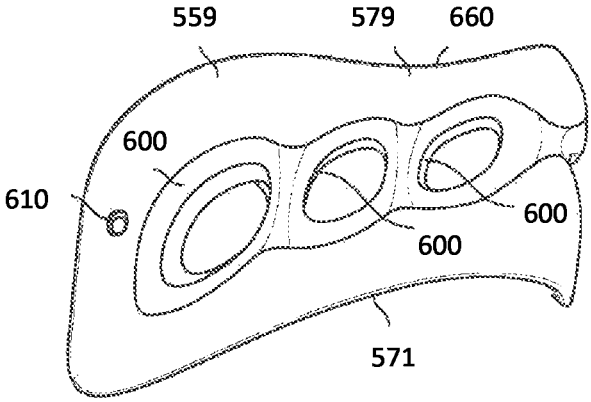
FIG. 44B is a right-side elevational view thereof.

A flexible, preferably elastic chin sling 760 (FIGS. 44A, 51A, & 51B) may be fixed between the forward ends 572 of each side portion 590 of the outer cushion 570. Such a chin sling 760 is adapted to support the person's chin 527 to keep the person's head 525 in a substantially upright position. The sling 760 may be adjustable in location, length and elasticity, and may also function as the closure mechanism 620.

Such a chin sling 760 may include the mechanical two-part fastener 630 such as buttons (FIG. 51A), snaps (not shown), a buckle (FIG. 51B), magnets (FIG. 44A), hook and loop-type material (not shown), or the like. Such a chin sling 760 may be selectively removable from one of the side portions 590 or both of the side portions 590.

Figure 50:
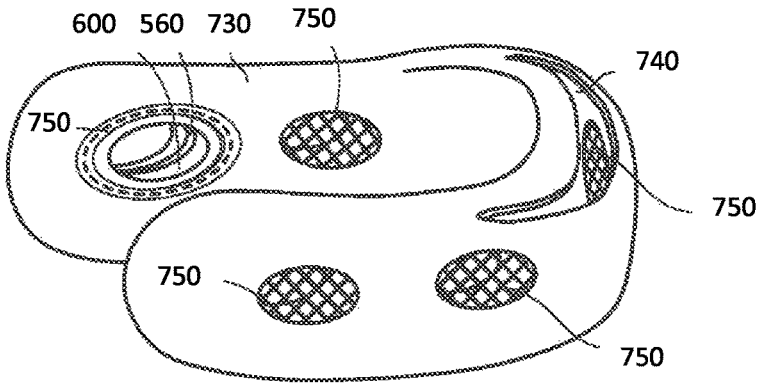
FIG. 50 is a bottom perspective view of a cover of the invention.

In one embodiment, the travel pillow 510 further includes a flexible cover 730 (FIG. 50) that has an opening 740 therethrough into which the inner frame 30 and the outer cushion 570 are inserted. The cover 730 includes at least one ventilation area 750 through which air may travel through the cover 730, the air apertures 560,600 of the inner frame 530 and the outer cushion 570, and through the cover 730 again. Preferably the cover includes a flexible 4-way stretch fabric.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A travel pillow comprising: a U-shaped cushion comprising: two non-contiguous side cushion portions spaced apart by a rear cushion portion; each side cushion portion and the rear cushion portion comprising an outer surface and an inner surface, the respective inner surfaces oriented towards each other, each side cushion portion further comprising one or more substantially horizontally positioned cushion apertures each defining a cavity spanning from said outer surface to said inner surface; a cover configured to enclose said U-shaped cushion, said cover comprising one or more ventilation areas configured to align with said one or more cushion apertures; a frame within said U-shaped cushion, said frame having a higher density than said U-shaped cushion, said frame comprising: two side frame portions spaced apart by a rear frame portion; each side frame portion shaped to define one or more frame apertures configured to be substantially aligned with one of said cushion apertures; and the rear frame portion positioned between said side frame portions.

2. The travel pillow of claim 1, wherein said rear cushion portion further comprises one or more substantially horizontally positioned rear cushion apertures each defining a cavity spanning from said outer surface to said inner surface of the rear cushion portion, and wherein said rear frame portion is shaped to define one or more rear frame apertures substantially aligned with one of said rear cushion apertures.

3. The travel pillow of claim 1, wherein said rear cushion portion further comprises one or more substantially horizontally positioned rear cushion apertures each defining a cavity spanning from said outer surface to said inner surface of the rear cushion portion.

4. The travel pillow of claim 1, wherein each of said side cushion portions comprises an upper front portion that extends upward for contacting a person's jaw and cheek areas to support the person's head.

5. The travel pillow of claim 1, wherein each of said cushion apertures, and said ventilation areas is oriented so as to allow air flow generally toward or away from a user's neck.

* * * * *